US010238910B2

(12) United States Patent
Lagree et al.

(10) Patent No.: US 10,238,910 B2
(45) **Date of Patent: *Mar. 26, 2019**

(54) MULTI-AXIS ADJUSTABLE EXERCISE MACHINE

(71) Applicant: Lagree Technologies, Inc., Burbank, CA (US)

(72) Inventors: Sebastien Anthony Louis Lagree, Burbank, CA (US); Samuel D. Cox, Yuba City, CA (US); Todd G. Remund, Yuba City, CA (US)

(73) Assignee: Lagree Technologies, Inc., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/917,878

(22) Filed: Mar. 12, 2018

(65) Prior Publication Data

US 2018/0193691 A1 Jul. 12, 2018

Related U.S. Application Data

(63) Continuation of application No. 15/785,409, filed on Oct. 16, 2017, now Pat. No. 9,914,014, which is a (Continued)

(51) Int. Cl.
*A63B 22/00* (2006.01)
*A63B 22/20* (2006.01)
(Continued)

(52) U.S. Cl.
CPC .... *A63B 22/0023* (2013.01); *A63B 21/00069* (2013.01); *A63B 21/023* (2013.01);
(Continued)

(58) Field of Classification Search
CPC ..... A63B 22/0023; A63B 22/0087; A63B 22/0089; A63B 22/20–22/208
See application file for complete search history.

(56) References Cited

U.S. PATENT DOCUMENTS 1,866,868 A 7/1932 Thomson
3,770,267 A 11/1973 McCarthy
(Continued)

FOREIGN PATENT DOCUMENTS

EP 0354785 2/1990
KR 101226434 1/2013
WO WO 2008/010797 1/2008

OTHER PUBLICATIONS

PCT Search Report from Korean Intellectual Property Office for US2017028393; dated Jan. 11, 2017.
(Continued)

*Primary Examiner* — Nyca T Nguyen
(74) *Attorney, Agent, or Firm* — Neustel Law Offices

(57) ABSTRACT

A multi-axis adjustable exercise machine which is pivotable about both a pitch axis and a roll axis with respect to a base for allowing an exerciser to perform a wide range of exercises on a pitched or rolled exercise machine. The multi-axis adjustable exercise machine generally includes an exercise machine which is adjustable with respect to a base. The exercise machine may be pivoted about a roll axis to adjust the roll angle of the exercise machine or may be pivoted about a pitch axis to adjust the pitch angle of the exercise machine. One or more actuators may be connected between the base and the exercise machine to effectuate the pivoting of the exercise machine about either or both axes with respect to the base.

45 Claims, 48 Drawing Sheets

Related U.S. Application Data continuation of application No. 15/595,258, filed on May 15, 2017, now Pat. No. 9,789,354, which is a continuation of application No. 15/395,041, filed on Dec. 30, 2016, now Pat. No. 9,649,526, which is a continuation of application No. 15/332,786, filed on Oct. 24, 2016, now Pat. No. 9,533,184, which is a continuation of application No. 15/187,728, filed on Jun. 20, 2016, now Pat. No. 9,474,926, which is a continuation of application No. 14/725,908, filed on May 29, 2015, now Pat. No. 9,370,679, which is a continuation-in-part of application No. 14/468,958, filed on Aug. 26, 2014, now Pat. No. 9,211,440.

(60) Provisional application No. 61/869,904, filed on Aug. 26, 2013, provisional application No. 62/004,936, filed on May 30, 2014.

(51) Int. Cl.

| | |
|---|---|
| ***A63B 21/068*** | (2006.01) |
| ***A63B 21/055*** | (2006.01) |
| ***A63B 24/00*** | (2006.01) |
| ***A63B 21/04*** | (2006.01) |
| ***A63B 21/00*** | (2006.01) |
| ***A63B 21/02*** | (2006.01) |
| ***A63B 23/02*** | (2006.01) |
| *A63B 21/008* | (2006.01) |
| *A63B 22/02* | (2006.01) |
| *A63B 22/06* | (2006.01) |
| *A63B 22/18* | (2006.01) |
| *A63B 23/035* | (2006.01) |
| *A63B 23/04* | (2006.01) |
| *A63B 23/12* | (2006.01) |
| *A63B 23/00* | (2006.01) |

(52) U.S. Cl.

CPC ..... *A63B 21/0428* (2013.01); *A63B 21/0552* (2013.01); *A63B 21/068* (2013.01); *A63B 21/4033* (2015.10); *A63B 21/4045* (2015.10); *A63B 22/0002* (2013.01); *A63B 22/0012* (2013.01); *A63B 22/0046* (2013.01); *A63B 22/0087* (2013.01); *A63B 22/0089* (2013.01); *A63B 23/0205* (2013.01); *A63B 23/0233* (2013.01); *A63B 24/0075* (2013.01); *A63B 24/0084* (2013.01); *A63B 24/0087* (2013.01); *A63B 21/00061* (2013.01); *A63B 21/00065* (2013.01); *A63B 21/0083* (2013.01); *A63B 21/0087* (2013.01); *A63B 21/0442* (2013.01); *A63B 21/4034* (2015.10); *A63B 21/4035* (2015.10); *A63B 21/4043* (2015.10); *A63B 22/02* (2013.01); *A63B 22/0605* (2013.01); *A63B 22/0664* (2013.01); *A63B 22/18* (2013.01); *A63B 22/203* (2013.01); *A63B 23/0211* (2013.01); *A63B 23/03508* (2013.01); *A63B 23/03525* (2013.01); *A63B 23/03541* (2013.01); *A63B 23/047* (2013.01); *A63B 23/1209* (2013.01); *A63B 2022/0094* (2013.01); *A63B 2023/003* (2013.01); *A63B 2023/0411* (2013.01); *A63B 2024/0081* (2013.01); *A63B 2024/0093* (2013.01); *A63B 2208/0204* (2013.01); *A63B 2208/0214* (2013.01); *A63B 2208/0219* (2013.01); *A63B 2208/0242* (2013.01); *A63B 2225/50* (2013.01); *A63B 2225/54* (2013.01); *A63B 2230/60* (2013.01)

(56) References Cited

U.S. PATENT DOCUMENTS

| | | | |
|---|---|---|---|
| 4,240,627 | A | 12/1980 | Brentham |
| 4,759,540 | A | 7/1988 | Yu |
| 4,798,378 | A | 1/1989 | Jones |
| 5,066,005 | A | 11/1991 | Luecke |
| 5,263,913 | A | 11/1993 | Boren |
| 5,460,596 | A | 10/1995 | Brady |
| 5,782,639 | A | 7/1998 | Beal |
| 5,820,478 | A | 10/1998 | Wood |
| 5,885,197 | A | 3/1999 | Barton |
| 5,895,340 | A | 4/1999 | Keller |
| 6,179,753 | B1 | 1/2001 | Barker |
| 6,761,667 | B1 | 7/2004 | Cutler |
| 6,796,927 | B2 | 9/2004 | Toyama |
| 7,163,500 | B2 | 1/2007 | Endelman |
| 7,270,628 | B2 | 9/2007 | Campanaro |
| 7,530,929 | B2 | 5/2009 | Feldman |
| 7,803,095 | B1 | 9/2010 | Lagree |
| 7,935,032 | B1 | 5/2011 | Jackson |
| 7,998,043 | B2 | 8/2011 | Zhou |
| 8,012,073 | B2 | 9/2011 | Barnett |
| 8,192,332 | B2 | 6/2012 | Baker |
| 8,356,996 | B2 | 1/2013 | Mayrhofer |
| 8,641,585 | B2 | 2/2014 | Lagree |
| 8,721,506 | B2 | 5/2014 | Gerschefske |
| 8,734,307 | B2 | 5/2014 | Bathey |
| 8,764,609 | B1 | 7/2014 | Elahmadie |
| 8,858,409 | B2 | 10/2014 | Trees |
| 8,870,726 | B2 | 10/2014 | Watterson |
| 9,022,909 | B2 | 5/2015 | Kermath |
| 9,038,218 | B1 | 5/2015 | Heil |
| 9,050,517 | B2 | 6/2015 | Oliver |
| 9,125,785 | B2 | 9/2015 | Trees |
| 9,132,051 | B2 | 9/2015 | Heil |
| 9,339,712 | B2 | 5/2016 | De Biasi |
| 9,539,462 | B2 | 1/2017 | Carter |
| 2001/0056011 | A1 | 12/2001 | Endelman |
| 2002/0022551 | A1 | 2/2002 | Watterson |
| 2003/0078138 | A1 | 4/2003 | Toyama |
| 2003/0119635 | A1 | 6/2003 | Arbuckle |
| 2004/0077464 | A1 | 4/2004 | Feldman |
| 2004/0142800 | A1 | 7/2004 | Gerschefske |
| 2004/0248710 | A1 | 12/2004 | Rodgers, Jr. |
| 2006/0172862 | A1 | 8/2006 | Badarneh |
| 2006/0199712 | A1 | 9/2006 | Barnard |
| 2006/0211543 | A1 | 9/2006 | Feldman |
| 2006/0293156 | A1 | 12/2006 | Trees |
| 2008/0070765 | A1 | 3/2008 | Brown |
| 2008/0242511 | A1 | 10/2008 | Munoz |
| 2008/0248935 | A1 | 10/2008 | Solow |
| 2009/0023556 | A1 | 1/2009 | Daly |
| 2009/0156372 | A1 | 6/2009 | Solomon |
| 2009/0203505 | A1 | 8/2009 | Kroll |
| 2009/0209393 | A1 | 8/2009 | Crater |
| 2010/0056289 | A1 | 3/2010 | Zhou |
| 2010/0227748 | A1 | 9/2010 | Campanaro |
| 2011/0039669 | A1 | 2/2011 | Stewart |
| 2011/0082016 | A1 | 4/2011 | Kim |
| 2011/0152032 | A1 | 6/2011 | Barnett |
| 2011/0166002 | A1 | 7/2011 | Savsek |
| 2011/0172069 | A1 | 7/2011 | Gerschefske |
| 2012/0071301 | A1 | 3/2012 | Kaylor |
| 2012/0088634 | A1 | 4/2012 | Heidecke |
| 2012/0122637 | A1 | 5/2012 | Bathey |
| 2012/0295771 | A1 | 11/2012 | Lagree |
| 2013/0008452 | A1 | 1/2013 | Evangelos |
| 2013/0150219 | A1 | 6/2013 | Chang |
| 2014/0011645 | A1 | 1/2014 | Johnson |
| 2014/0121076 | A1 | 5/2014 | Lagree |
| 2014/0121078 | A1 | 5/2014 | Lagree |
| 2014/0121079 | A1 | 5/2014 | Lagree |
| 2014/0141948 | A1 | 5/2014 | Aronson |
| 2015/0011362 | A1 | 1/2015 | Oh |
| 2015/0024914 | A1 | 1/2015 | Lagree |
| 2015/0057127 | A1 | 2/2015 | Lagree |
| 2015/0065318 | A1 | 3/2015 | Lagree |

(56) References Cited

U.S. PATENT DOCUMENTS

| | | | |
|---|---|---|---|
| 2015/0072841 | A1 | 3/2015 | Lagree |
| 2015/0141204 | A1 | 5/2015 | Lagree |
| 2015/0217164 | A1 | 8/2015 | Lagree |
| 2015/0220523 | A1 | 8/2015 | Lagree |
| 2015/0246263 | A1 | 9/2015 | Campanaro |
| 2015/0297944 | A1 | 10/2015 | Lagree |
| 2015/0343250 | A1 | 12/2015 | Lagree |
| 2015/0360068 | A1 | 12/2015 | Lagree |
| 2015/0360083 | A1 | 12/2015 | Lagree |
| 2015/0360113 | A1 | 12/2015 | Lagree |
| 2015/0364058 | A1 | 12/2015 | Lagree |
| 2015/0367166 | A1 | 12/2015 | Lagree |
| 2016/0008657 | A1 | 1/2016 | Lagree |
| 2016/0166870 | A1 | 6/2016 | Lagree |

OTHER PUBLICATIONS https://www.youtube.com/watch?v=froSxJ3T6jE; Screenshot at 1:52 of YouTube Video "Megaformer Evolution Promo" published on Sep. 1, 2014.

http://www.walmart.com/ip/total-gym-1400/23816097?adid=15000000000000027727770; Webpage from Walmart.com for the Total Gym 1400; Received and Printed Aug. 25, 2014.

PCT International Search Report and Written Opinion for PCT/US2015/033463; Received and Downloaded dated Sep. 1, 2015.

www.SolidMasters.com Website Page via Archive.org; Jul. 7, 2014.

Picture from www.SolidMasters.com Page via Archive.org; Jul. 7, 2014.

EPO Search Report for application EP12807353.6; dated Feb. 9, 2018.

PCT Preliminary Report on Patentability and Opinion for PCT/U82017/028393; dated Nov. 1, 2018.

| Whole Body Workout | Pitched and/or Rolled Plane | | Traditional Horizontal Plane | |
|---|---|---|---|---|
| Targeted Muscle Groups | # of Exercises | Time / Exercise | # of Exercises | Time / Exercise |
| A) Upper Extremities | 3 | 3 | 5 | 3-4 |
| B) Trunk / Core Muscles | 3 | 3 | 5 | 3-4 |
| C) Lower Extremities | 3 | 3 | 5 | 3-4 |
| Equivalent Workout Intensity | 9 Exercises | Time: 27 mins | 15 Exercises | Time: 45-60 mins |
| Estimated Time Savings | | 18-33 mins | | 0 mins |

FIG. 47

| Test Condition | Pitch | Roll |
|---|---|---|
| (1) | 0° Elevation | 0° |
| (2) | 9° Elevation | 13° |
| | | |
| Test Condition(2): Average of 38% muscle stimulation increase in the 5 muscles targeted by this exercise. | | |
| | | |
| This exercise primarily targets:<br>• External obliques (left)<br>• Erector spinae (right)<br>• Anterior deltoid (left)<br>• Posterior deltoid (right)<br>• Pectoralis major (left) | | |

Bar Definitions

- ■ % EMG increase tilt/roll over horizontal carriage
- □ % EMG increase horizontal over tilt/roll carriage
- ⬚ Inconsistent data among test subjects

| Test Condition | Pitch | Roll |
|---|---|---|
| (1) | 0° Elevation | 0° |
| (2) | 12° Elevation | 13° |
| | | |
| Test Condition(2): Average of 36% muscle stimulation increase in the 3 targeted muscles of this exercise. | | |
| | | |
| This exercise primarily targets:<br>• Gluteus maximus (right)<br>• Hamstrings (right)<br>• Gastrocnemius (right) | | |

Bar Definitions

- ■ % EMG increase tilt/roll over horizontal carriage
- □ % EMG increase horizontal over tilt/roll carriage
- ⬚ Inconsistent data among test subjects

| Test Condition | Pitch | Roll |
|---|---|---|
| (1) | 0° Elevation | 0° |
| (2) | 12° Elevation | 13° |
| | | |
| Test Condition(2): Average of 32.5% muscle stimulation increase across the 4 targeted muscles of this exercise. | | |
| | | |
| This exercise primarily targets:<br>• Quadriceps (right)<br>• Gluteus maximus (right)<br>• Hamstrings (right)<br>• Gastrocnemius (right) | | |

Bar Definitions

- ■ % EMG increase tilt/roll over horizontal carriage
- □ % EMG increase horizontal over tilt/roll carriage
- ⬚ Inconsistent data among test subjects

MULTI-AXIS ADJUSTABLE EXERCISE MACHINE

CROSS REFERENCE TO RELATED APPLICATIONS

The present application is a continuation of U.S. application Ser. No. 15/785,409 filed on Oct. 16, 2017 which issues as U.S. Pat. No. 9,914,014 on Mar. 13, 2018, which is a continuation of U.S. application Ser. No. 15/595,258 filed on May 15, 2017 now issued as U.S. Pat. No. 9,789,354, which is a continuation of U.S. application Ser. No. 15/395,041 filed on Dec. 30, 2016 now issued as U.S. Pat. No. 9,649,526, which is a continuation of U.S. application Ser. No. 15/332,786 filed on Oct. 24, 2016 now issued as U.S. Pat. No. 9,533,184, which is a continuation of U.S. application Ser. No. 15/187,728 filed on Jun. 20, 2016 now issued as U.S. Pat. No. 9,474,926, which is a continuation of U.S. application Ser. No. 14/725,908 filed on May 29, 2015 now issued as U.S. Pat. No. 9,370,679, which is a continuation-in-part of U.S. application Ser. No. 14/468,958 filed on Aug. 26, 2014 now issued as U.S. Pat. No. 9,211,440, which claims priority to U.S. Provisional Application No. 61/869,904 filed Aug. 26, 2013. U.S. application Ser. No. 14/725,908 filed on May 29, 2015 now issued as U.S. Pat. No. 9,370,679 also claims priority to U.S. Provisional Application No. 62/004,936 filed May 30, 2014. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND OF THE INVENTION

Field of the Invention

The present invention relates generally to an adjustable exercise machine and more specifically it relates to a multi-axis adjustable exercise machine which is pivotable about both a pitch axis and a roll axis with respect to a base for allowing an exerciser to perform a wide range of exercises on a pitched and/or rolled exercise machine.

Description of the Related Art

Contemporary exercise machines are well known throughout the fitness industry. Some exercise machines, such as Pilates machines, are generally comprised of a rectangular, horizontal base structure with parallel rails aligned with the major axis of the rectangular structure, and a sliding carriage thereupon that is removably attached to one end of the structure by one or more springs or elastic bands that produce a resistance bias. Sliding the carriage away from the end of the machine to which the spring resistance is attached creates a workload against which exercises can be safely and beneficially performed.

The long-standing method of exercising, known as the "Pilates Method" is performed on a Pilates machine, and teaches practitioners to precisely control muscle movements, and to center their bodies upon the machine while exercising core muscles. The core muscles generally include the abdominal muscles, upper and lower back muscles, gluteus maximus and adductor magnus muscles, and tensor facia lata.

With regular exercise on a Pilates machine, the Pilates machine is well recognized as delivering on its promise of increasing core strength while, at the same time, minimizing injury related to overstressing muscles and connective tissue, or injury related to joint hyperextension.

One major deficiency related to the horizontal support surfaces of traditional exercise machines is that exercisers must exercise for long periods of time in order to achieve significant improvement in cardiovascular efficiency or muscle strength. For instance, many different exercises must be performed during the course of a training class in order to substantially engage all of the major and stabilizing muscles during the workout. Such a workout period requires 45 minutes to one hour to complete. Many exercisers with busy schedules desire shorter workout periods, yet still demand the same fitness improvements obtained during longer workout periods.

Those skilled in the art will immediately appreciate the need for an improved fitness training machine that is capable of delivering more intense workouts that simultaneously engage more muscles, thereby reducing the workout time without otherwise reducing the fitness improvements. An improved fitness machine modifies the exercise environment by rotating an otherwise horizontal exercise surface about one or more axes, purposely upsetting the balance and body centering on the machine, and thereby engaging muscles not otherwise engaged to counter the imbalance during exercise.

It will also be appreciated that a new method of exercising, combined with a novel exercise environment that tilts the traditionally horizontal exercise surfaces of an exercise machine along one or more axes will enhance the exerciser's balance, accelerate muscle strength development, reduce workout time, enhance agility and sharpen coordination skills not otherwise attainable using a traditional exercise machine.

Because of the inherent problems with the related art, there is a need for a new and improved multi-axis adjustable exercise machine which is pivotable about both a pitch axis and a roll axis with respect to a base for allowing an exerciser to perform a wide range of exercises on a pitched or rolled exercise machine.

BRIEF SUMMARY OF THE INVENTION

The present invention is a new method of exercising upon a novel exercise machine that introduces an exercise platform repositionable relative to a horizontal plane about one or more axes.

More specifically, the present invention teaches the pivoting of an exercise machine traditionally operable only in a fixed horizontal plane, and further teaches a new method of exercising on such an improved exercise machine to accelerate fitness conditioning of an exerciser. The improved fitness machine provides for rotating an exercise platform to variable positions about the longitudinal and transverse axes of the machine, thereby inducing variable pitch and roll positioning to an exercise platform that traditionally has been fixed in a horizontal plane.

Proprioception is the body's sensory modality that transmits feedback of relative positioning of different parts of the body to other parts of the body. The brain's interpretation of proprioceptor information allows a person to sense where their body parts are without looking.

Muscle memory is a well-known term used within the fitness industry to describe an exerciser's motor learning that results from repeatedly performing many repetitions of a particular exercise. Muscle memory allows exercisers to ultimately perform the exercise without thinking about each element of the exercise. For instance, riding a bicycle or climbing a flight of stairs do not require the exerciser to be mindful of the engagement of each muscle required to accomplish each and every component of the exercise. In other words, the exerciser does not consciously plan to lift a foot above the next step, move it forward over the step, put it down, then transfer weight to that foot so he can pick up the second foot to repeat the process. The efficiency of the exerciser to consciously engage each muscle or group of muscles diminishes. Muscle memory diminishes the exerciser's sense of proprioception.

Similar to proprioception, kinesthesia is the ability to sense where body parts are during movement. Kinesthesia is important for exercisers who should be aware not only of muscle movement used to overcome a resistive force during exercise, but to also know where their body parts are throughout the exercise.

The body's proprioceptors, along with the vestibular system, help control balance, coordination and agility. When an exerciser performs exercise movements upon a horizontal platform, the use of proprioceptors are minimized, especially in the case described above in which the exerciser has developed muscle memory, and/or is performing many repetitions of a familiar exercise.

In order to break muscle memory, and improve balance, coordination and agility skills, the exerciser must be exposed to new exercise environments. By changing the pitch and/or roll angles of an otherwise substantially horizontal exercise platform, an exerciser will immediately sense an imbalance, and will subconsciously engage various muscles in order to rebalance or remain balanced upon the pitched platform. Exercisers therefore engage muscles not otherwise stimulated when performing the same exercises on a traditional machine with a horizontal platform.

Therefore, an improved method of performing exercises upon the machine platform that is tilted at an acute angle relative to the horizontal plane along one or more axes tends to break muscle memory, stimulate proprioceptors, stimulate primary and stabilizing muscles otherwise not engaged, and increases the level stimulation of already engaged muscles when compared to performing the same exercises on a horizontal exercise platform.

The improved exercise machine and exercise method of the present invention deliver many commercial and exerciser advantages when compared to traditional exercise machines and methods.

For example, by performing Pilates types of exercises upon an exercise plane pitched and rolled at various acute angles relative to the horizontal exercise plane of traditional Pilates machine, and by performing the exercises according to the novel methods taught by the present invention, exercisers realize various immediate benefits including: simultaneous engagement of more muscles during an exercise as compared to performing the same exercise on a horizontal plane, increased energy consumption (typically expressed in calories), increased heart rate that improves cardiovascular efficiency, decrease in workout time and accelerated strength conditioning.

One exemplary embodiment of the present invention is a method of exercising whereby an exerciser applies an exercise force against a spring biased carriage slidable upon at least one rail aligned with the longitudinal axis of an exercise machine, the carriage being variably positioned at an acute angle relative to the horizontal plane along one or more of the roll or pitch axes of the structure.

Another exemplary embodiment of the present invention is an improved exercise machine comprising a substantially rectangular horizontal base structure, a substantially rectangular upper structure that incorporates at least one exercise platform that is movable along one or more rails that are aligned with the longitudinal axis of the machine, and a means to variably pitch the longitudinal axis of the upper structure at acute angles relative to the substantially horizontal base structure.

Another exemplary embodiment of the present invention is an improved exercise machine comprising a substantially rectangular horizontal base structure, a substantially rectangular upper structure that incorporates at least one exercise platform that is movable along one or more rails that are aligned with the longitudinal axis of the machine, and a means to variably roll the longitudinal axis of the upper structure at acute angles relative to the substantially horizontal base structure.

Yet another exemplary embodiment of the present invention is an improved exercise machine comprising a substantially rectangular horizontal base structure, a substantially rectangular upper structure that incorporates at least one exercise platform that is movable along one or more rails that are aligned with the longitudinal axis of the machine, and a means to vary both the pitch and roll of the upper structure at acute angles relative to the substantially horizontal base structure.

Still another exemplary embodiment of the present invention is an improved exercise machine that may be dynamically pitched and rolled during the performance of an exercise.

These and other embodiments will become known to one skilled in the art, especially after understanding the commercial and exerciser advantages of shorter workout periods while exercisers realize increased muscle stimulation, improved coordination development, agility and balance while performing exercises on an exercise platform that can be pitched and rolled in one or more axes at acute angles relative to the traditional horizontal plane. The present invention is not intended to be limited to the disclosed embodiments.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 47 is an exemplary illustration showing a workout planning chart.

DETAILED DESCRIPTION OF THE INVENTION

I. Adjustable Exercise Machine

A. Overview

Figure 1:
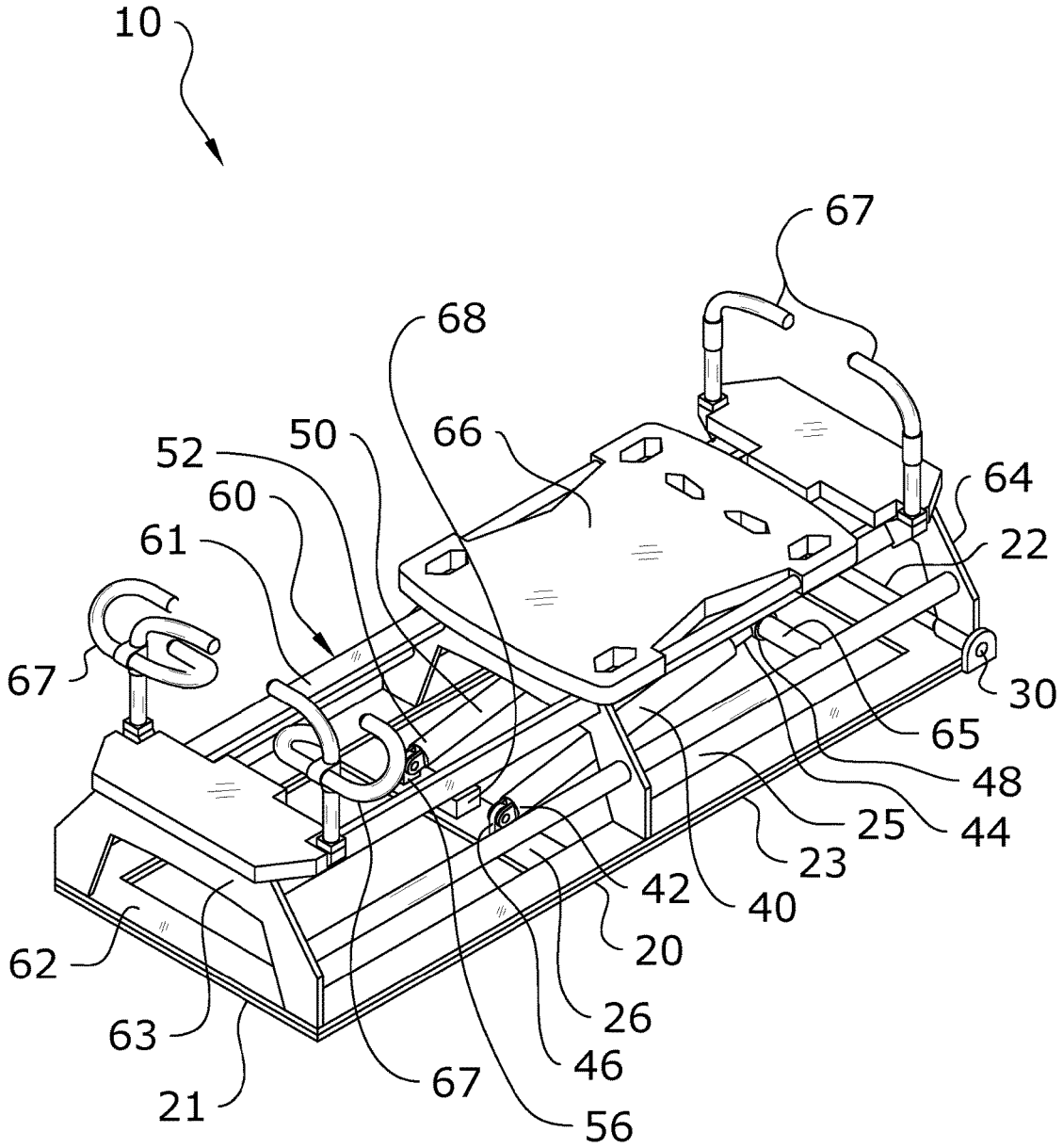
FIG. 1 is an upper perspective view of an adjustable exercise system.

Turning now descriptively to the drawings, in which similar reference characters denote similar elements throughout the several views, FIGS. 1 through 17 illustrate an adjustable exercise system 10, which comprises a base 20, an exercise machine 60 pivotably connected to the base 20, and one or more actuators 40, 50 for lifting or lowering the exercise machine 60 into varying angles of incline with respect to the base 20. The rear end 22 of the base 20 is generally pivotably connected to the rear end 64 of the exercise machine 60 by a hinge or pivot connectors 30, 32. The front end 63 of the exercise machine 60 may be raised or lowered with respect to the front end 21 of the base 20 by the one or more actuators 40, 50 to achieve varying angles of incline. A controller 70 is also provided which communicates via a wired or wireless communications network 12 with one or more of the adjustable exercise systems 10. Using the controller 70, an exercise instructor may adjust the adjustable exercise systems 10 of multiple exercisers with a single command.

B. Base

As shown throughout the figures, the present invention includes a base 20 to which the exercise machine 60 of the present invention is hingedly attached such that a level of inclination of the exercise machine 60 may be adjusted to increase or decrease the intensity of exercises. The shape, structure, and configuration of the base 20 may vary in different embodiments, and thus the scope of the present invention should not be construed as limited by the exemplary configuration shown in the figures.

It should be appreciated that, in some embodiments, the base 20 may be comprised of any structure which interconnects the exercise machine 60 with a surface, such as legs contacting the floor. Thus, in some embodiments, an explicit base 20 may be omitted, with the ground surface being comprised of the base 20 for the exercise machine 60. In such embodiments, the actuators 40, 50 may be connected directly between the ground and the exercise machine 60.

Figure 2:
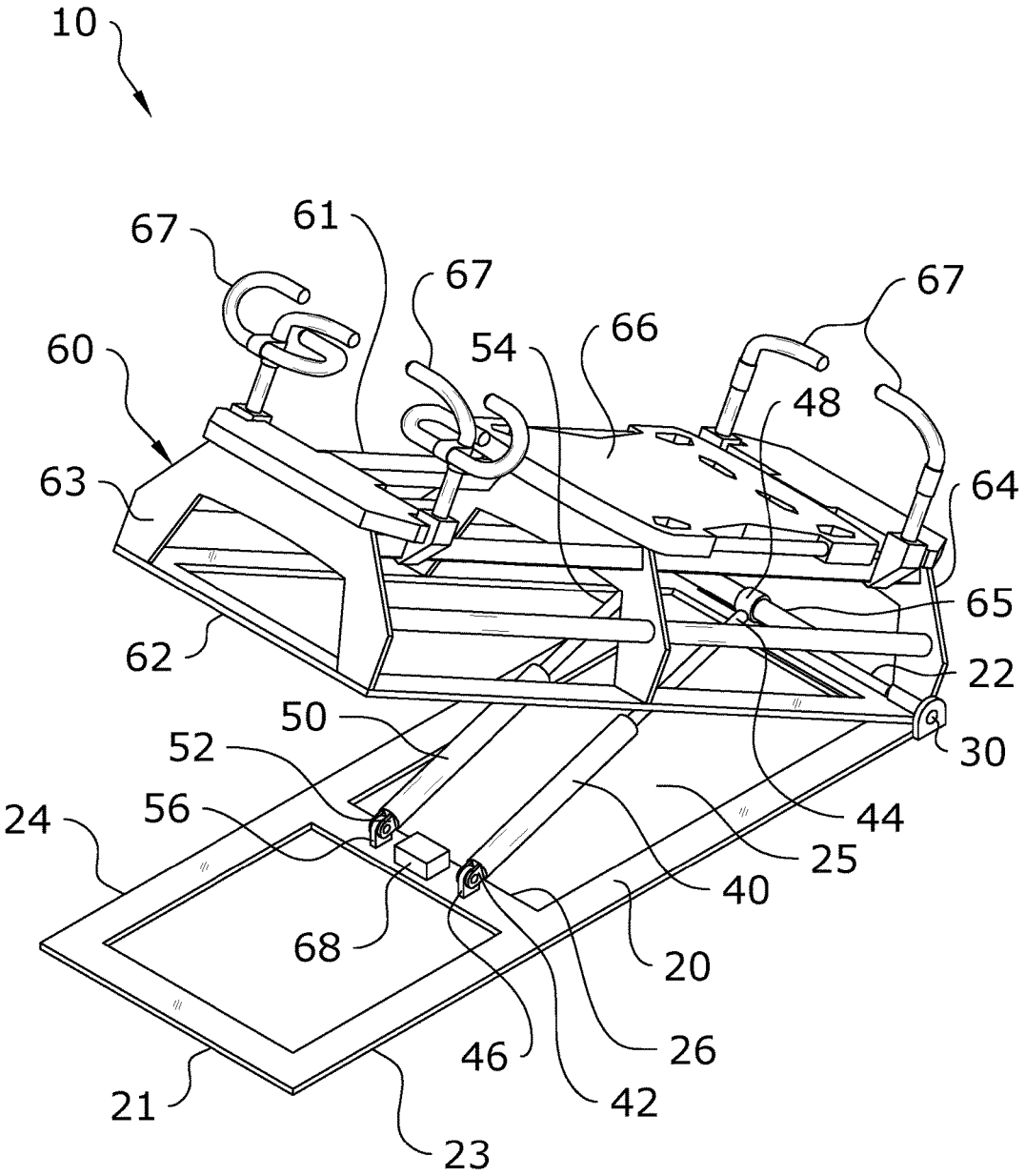
FIG. 2 is an upper perspective view of the adjustable exercise system with the exercise machine in a raised position.
Figure 3:
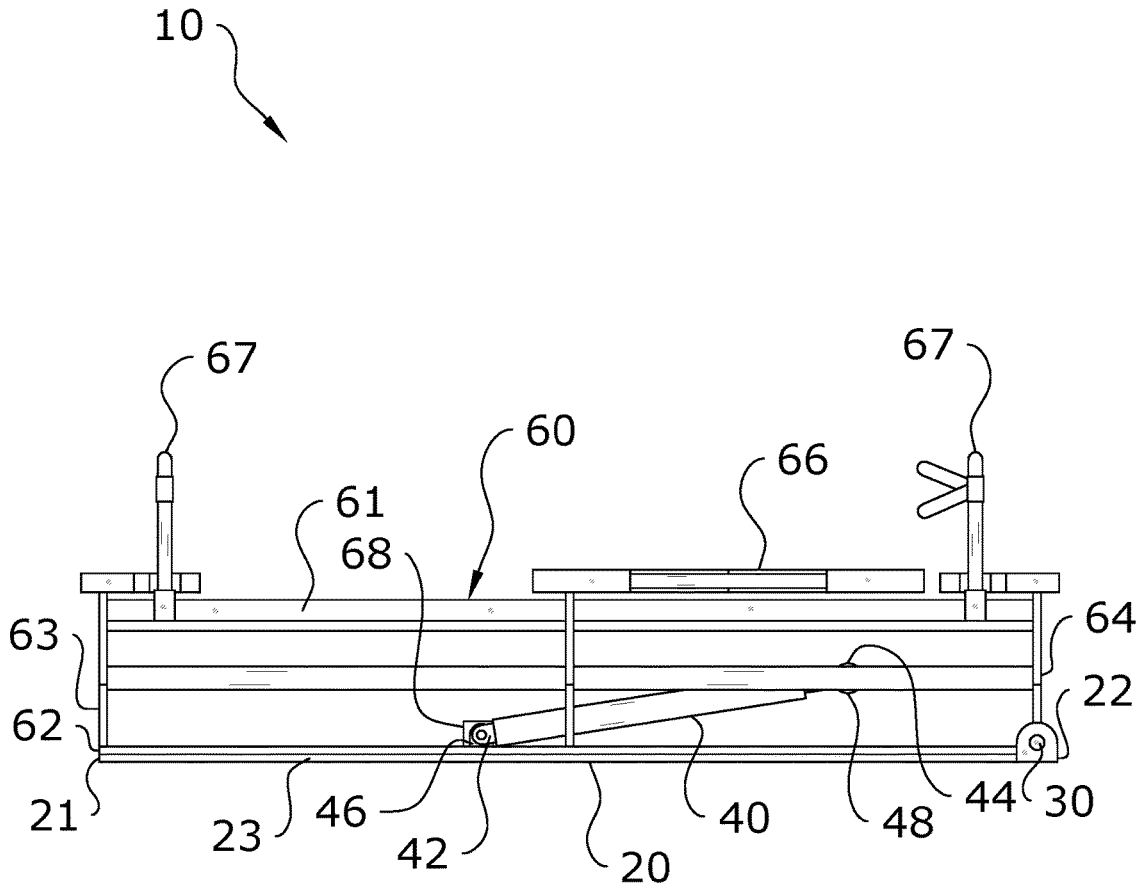
FIG. 3 is a side view of the adjustable exercise system in a lowered position.
Figure 4:
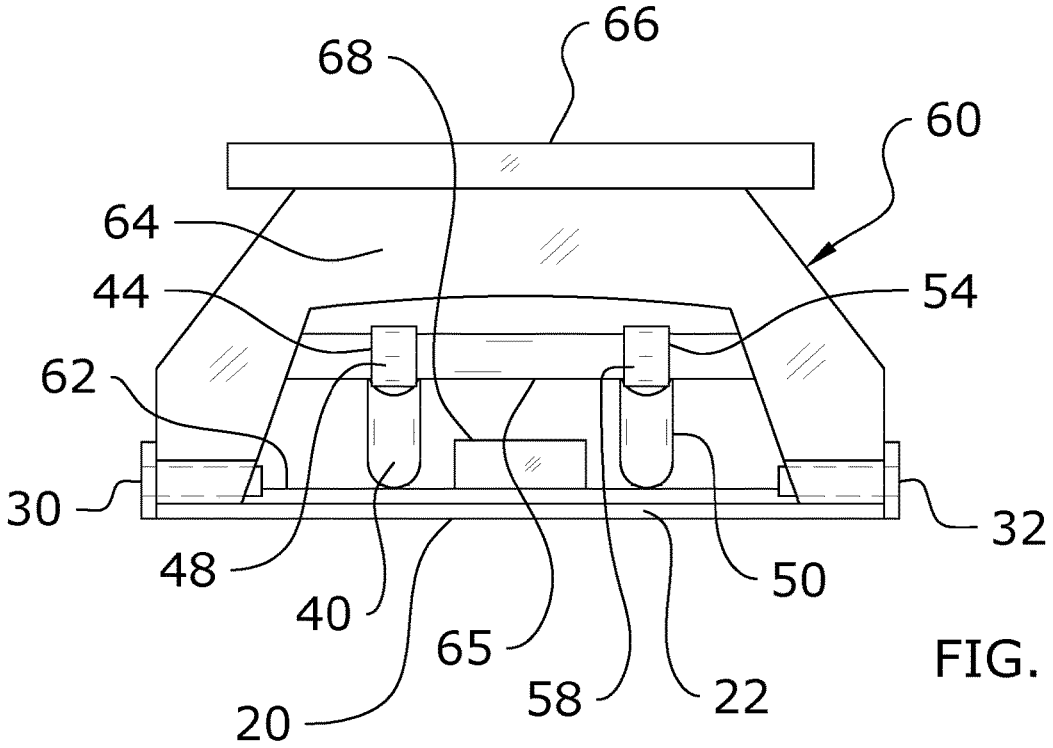
FIG. 4 is a rear view of the adjustable exercise system in a lowered position.
Figure 5:
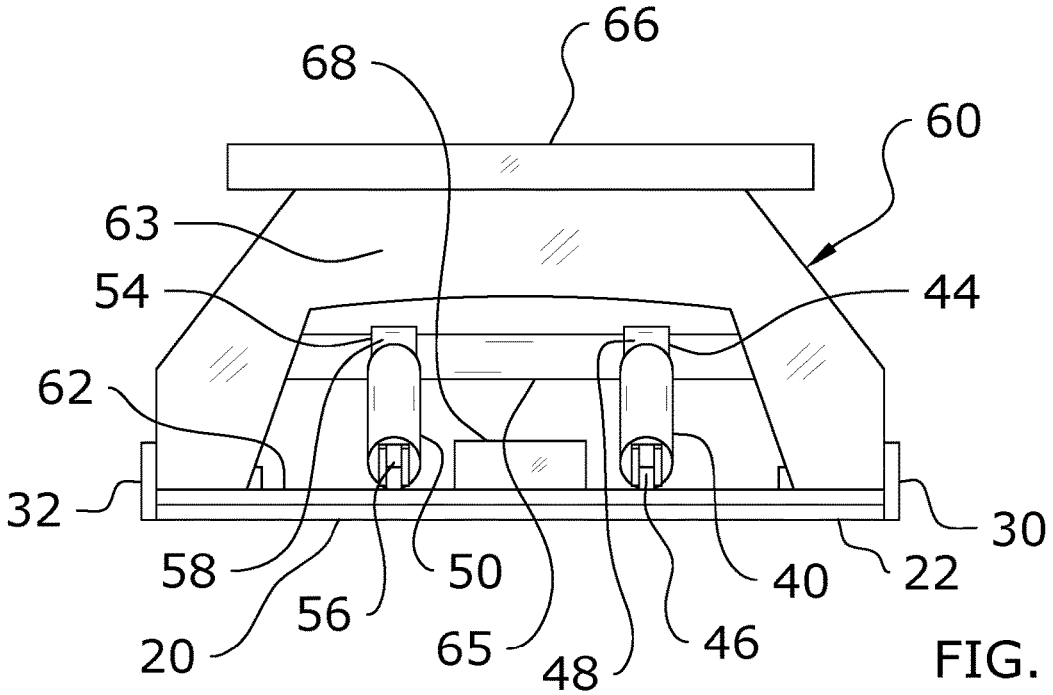
FIG. 5 is a frontal view of the adjustable exercise system in a lowered position.
Figure 6:
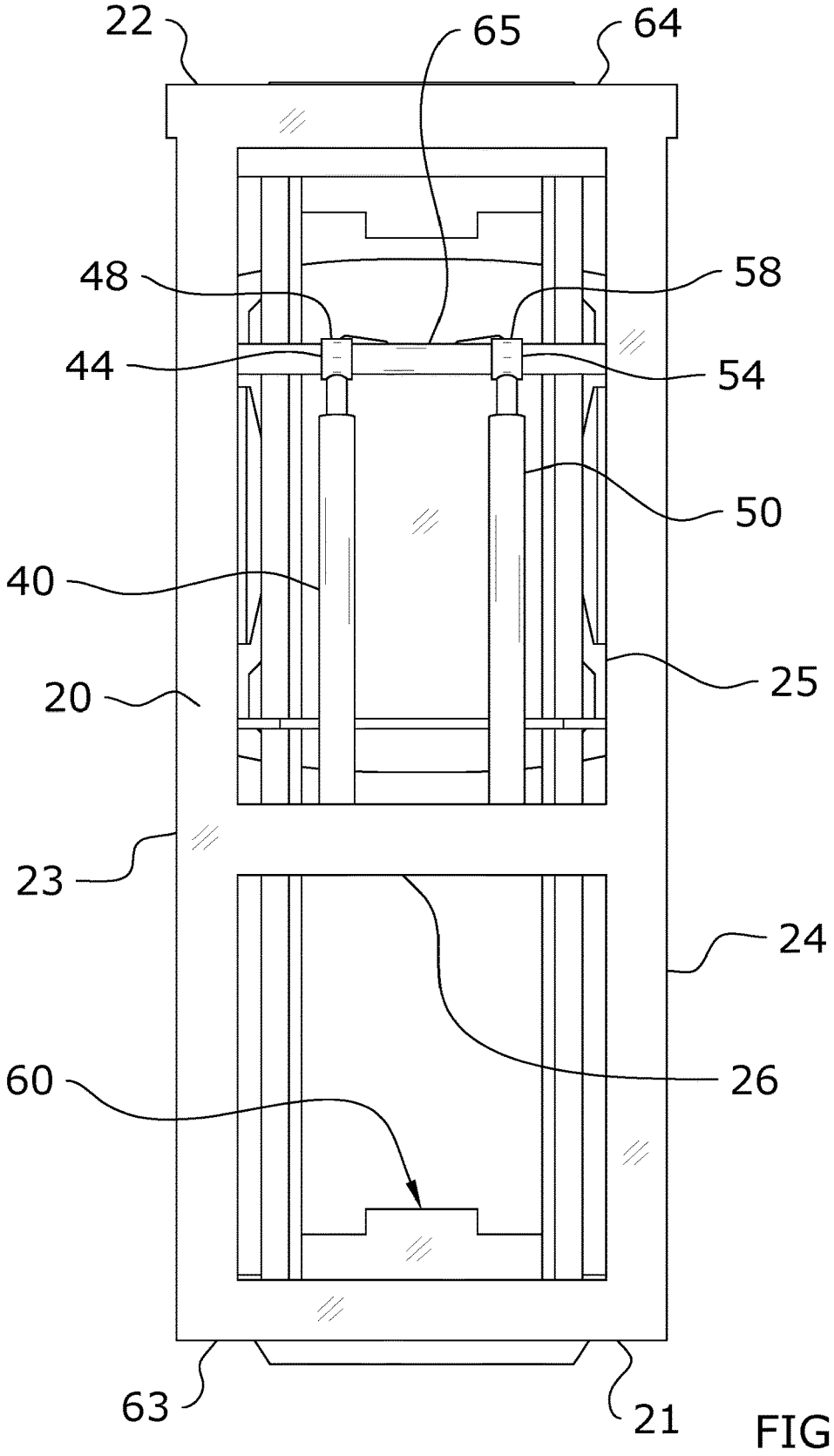
FIG. 6 is a bottom view of the adjustable exercise system.

In the embodiment best shown in FIGS. 1-3, the base 20 generally includes a front end 21, a rear end 22, a first side 23, and a second side 24. The base 20 may be of a solid configuration or may be comprised of an outer frame as shown in the figures. The base 20 will rest upon the ground and remain stable as the exercise machine 60 is lifted or lowered to different levels of incline.

The base 20 may include an opening 25 defined by the first side 23, second side 24, rear end 22, and a cross bar 26 extending between the first and second sides 23, 24. The cross bar 26 may be located at various locations along the length of the base 20 between its front and rear ends 21, 22. In the embodiment shown in the figures, the cross bar 26 is located approximately ⅓ of the distance from the front end 21 to the rear end 22.

As best shown in FIG. 2, the first ends 42, 52 of the first and second actuators 40, 50 are secured to the cross bar 26 by a pair of actuator mounts 46, 56. However, it should be appreciated that the actuators 40, 50 could be located along various locations of the base 20, particularly in embodiments which may include a solid base 20. Thus, the mount location of the actuators 40, 50 on the base 20 may vary and should not be construed as limited by the exemplary figures.

C. Lift Assembly

The present invention utilizes a lift assembly to allow the exercise machine 60 to be adjusted between various angles of incline with respect to the base 20. To effectuate the adjustment of inclination, the exercise machine 60 is hingedly or pivotably connected to the base 20 of the present invention and adjusted through usage of one or more actuators 40, 50, with the first ends 42, 52 of the actuators 40, 50 being secured to the base 20 and the second ends 44, 54 of the actuators 40, 50 being secured to the exercise machine 60.

The exercise machine 60 and base 20 may be pivotably attached in any number of manners. For example, a pivoting pin or rod may be utilized to interconnect the base 20 with the exercise machine 60. In other embodiments, hinges or the like may be utilized. In the embodiment shown in the figures, a first pivot connector 30 pivotably connects the rear end 64 of the exercise machine 60 with the first side 23 of the rear end 22 of the base 20. Similarly, a second pivot connector 32 pivotably connects the rear end 64 of the exercise machine 60 with the second side 24 of the rear end 22 of the base 20.

The structure, configuration, and type of pivot connectors 30, 32 utilized may vary in different embodiments. In the exemplary figures, the pivot connectors 30, 32 comprise a pair of hinge-type configurations which interconnect the base 20 and exercise machine 60 in a pivoting configuration. A first pivot connector 30 pivotably connects the first side 23 of the rear end 22 of the base 20 and a second pivot connector 30 pivotably connects the second side 24 of the rear end 22 of the base 20 with the exercise machine 60.

As shown throughout the figures, at least one actuator 40, 50 is connected between the base 20 and the exercise machine 60 such that the exercise machine 60 may be lifted or lowered into various angles of incline with respect to the base 20. Although the figures illustrate the usage of two actuators 40, 50, it should be appreciated that more or less actuators 40, 50 may be utilized in different embodiments.

The structure, size, and type of actuators 40, 50 used may also vary in different embodiments. The figures illustrate cylinder-type actuators 40, 50. It should be appreciated that other types of actuators 40, 50 known in the art may also be utilized to effectuate the lifting and lowering of the exercise machine 60 with respect to the base 20. It should also be appreciated that the actuators 40, 50 may be pneumatic, hydraulic, electric, or any other variant known in the art.

In the preferred embodiment shown in FIGS. 1, 2, and 4-6, a first actuator 40 extends between a point on the cross bar 26 adjacent to the first side 23 of the base 20 and a point on the actuator bar 65 adjacent to the first side of the exercise machine 60. A second actuator 50 extends between a point on the cross bar 26 adjacent to the second side 24 of the base 20 and a point on the actuator bar 65 adjacent to the second side of the exercise machine 60.

As best shown in FIGS. 2-5, the first end 42 of the first actuator 40 is pivotably connected to a first actuator mount 46 which is secured to the cross bar 26 adjacent to the first side 23 of the base 20. The second end 44 of the first actuator 40 is rotatably secured around the actuator bar 65 on the lower end 62 of the exercise machine 60. In the preferred embodiment shown in the figures, the second end 44 of the first actuator 40 includes a first actuator linkage 48 comprised of a ring-member which either partially or fully surrounds the actuator bar 65 so as to freely rotates therearound and forces the exercise machine 60 up or down into various levels of incline with respect to the base 20.

As best shown in FIGS. 2-5, the first end 52 of the second actuator 50 is pivotably connected to a second actuator mount 56 which is secured to the cross bar 26 adjacent to the second side 24 of the base 20. The second end 54 of the second actuator 50 is rotatably secured around the actuator bar 65 on the lower end 62 of the exercise machine 60 in spaced-apart relationship with the first actuator 40. In the preferred embodiment shown in the figures, the second end 54 of the second actuator 50 includes a second actuator linkage 58 comprised of a ring-member which either partially or fully surrounds the actuator bar 65 so as to freely rotates therearound and aids in forcing the exercise machine 60 up or down into various levels of incline with respect to the base 20.

It should be appreciated that the foregoing is merely an exemplary description of one embodiment of the lift assembly, and that variations of the components thereof may vary in different embodiments. The type of connection between the exercise machine 60 and base 20 may vary, as well as the available angles of incline from use of the lift assembly. The placement, numbering, type, and size of actuators 40, 50 may vary. The connection points of the actuators 40, 50 may also vary so long as the exercise machine 60 may be lifted and lowered with respect to the base 20 as shown in the figures and described herein.

D. Exercise Machine

The present invention is generally used in combination with an exercise machine 60. Various types of exercise machines 60 may be utilized. Although the figures illustrate a Pilates machine 60, it should be appreciated that other exercise machines 60 such as treadmills, ellipticals, edge machines, exercise bikes, and the like could also be utilized in combination with the base 20 and lift assembly of the present invention. In a preferred embodiment, the exercise machine 60 may be comprised of the "Exercise Machine" described and shown in U.S. Pat. No. 8,641,585, issued on Feb. 4, 2014, which is hereby fully incorporated by reference.

As shown throughout the figures, the exercise machine 60 may include an upper end 61, a lower end 62, a front end 63, and a rear end 64. The front end 63 will generally be raised and lowered while the rear end 64 remains pivotably secured to the base 20 when the present invention is being raised or lowered. This will allow adjustment of the levels of incline of the exercise machine 60 with respect to the base 20. Thus, the rear end 64 of the exercise machine 60 is generally pivotably connected to the rear end 22 of the base 20, such as by the pivot connectors 30, 32 shown in the figures.

In some embodiments utilizing, the upper end 61 of the exercise machine 60 may include a platform 66 which is slidably secured along tracks on the upper end 61 of the exercise machine 60. One or more handlebars 67 may also be included at the front end 63 and/or rear end 64 of the exercise machine 60. By utilizing the present invention, a wide range of exercises may be performed such as those shown in FIGS. 7-11.

In a preferred embodiment, the platform 66 is slidably upon the exercise machine 60 without the use of compression springs, bias members, cords, actuators, or the like. In such an embodiment, the platform 66 rolls freely along the upper end 61 of the exercise machine 60, with only the body weight of the exerciser providing resistance during exercises. Using this type of embodiment of the exercise machine 60, reliance will be placed on the angle of incline to determine the proper level of resistance for a higher or lower intensity workout.

The lower end 62 of the exercise machine 60 will generally include an actuator bar 65 around which the second ends 44, 54 of the respective actuators 40, 50 will be rotatably secured. The shape, size, length, and cross-section of the actuator bar 65 may vary in different embodiments. The actuator bar 65 will generally extend between the sides of the lower end 62 of the exercise machine 60 adjacent to its rear end 64 as shown throughout the figures.

In some embodiments of the present invention, linear actuators 130, 146, 162, 166 may be omitted entirely or not directly connected to the exercise machine 100, with gearing being used to manipulate the position of the exercise machine 100 with respect to the base 90 instead. In such an embodiment, actuation may be provided by a rotating electric motor or extending/retracting an actuator which could be connected between the base 90 and the exercise machine 100 by gearing.

E. Controller

Figure 13:
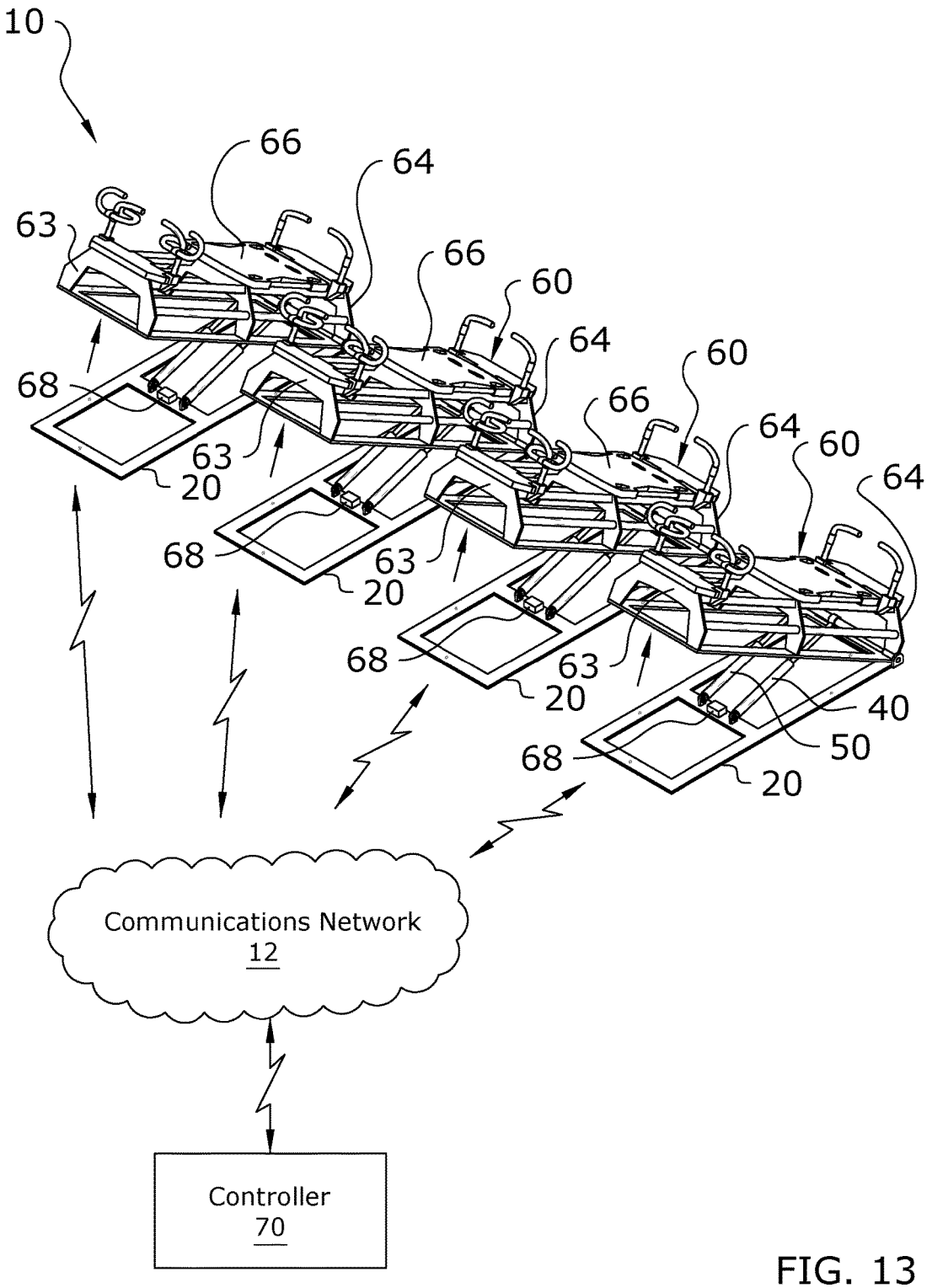
FIG. 13 is an upper perspective view illustrating adjustment of multiple adjustable exercise systems being controlled by a single controller through a communications network.
Figure 14:
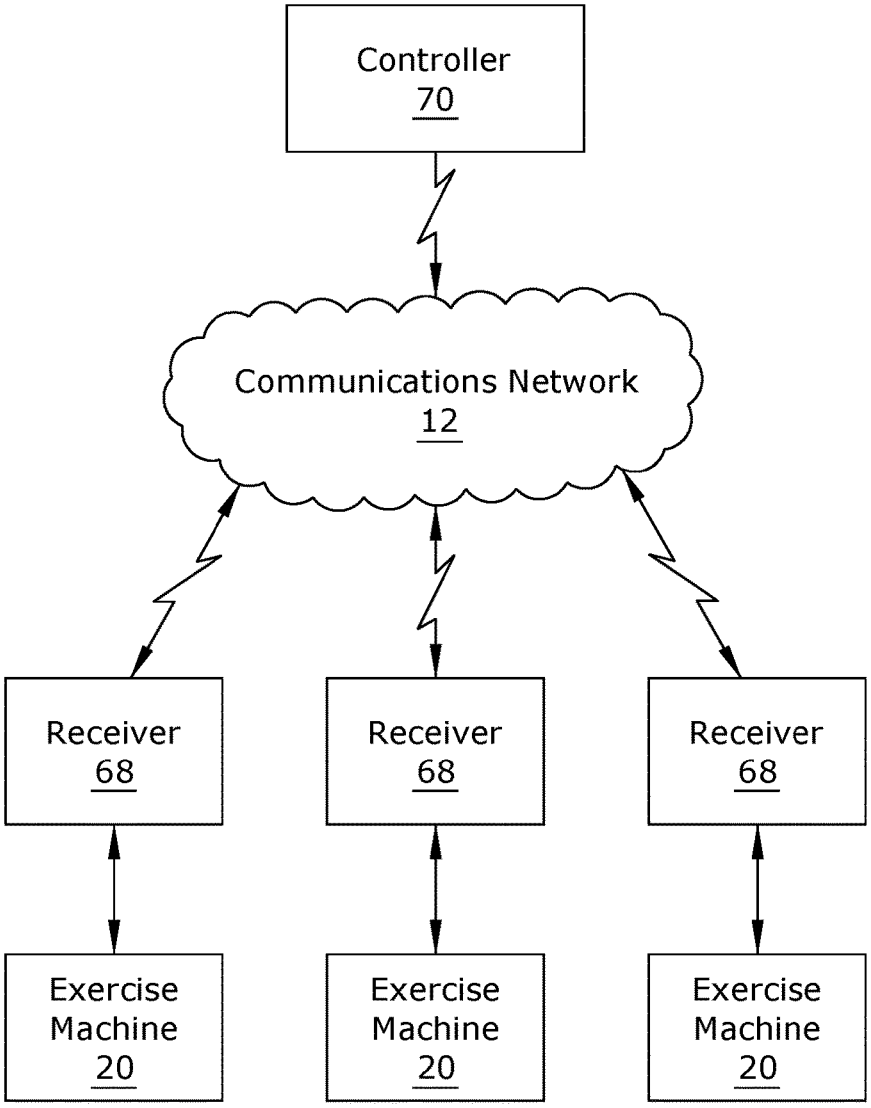
FIG. 14 is a block diagram illustrating interconnection of multiple adjustable exercise systems with a single controller through a communications network.
Figure 15:
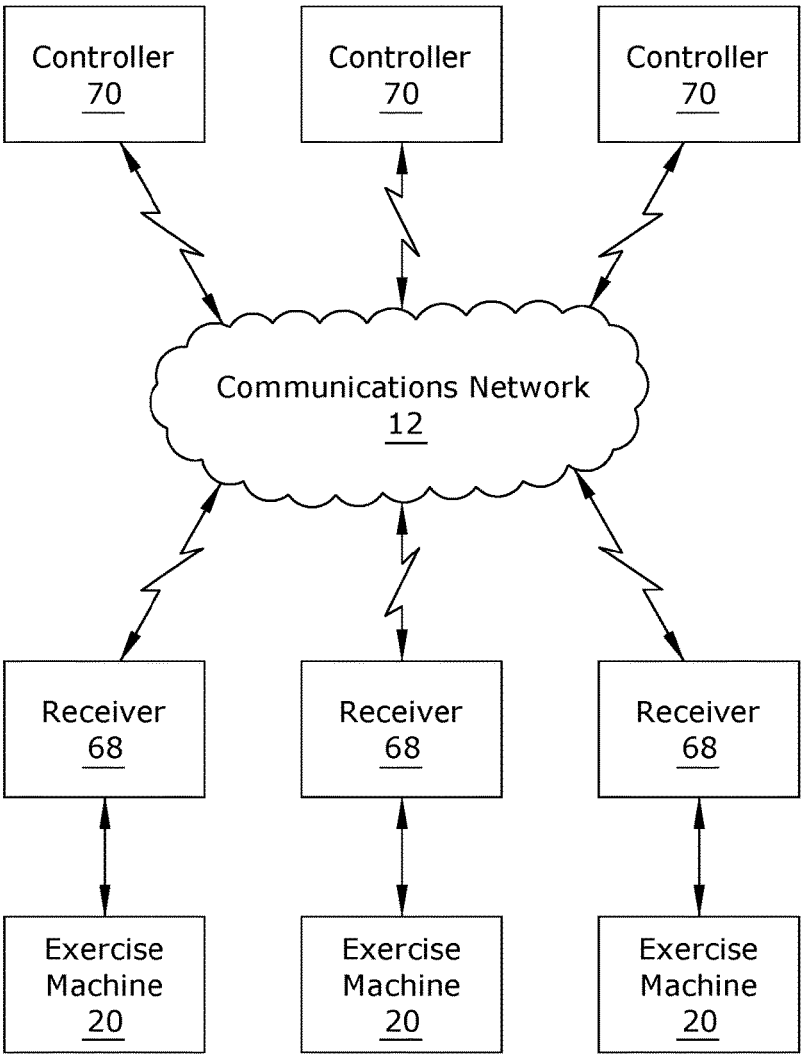
FIG. 15 is a block diagram illustrating interconnection of multiple adjustable exercise systems with multiple controllers through a communications network.

As shown in FIGS. 13-15, the present invention may include a controller 70 for controlling the angle of incline of the exercise machine 60 with respect to the base 20. In some embodiments, each of the adjustable exercise systems 10 includes its own controller 70, with each individual exerciser having control of his/her own system 10.

Figure 12:
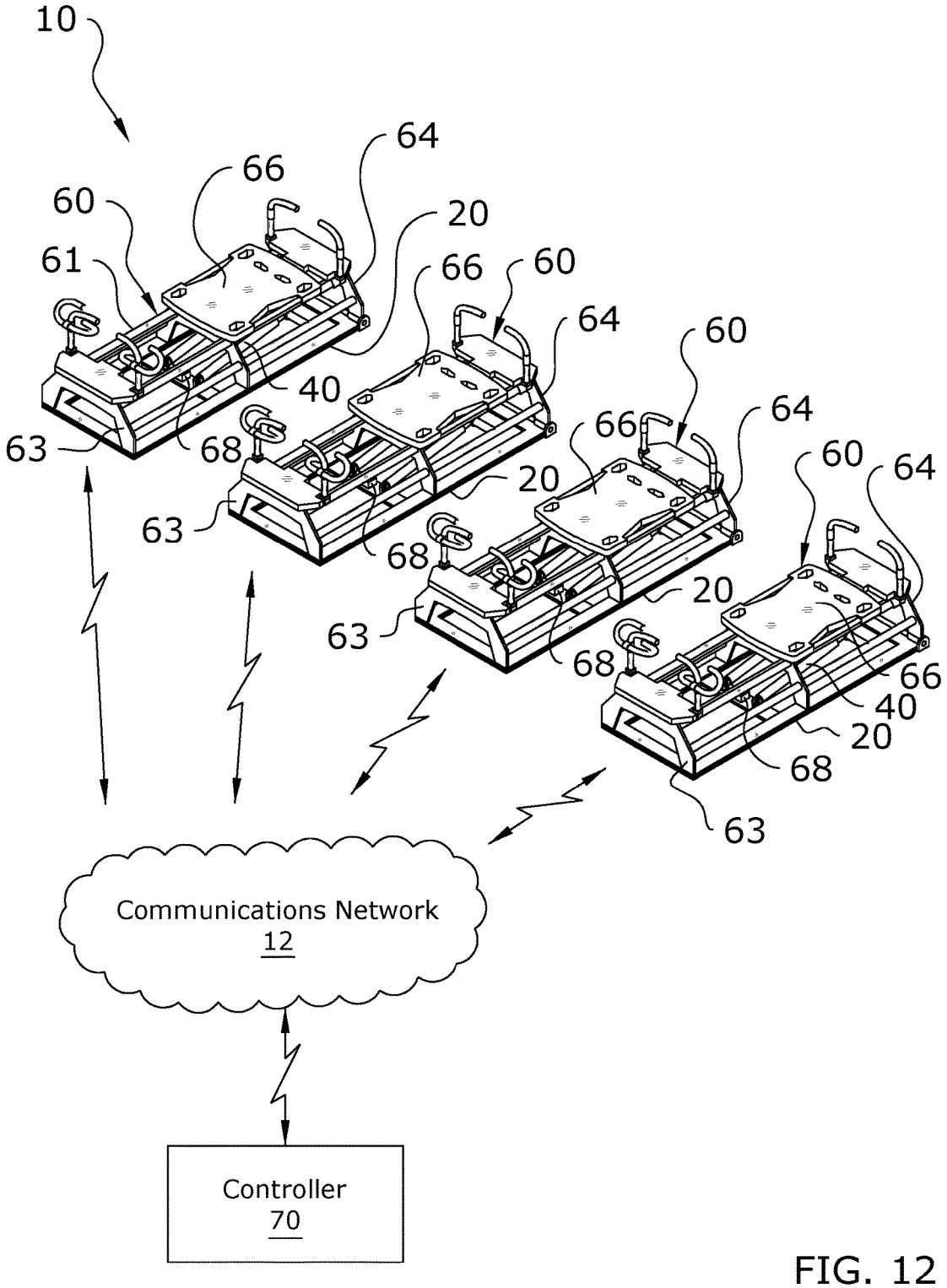
FIG. 12 is an upper perspective view illustrating multiple adjustable exercise systems being controlled by a single controller through a communications network.

In other embodiments, it may be desirable for an exercise instructor to control multiple adjustable exercise systems 10 for a plurality of exercisers, such as in the context of a workout class. In such embodiments, the instructor will have a single controller 70 which is adapted to control the incline of a plurality of adjustable exercise systems 10. Such an embodiment is best shown in FIGS. 12-14. By entering an incline level into the controller 70, the adjustable exercise systems 10 of a plurality of exercisers may be simultaneously adjusted by the instructor.

A wide range of controllers 70 may be used with the present invention. Preferably, the controller 70 will be a hand-held device adapted to control the present invention. The controller 70 may be a computer, smart phone, tablet or the like running a specialized software program for controlling the adjustable exercise systems 10. Alternatively, the controller 70 may be a device specifically configured for the sole purpose of controlling the adjustable exercise systems 10.

The controller 70 will communicate via a communications network 12 with one or more corresponding receivers 68 on the adjustable exercise systems 10. It should be appreciated that the receivers 68 may be located along various locations on the present invention, and should not be construed as being limited to a location between the actuators 40, 50 as shown in the figures.

The type of communications network 12 may vary in different embodiments, including, for example, WI-FI, Bluetooth, RFID, wired signals sent through conduits, and the like. It should be appreciated that any communications network 12 known in the art for transmitting signals to a receiver 68 either through wires or wirelessly may be utilized with the present invention.

F. Operation of Preferred Embodiment

FIGS. 7-11 provide illustrations of some exemplary uses of the present invention. In use, the base 20 is positioned on the ground with the exercise machine 60 in its lowered position. In such a lowered position as shown in FIG. 2, the user of the present invention may perform a wide range of exercises at a first level of intensity defined by the zero-degree angle of incline between the base 20 and the exercise machine 60.

When desired, the exercise machine 60 may be lifted to various angles of incline with respect to the base 20 so as to increase the intensity of the workout when compared with the lowered position shown in FIG. 2. To lift the exercise machine 60 with respect to the base 20, the actuators 40, 50 may be activated to extend outwardly as discussed below. As the actuators 40, 50 are extended, force is applied to the actuator bar 65 of the exercise machine 60.

Because the actuator linkages 48, 58 of the actuators 40, 50 are rotatably secured around the actuator bar 65, which is fixed to the exercise machine 60, the extension of the actuators 40, 50 will cause front end 63 of the exercise machine 60 to rise while the rear end 64 of the exercise machine 60 remains anchored to the rear end 22 of the base 20 by the pivot connectors 30, 32. Thus, the angle of incline between the base 20 and exercise machine 60 may be increased by extending the actuators 40, 50.

Figure 7:
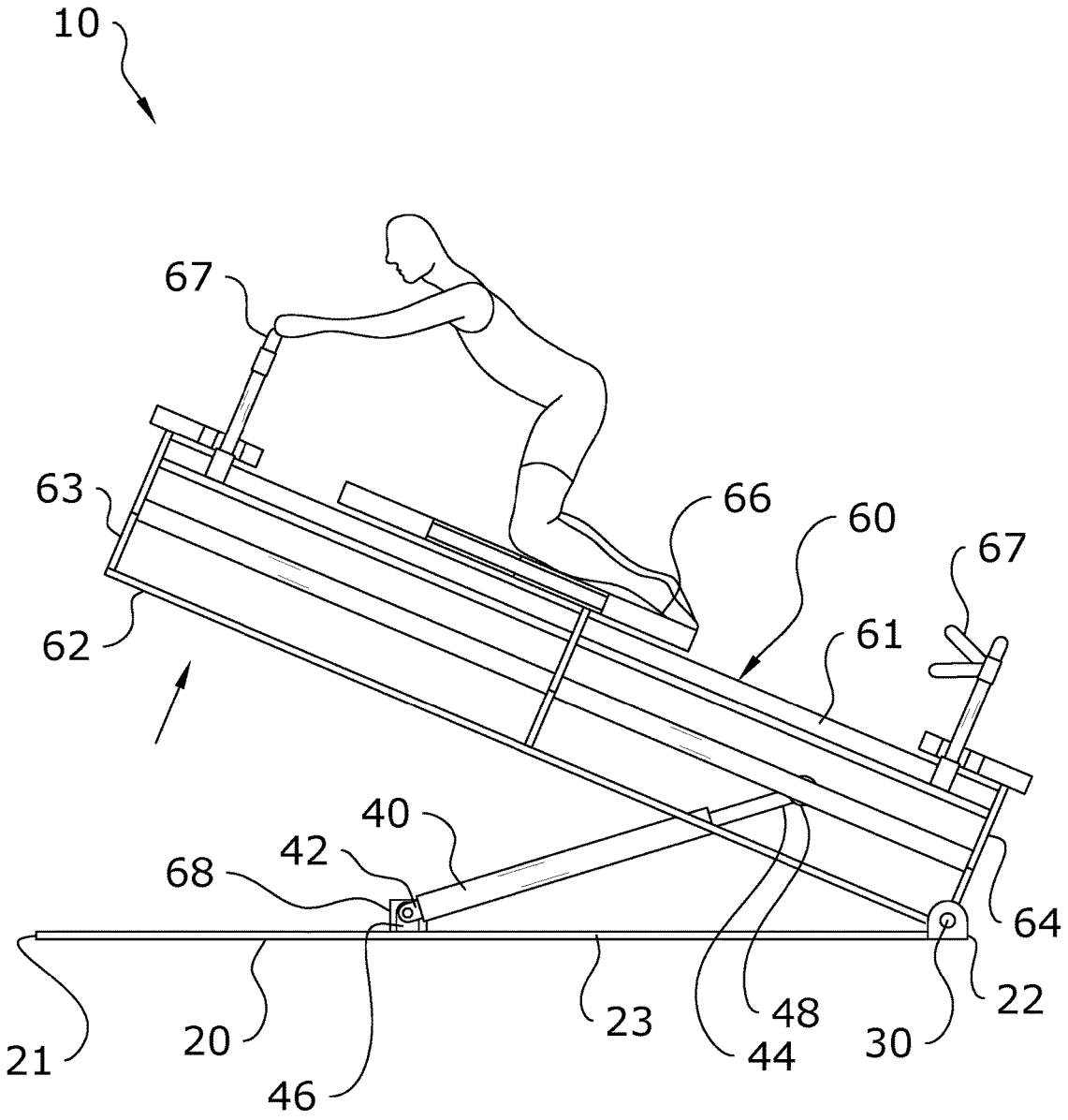
FIG. 7 is a side view of the adjustable exercise system illustrating an exercise being performed at a first angle of incline.
Figure 8:
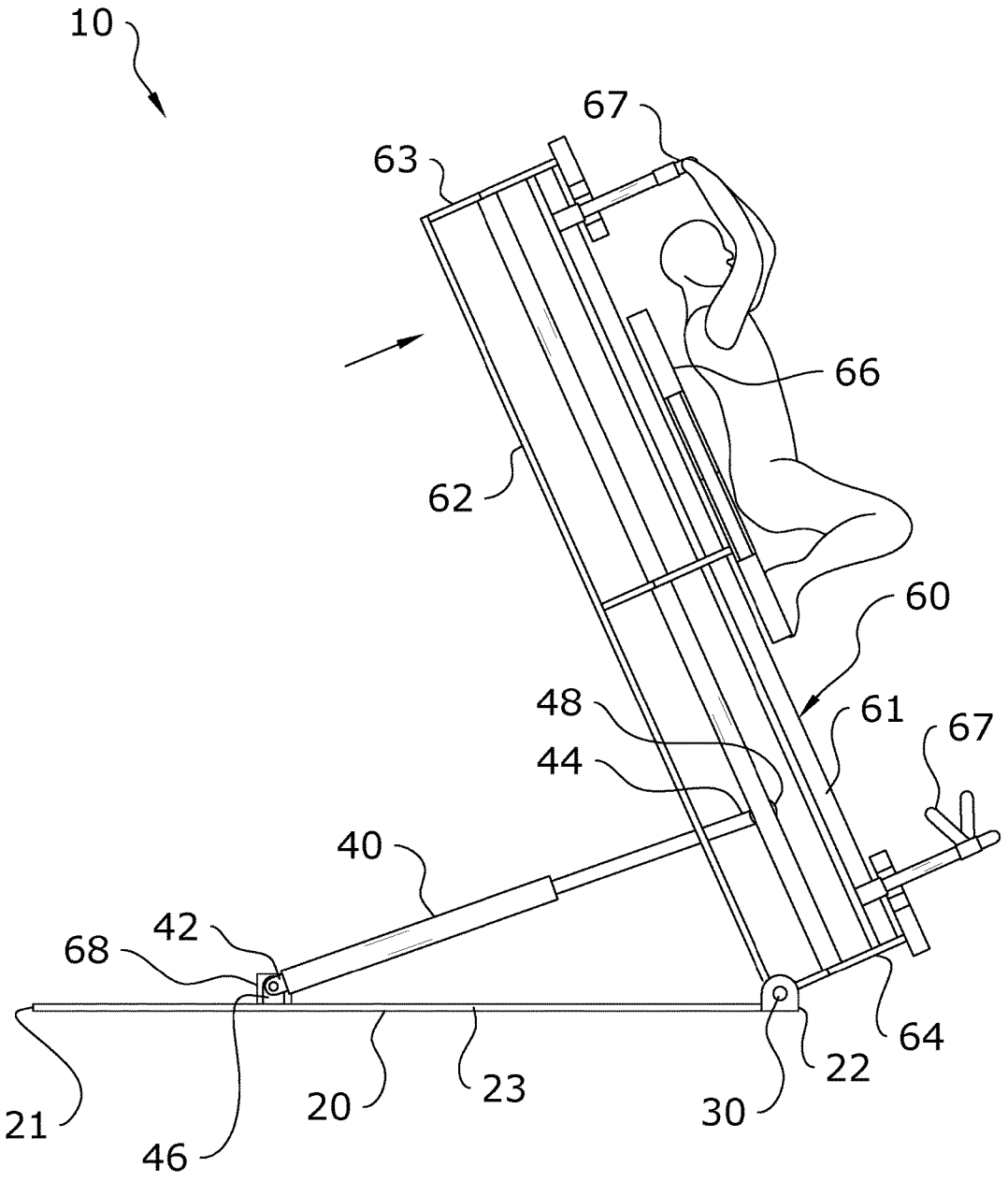
FIG. 8 is a side view of the adjustable exercise system illustrating an exercise being performed at a second angle of incline.
Figure 9:
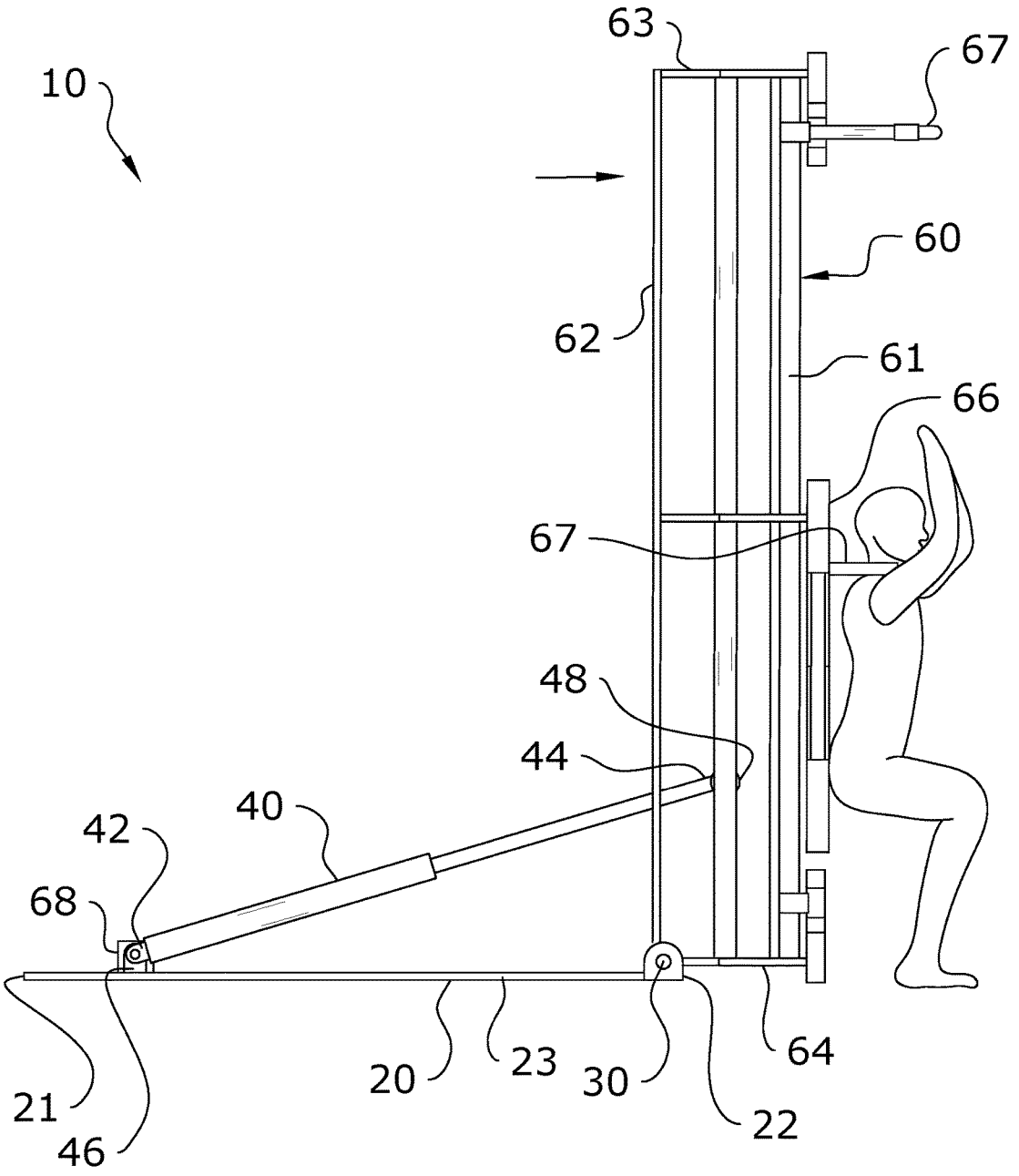
FIG. 9 is a side view of the adjustable exercise system illustrating an exercise being performed at a third angle of incline.

During exercise, the angle of incline between the base 20 and exercise machine 60 may be freely adjusted up or down to accommodate different levels of intensity. Preferably, the present invention will be adapted to adjust between a 0 degree angle of incline as shown in FIG. 2 and 90 degree angle of incline as shown in FIG. 9. FIGS. 7-9 illustrate various levels of incline for use with the present invention; each representing a different level of intensity and showing alternate exercises capable of being performed with the present invention.

Figure 10:
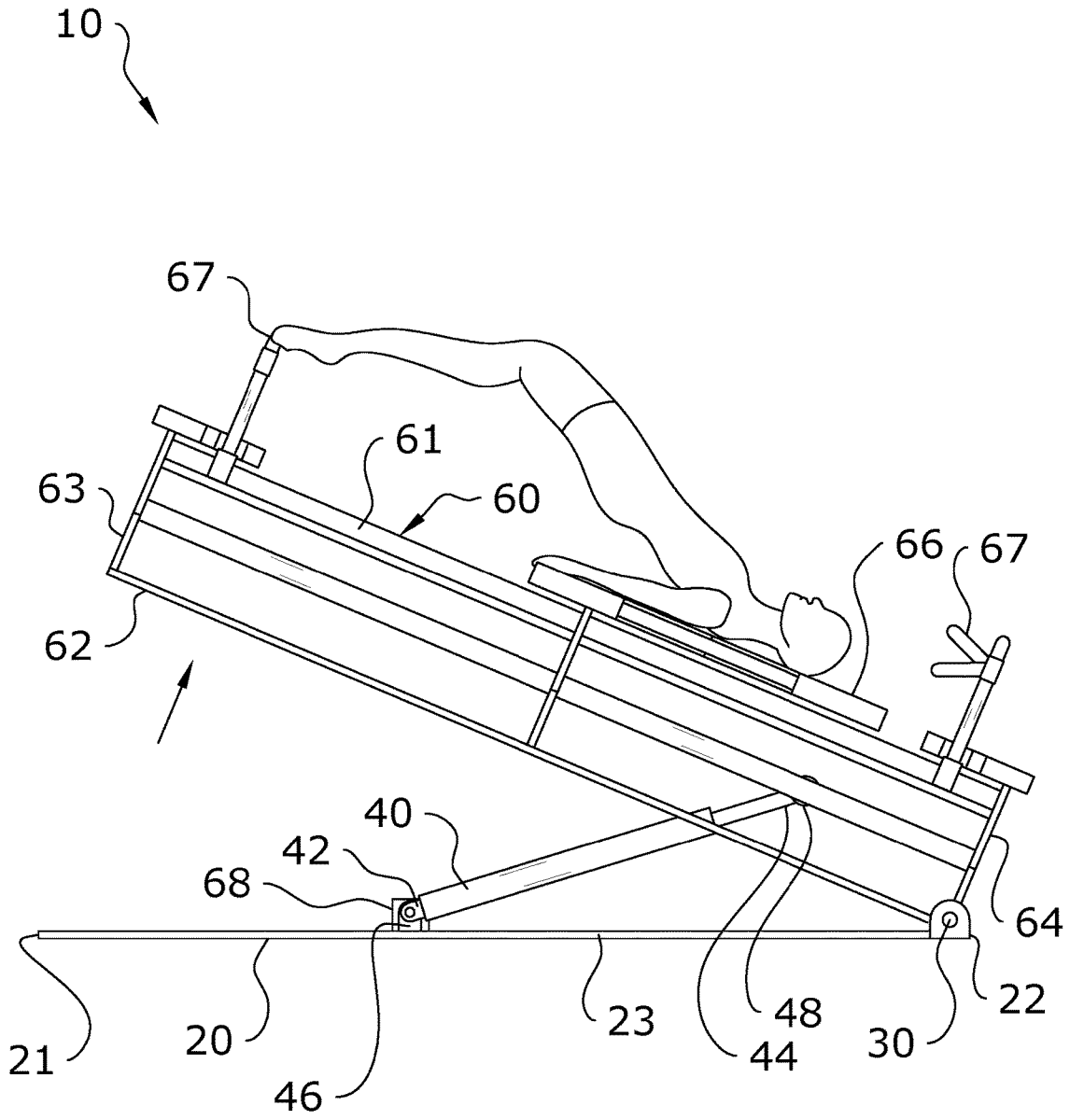
FIG. 10 is a side view of the adjustable exercise system illustrating the first position of an exercise at an angle of incline.
Figure 11:
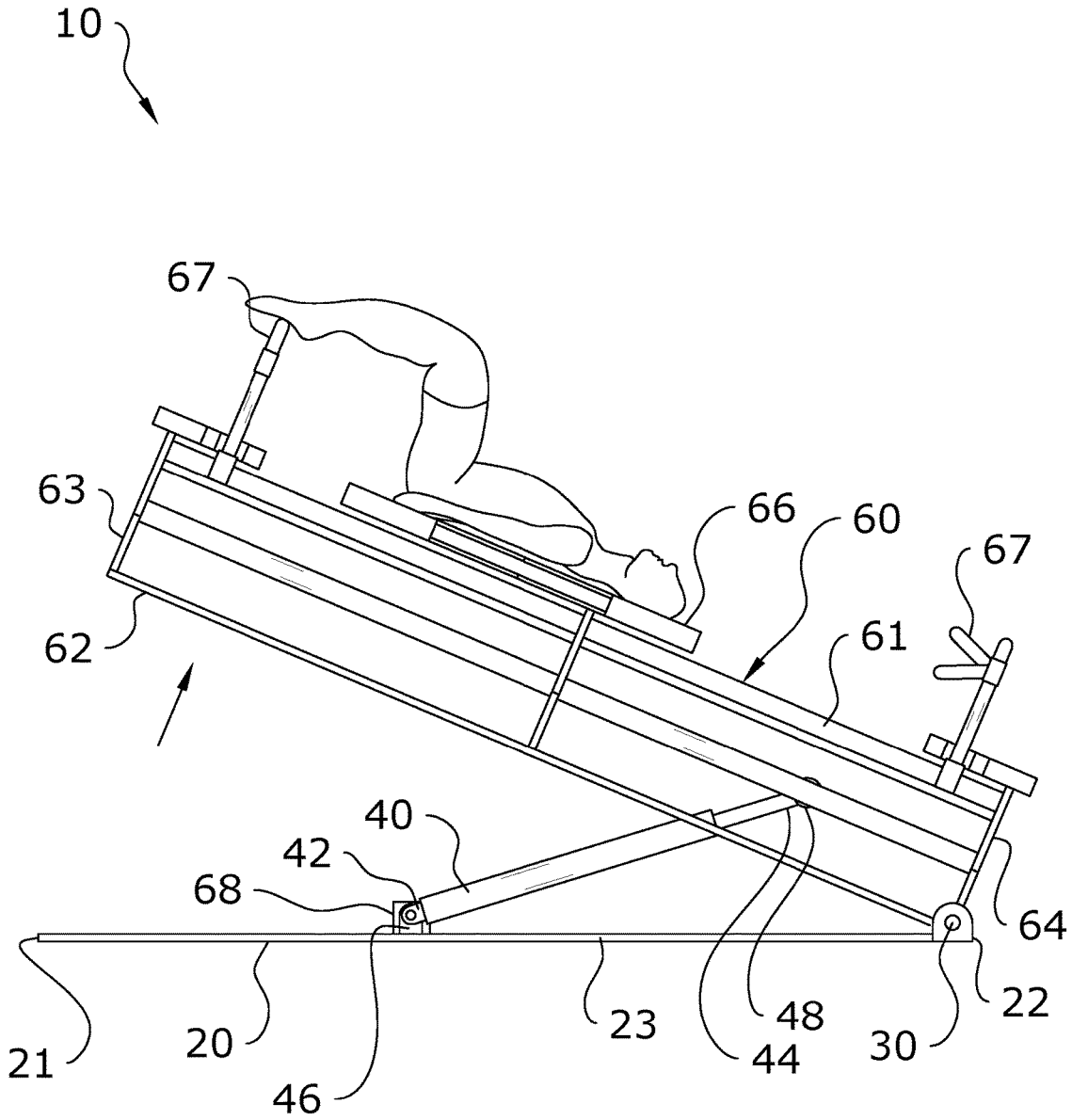
FIG. 11 is a side view of the adjustable exercise system illustrating the second position of an exercise at an angle of incline.

FIGS. 10 and 11 illustrate exercises suitable for use with an exercise machine 60 comprised of a Pilates machine. With an angle of incline set, the user of the present invention will rest upon the platform 66 of the exercise machine 60 with his/her feet positioned on the handlebars 67. As shown in FIG. 11, the user may slide the platform 66 along the exercise machine 60 to perform Pilates exercises. These exercises are more intensive and efficient than maneuvers on prior art systems due to the additional resistance added by the angle of incline between the base 20 and the exercise machine 60.

It should be appreciated that the present invention may be adapted for use in individual workouts or as part of a group of adjustable exercise systems 10 each performing exercises together in response to instructions from an exercise instructor. As previously described, it is therapeutically and commercially beneficial for a rehabilitation therapist or fitness instructor to vary the incline angle of the present invention before, during, and/or after an exercise session.

For instance, as a safety measure, an exercise instructor may prefer to have one or more exercisers mount one or more of the present invention while the exercise machine 20 is substantially horizontal. Once the instructor starts the class session and the exercisers begin exercising, the instructor may change the incline angles, and therefore the intensity of the exercise for one or more exercisers in a class.

Using a controller 70 located remotely from the machines, the instructor may select either a preprogrammed sequence, or manually set the desired incline angle of the machines at any time during the exercise session. The controller 70 output function is a signal that is communicated via a communications network 12 to a corresponding receiver 68 on each of the exercise machines 60 adapted to receive such signals.

Via the communications network 12, the controller 70 communicates with one or more of the adjustable exercise systems 10, each of which is also connected wirelessly to, and addressable through the network 12. The signals are sent from the controller 70 to the adjustable exercise systems 10 to actuate the actuators 40, 50, either to increase or decrease the angle of incline, thereby increasing or decreasing the exercise intensity in real time.

As shown in FIGS. 12-14, an incline angle controller 70 is wirelessly connected to one or more incline-variable adjustable exercise systems 10 via a communications network 12. As a person (exerciser or instructor) uses the controller 70 to change the incline angle of the exercise machine 60, the controller 70 sends a signal via the communications network 12 to the receiver(s) 68 of one or more adjustable exercise systems 10. In embodiments in which the communications network 12 comprises Bluetooth, a Bluetooth signal receiver 68 will have been previously installed on the adjustable exercise systems 10 to receive and decodes the signal from a Bluetooth controller 70 and direct the actuators 40, 50 to increase or decrease the incline angle.

In the foregoing, it should be noted that the controller 70 may incorporate preprogrammed sequences to allow for an instructor to create, store and execute an exercise sequence, or for the controller 70 to simultaneously control all adjustable exercise systems 10, or separately control individual adjustable exercise systems 10 or groups of adjustable exercise systems 10 comprised of fewer than all adjustable exercise systems 10 within an exercise space.

Figure 16:
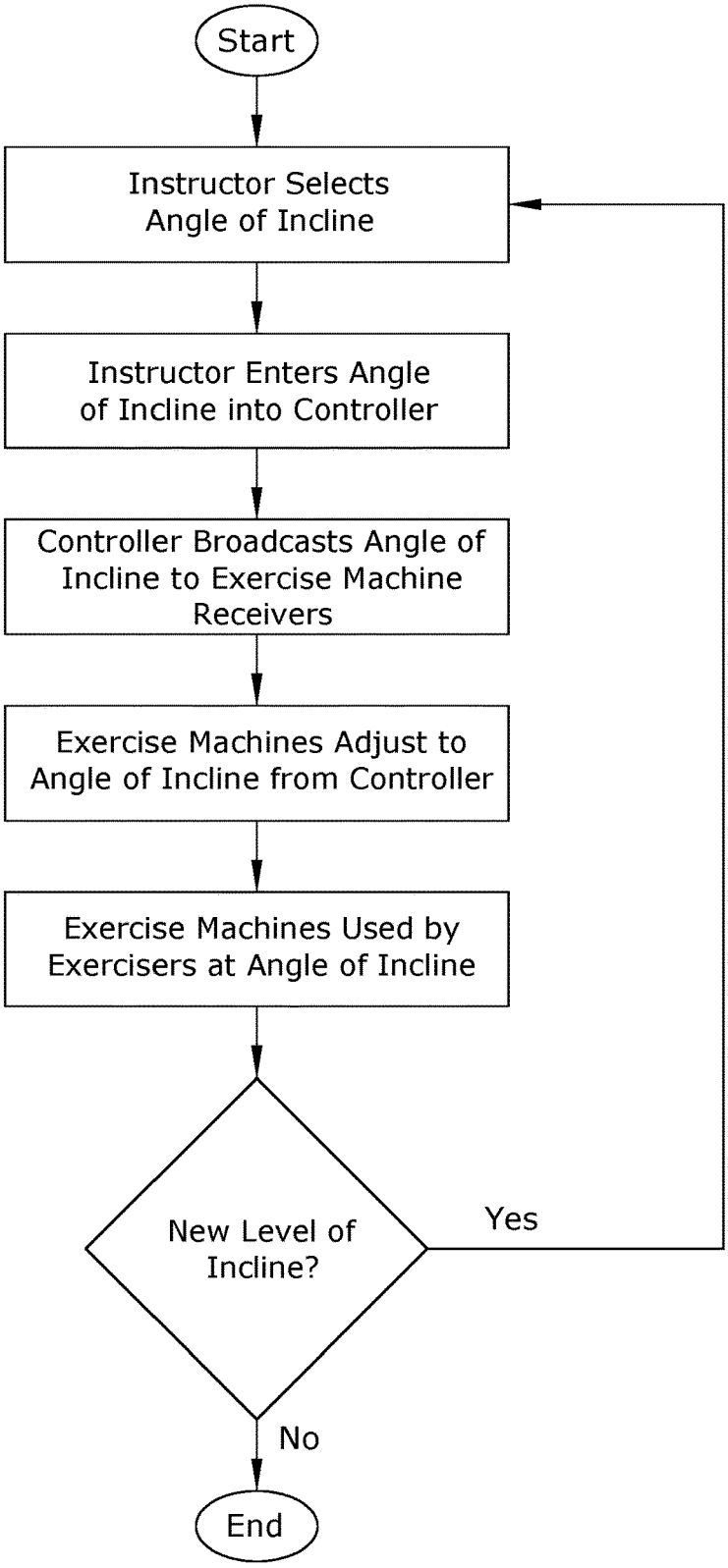
FIG. 16 is a flowchart illustrating instructor-led adjustment of angles of incline for multiple adjustable exercise systems.
Figure 17:
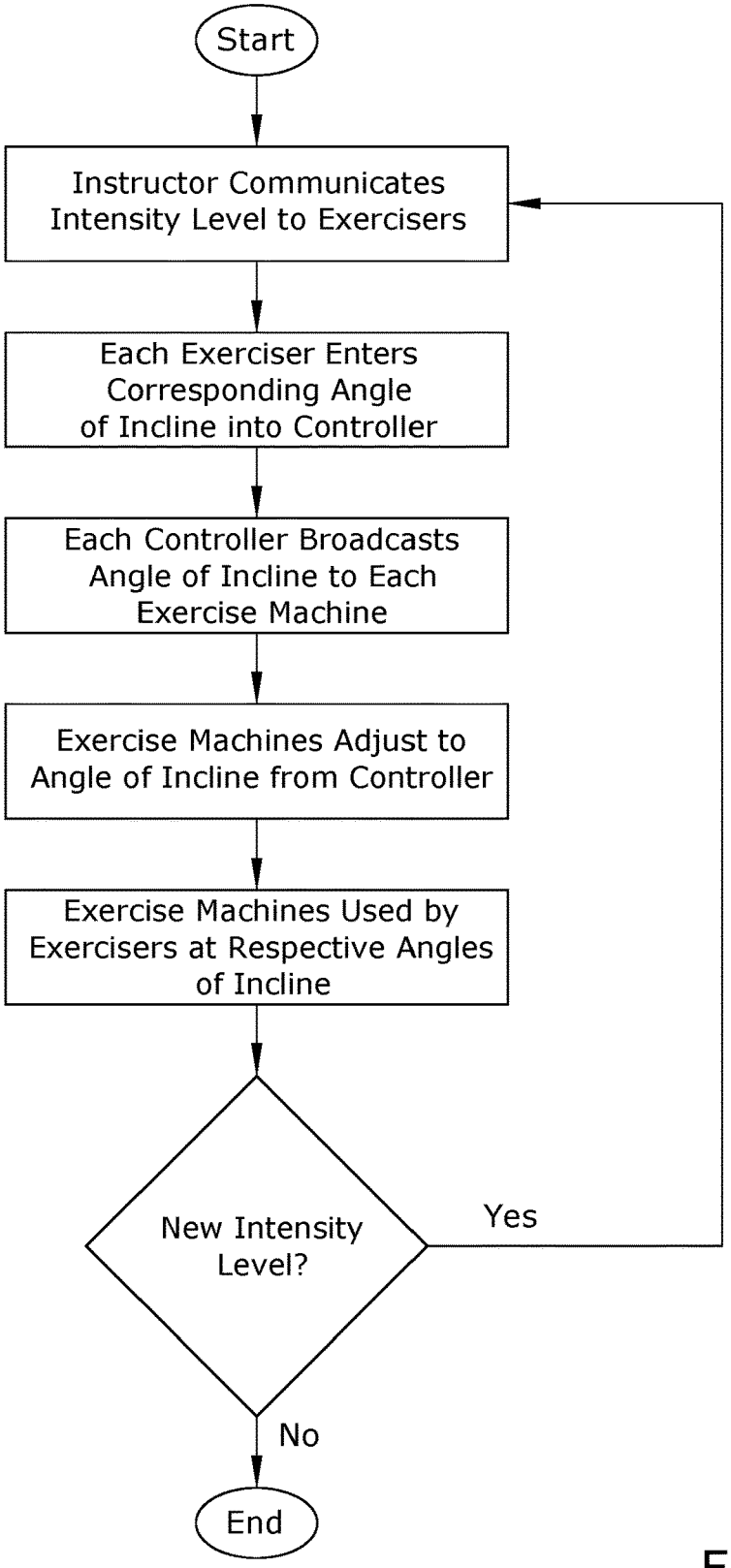
FIG. 17 is a flowchart illustrating individual exerciser adjustment of angles of incline for an adjustable exercise system.

FIG. 16 is a flowchart illustrating a plurality of exercisers each on their own adjustable exercise machine 10 which are controlled by a single instructor controller 70. FIG. 17 is a flowchart illustrating a single exerciser controlling his/her own adjustable exercise machine 10 with his/her own controller 70 in response to instructions from an exercise instructor.

Prior to the start of an exercise sequence, one or more exercisers mount one or more adjustable exercise systems 10. Once the exercisers are properly positioned upon the adjustable exercise systems 10, an instructor prepares to start an exercise session. Using a controller 70, the instructor launches a software program that allows the instructor to select any number of pre-programmed exercises or exercise sequences, such exercises or exercise sequences having been programmed by a manufacturer, or by the instructor. The instructor then initiates the sequence by starting the program on the controller 70.

The controller 70 is connected to each and all of the adjustable exercise systems 10 by a variety of methods including wirelessly through a network 12 such as via a Bluetooth connection or by a physical wire (not shown) through which the controller 70 signals pass. It should be noted that any particular controlling device that controls the incline of a particular Pilates machine may be mounted on or near that particular machine for the express purpose of controlling the exercise sequence and/or incline/decline angle of the upper structure of only that particular machine.

A receiver 68 integral to each of the adjustable exercise systems 10 comprises a signal receiver which is adapted to adjust the actuators 40, 50 responsive to signals received from the controller 70. Throughout the duration of the exercise cycle, or during various times during the performance of the exercise cycle, the controller 70 sends signals to adjustable exercise systems 10 that direct the incline actuators 40, 50 to increase or decrease the incline angle, thereby correspondingly increasing or decreasing the workout intensity that results when an increased or decreased portion of each exerciser's body weight is correspondingly added or subtracted from the total resistance force encountered during the exercise.

Either a result of an instructor manually ending the exercise, or because the preprogrammed sequence has been completed, the controller 70 in communication with the machines sends a signal at the end of the exercise, thereby instructing the adjustable exercise systems 10 to remain in their most recent positions, or change the incline angle to return to a preprogrammed starting position.

II. Multi-Axis Adjustable Exercise Machine

A. Overview

FIGS. 18 through 54 illustrate a multi-axis adjustable exercise machine 80. The multi-axis adjustable exercise machine 80 is adapted to move about at least two axes, such as, but not limited to, a pitch axis 82 and a roll axis 83. Two of the axes of movement for the multi-axis adjustable exercise machine 80 are preferably substantially perpendicular to one another.

The movement of the multi-axis adjustable exercise machine 80 may be controlled by any manner known in the art to control the motion and position of one or more actuators 130, 140, 162, 166. For example, the movement of the multi-axis adjustable exercise machine 80 may be controlled by a control unit remotely positioned or by a control unit positioned on the multi-axis adjustable exercise machine 80.

The multi-axis adjustable exercise machine 80 is adapted to move about a pitch axis with the front portion and/or rear portion moving upwardly or downwardly. The exercise machine 100 of the multi-axis adjustable exercise machine 80 may be pivotally attached to a base 90 at various locations along the exercise machine 100 from the rear end to the front end of the exercise machine 100 (e.g. rear end, rear portion, central portion, center, front portion, front end) to form the pitch axis.

The multi-axis adjustable exercise machine 80 is further adapted to move about a roll axis with the left side and/or right side moving upwardly or downwardly. The movements of the left side and the right side may be concurrent with one another or at different times. For example, as the left side moves upward the right side concurrently moves downward and vice versa. Alternatively, the movements may be performed at separate times. The exercise machine 100 of the multi-axis adjustable exercise machine 80 may be pivotally attached to the base 90 at various locations between the left side and the right side of the exercise machine 100 to form the roll axis, but it is preferable that the pivot connection be made at a central location between the left side and right side of the exercise machine 100.

The adjustment of the pitch and roll of the exercise machine 100 may be done independent of one another or concurrently with one another. For example, the multi-axis adjustable exercise machine 80 may adjust the pitch of the exercise machine 100 first and then the roll of the exercise machine 100 after the pitch has been adjusted and vice versa. As another example, the multi-axis adjustable exercise machine 80 may adjust the pitch and the roll of the exercise machine 100 concurrently in one fluid motion.

In use of the invention, the exerciser is positioned on the exercise machine 100 to perform a first exercise. The exercise machine 100 is pivoted about a first axis in a first or second direction and/or about the second axis in a first or second direction to a first position having a first attitude. It can be appreciate that the initial position may have various attitudes, but is preferable that the initial position of the exercise machine 100 is level with the upper surface of the exercise machine 100 parallel to the ground surface. After or during the transition of the exercise machine 100 to the first position which has a different attitude from the initial position, the exerciser performs a first exercise.

After the first exercise is performed, the exercise machine 100 is pivoted about the first axis in the first or second direction and/or about the second axis in the first or second direction to a second position having a second attitude that is different than the first attitude of the first position. After or during the transition of the exercise machine 100 to the second position, the exerciser performs a second exercise that may be the same as or different from the first exercise.

After the second exercise is performed, the exercise machine 100 is pivoted about the first axis in the first or second direction and/or about the second axis in the first or second direction to a third position having a third attitude that is different than the second attitude of the second position. After or during the transition of the exercise machine 100 to the third position, the exerciser performs a third exercise that may be the same as or different from the first exercise and/or second exercise. This process continues for as many different positions the exerciser desires.

Figure 18:
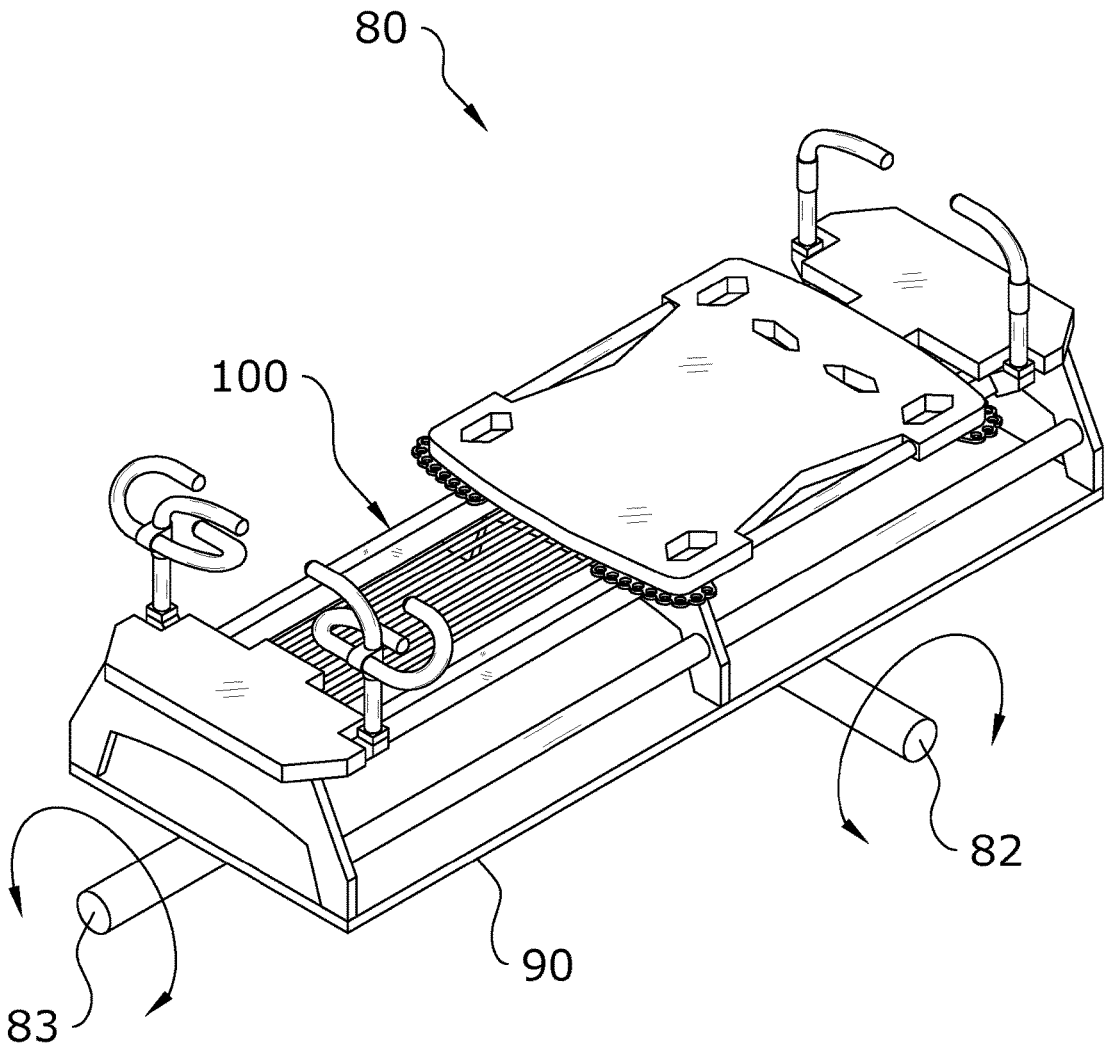
FIG. 18 is an upper perspective view of an exemplary multi-axis adjustable exercise machine.

FIG. 18 is an exemplary diagram showing an orthographic view of an exemplary multi-axis adjustable exercise machine 80 of the present invention comprising an upper structure with a length dimension substantially longer than the width dimension, incorporating one or more rails 105 aligned with the longitudinal axis of the structure, and an exercise carriage 120 slidable along a substantial length of the rails 105, and a structural base 90 of a length and width as reasonably necessary to provide stability to the upper structure and an exerciser positioned thereupon. A resistive force is applied to the slidable carriage 120, preferably by the use of one or more biasing members (e.g. springs, elastic cords) attached between the upper structure at the rear end 102 of the machine 100, and the slidable carriage 120. To perform certain exercises on the machine 100, the exerciser 85, positioned upon the slidable carriage 120, applies a force to the upper structure that exceeds the spring resistance force such that the slidable carriage 120 moves away from the rear end 102 of the machine 100.

It should be noted that "rear end 92" is used herein merely as a description of one end of the structure to which a spring biasing means is attached. The "front end 91" is used herein merely to describe the end of the structure opposite the rear end 92. No reference should be drawn relating to human anatomy, nor to the positioning or orientation of an exerciser's feet or head upon the machine 100.

An improved exercise machine 100 may incorporate other features such as a first non-slidable platform 122 at the rear end 102 of the machine 100, a second non-slidable platform 124 at the front end 101 of the machine 100, and one or more gripping or pushing handles affixed to the upper support structure at various locations.

For illustrative purposes, a roll axis 83 is shown aligned parallel to the longer axis of the machine 100, and a pitch axis 82 is shown aligned perpendicular to the roll axis 83. It should be noted that a roll axis 83 may be positioned anywhere along the width of the pitch axis 82 so long as the position remains within the maximum width of the machine 100. It should be further noted that the pitch axis 82 may be positioned anywhere along the length of the roll axis 83 so long as the position is within the maximum length of the machine 100.

The upper structure may roll to the left or right at acute angles relative to the substantially horizontal structural base about the roll axis 83. The upper structure may also pitch up or down at acute angles relative to the substantially horizontal structural base 90 about the pitch axis 82.

Figure 19:
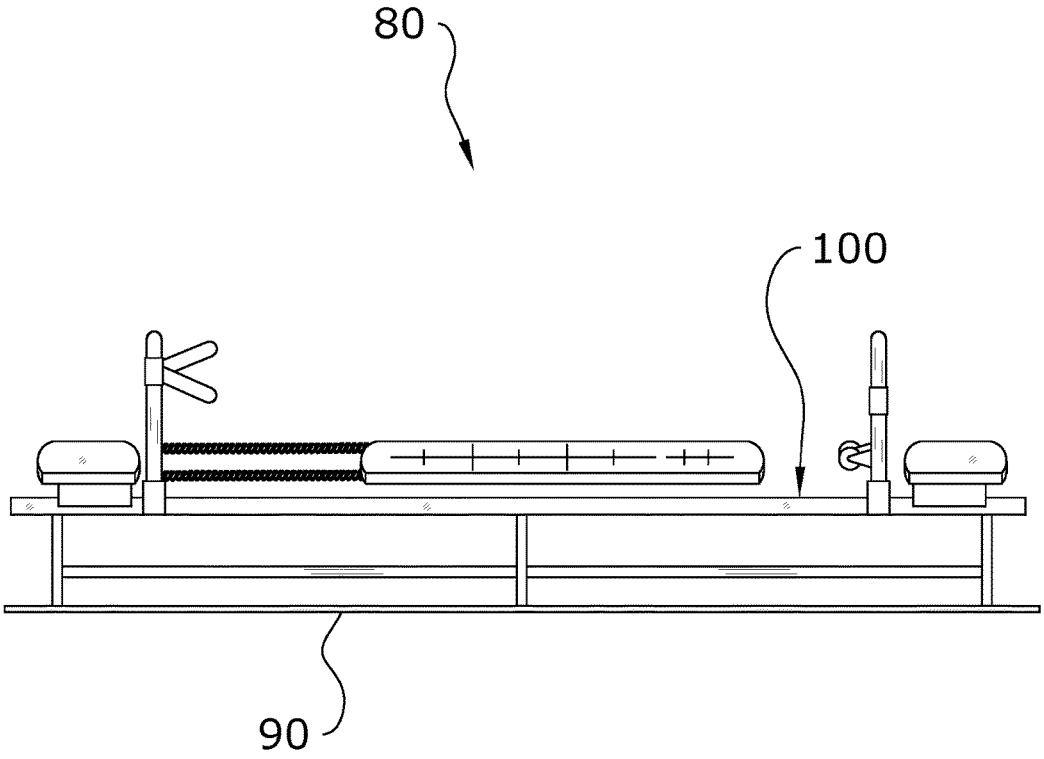
FIG. 19 is a side view of an exemplary multi-axis adjustable exercise machine on a level plane.

FIG. 19 is an exemplary diagram showing a side view of an improved exercise machine 100. In the diagram, an upper structure is pivotally attached to the substantially horizontal structural base 90 such that the upper structure may be tilted about a pitch axis 82 to various acute angles relative to the base 90 structure. The upper structure preferably comprises a slidable carriage 120 that rolls along the major length of the machine 100 on one or more rails 105 aligned with the longitudinal axis of the machine 100, and one or more resistance springs removably attached between the rear end 92 of the machine 100 and the slidable carriage 120.

A first stationary platform 122 is shown at the rear end 102 of the machine 100, and a second stationary platform 124 is shown at the front end 101 of the machine 100. A plurality of gripping handles are shown affixed to the upper structure at various positions. It should be noted that the stationary platforms 122, 124 and gripping handles are accessories that may be frequently attached to traditional exercise machines 80, and are not required features of the machine 100 of the present invention.

Figure 20:
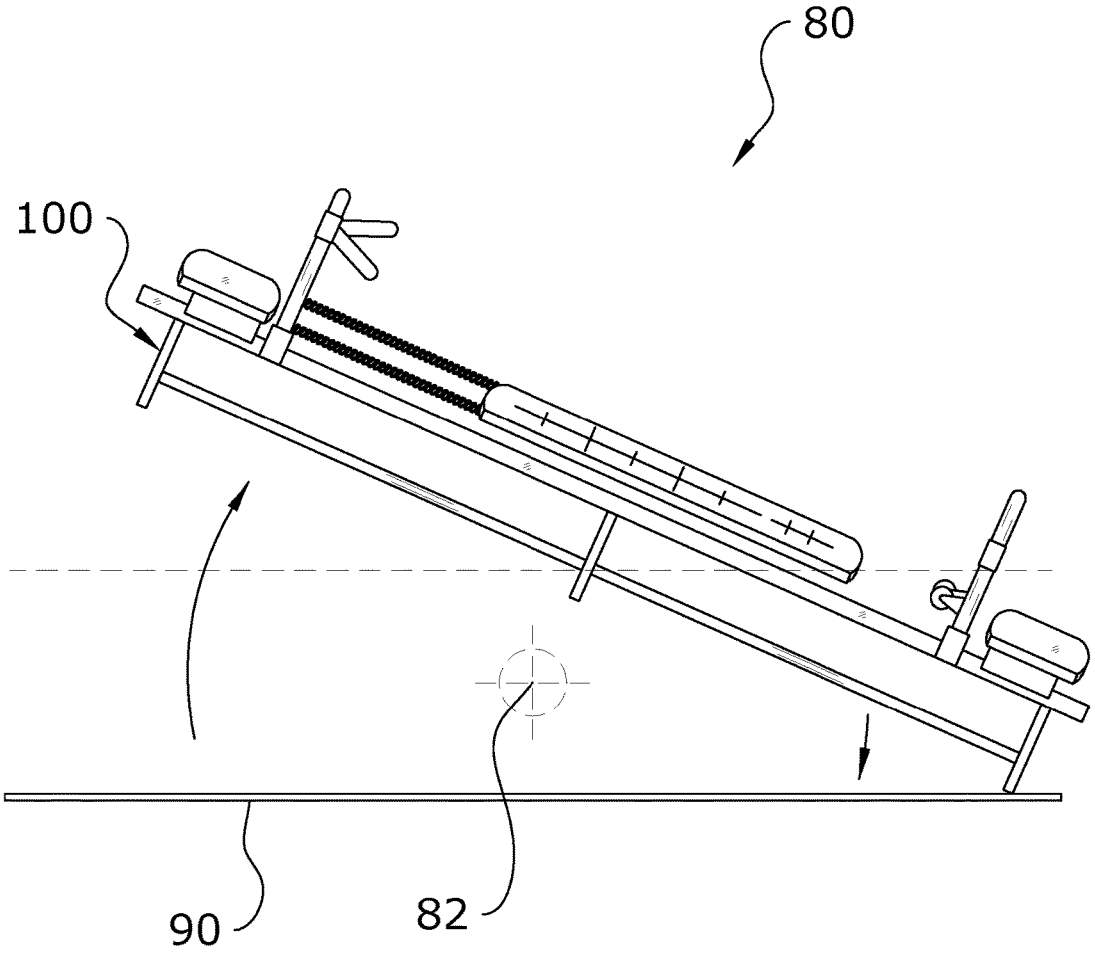
FIG. 20 is a side view of an exemplary multi-axis adjustable exercise machine on a pitched plane in a first direction.

FIG. 20 is an exemplary diagram showing a side view of an improved exercise machine 100 that has been pivoted clockwise about a pitch axis 82. More specifically, an upper structure being pivotally attached to a substantially horizontal structural base 90 allows the upper structure to rotate about a pitch axis 82 such that the stationary platform at the rear end 102 can be variably pitched upward at acute angles relative to the structural base 90.

In the diagram, the stationary platform 122 affixed to the front end 91 is shown pitched down relative to the horizontal position of the top plane of the platform 122 prior to angularly pitching the platform 122 about the center of the pitch axis 82. Achieving a downward pitch relative to the pitch axis 82 is made possible when the horizontal centerline of the pitch axis 82 is positioned at a certain dimension above the structural base, thereby allowing the front end 91 to pitch about the axis 82 until the underside of the upper structure contacts the structural base 90 which prevents further rotation.

It should be noted that if the pitch axis 82 is also the center of a pivoting means positioned at the outermost edge of the upper structure, hingeably attaching the upper structure to the structural base 90, the stationary platform 122 at the front end 91 would be unable to tilt downward relative to the horizontal centerline of the axis, and the entire upper structure would only pivot upward relative to the horizontal structural base 90.

The position of the pitch axis 82 and pivoting means affixing the upper structure to the structural base 90 is not mean to be limiting, and the center of the pitch axis 82 may be positioned vertically between the structural base 90 and upper structure, and horizontally at any point along the length of the upper structure.

The weight of an exerciser 85 positioned upon the slidable carriage 120 will bias the slidable carriage 120 to slide downward and to the right in response to the additional body weight of the exerciser 85 being applied to a declined plane, more easily overcoming the resistance force of the springs. Adding a portion of the exerciser's 85 body weight to reduce the force necessary to overcome the spring resistance may be preferred, for example, in cases when an exerciser 85 is rehabilitating following an injury, or to prevent injury of an un-fit or beginner exerciser 85.

Further, those skilled in the art will immediately understand that a great many hinge mechanisms may be affixed to and interposed between the upper and base structures 90, thereby allowing the plane of the top surface of the upper structure to be positioned at any reasonable acute angle relative to the horizontal structural base 90, preferably between one and 90 degrees from the horizontal plane.

Still further, the upper structure of the machine 100 may be supported above the horizontal base structure by a plurality of variable height posts, for instance, one hydraulic actuator 130, 146, 162, 166 in each of the four corners of the machine 100 such that variably adjusting the length of the rams of two or more actuators 130, 146, 162, 166 effectively changes the plane of the upper structure to a non-horizontal plane relative to the horizontal plane of the base structure 90.

Therefore, to describe or illustrate every possible combination of positions and types mechanisms that could be used to change the plane of the upper support structure relative to the base structure 90 would be inefficient, exhaustive, and unduly burdensome, but doing so would nevertheless affirm that varying the pitch and roll of the top surface of the upper structure at acute angles relative to the horizontal plane is novel and unanticipated as a means to increase exercise intensity and muscle engagement.

Figure 21:
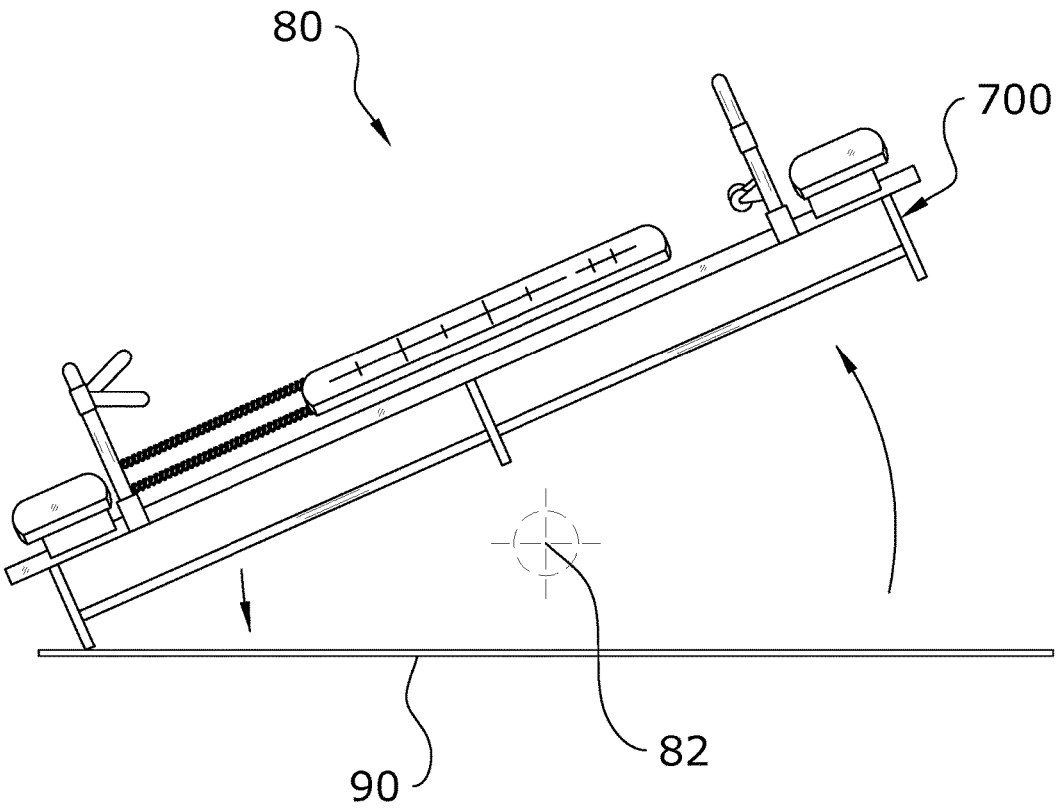
FIG. 21 is a side view of an exemplary multi-axis adjustable exercise machine on a pitched plane in a second direction.

FIG. 21 is an exemplary diagram showing a side view of an exercise machine 100 that has been pivoted counterclockwise about a pitch axis 82. In the diagram, the front end 91 of the upper structure of the machine 100 has been raised above the rear end 92 of the machine 100 relative to the horizontal plane of the structural base 90. The slidable carriage 120 is attached to the upper structure by a spring biasing means. An exerciser 85 positioned upon the slidable carriage 120 would be required to overcome the spring biasing force, as well as lift a portion of their own body weight, in order to move the slidable carriage 120 towards the raised front end 91.

Those skilled in the art will immediately appreciate that adding a portion of the exerciser's 85 body weight to the spring force increases the workload of the exerciser 85, which is considered beneficial to shortening the duration of an exercise, or to increase the intensity of weight training beyond that which could only be achieved with spring force alone when performed on a substantially horizontal exercise carriage 120. Additionally, those skilled in the art will understand that tilting the exercise machine 100 about the pitch axis 82 will beneficially engage muscles that the exerciser 85 would not normally engage, or engage those muscles more fully when compared to performing exercises on a substantially horizontal exercise machine 100.

Figure 22:
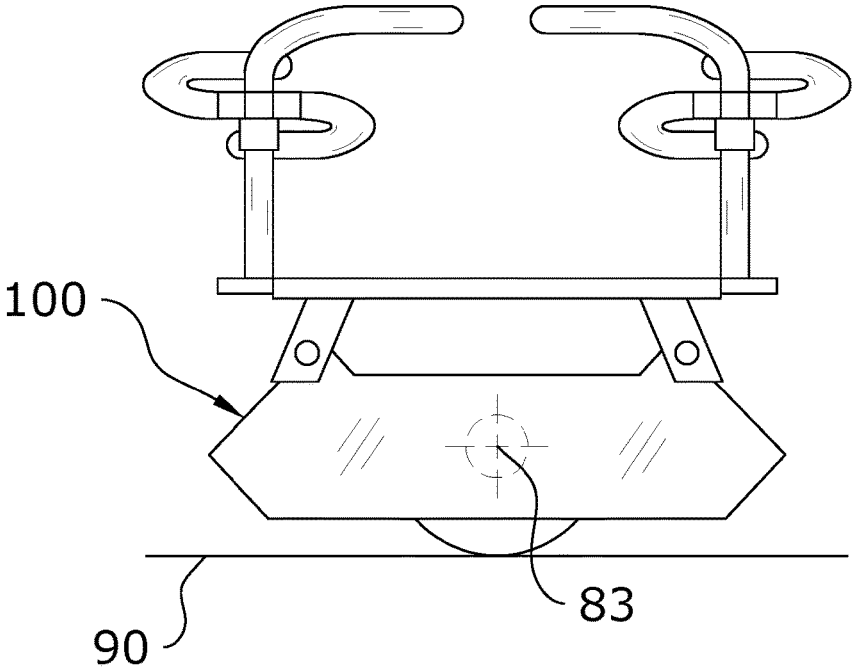
FIG. 22 is a frontal view of an exemplary multi-axis adjustable exercise machine on a level plane.

FIG. 22 is an exemplary diagram showing an end view of an improved exercise machine 100. In the diagram, a front view of the platform 124 at the rear end 102 of the upper structure of the machine 100 is shown. A slidable carriage 120 not shown in this view rolls along one or more longitudinal rails 105 in response to the force exerted upon the slidable carriage 120 by an exerciser 85. Foot bars and handles that may be used by an exerciser 85 when performing exercises are shown for reference, but are not an integral part of the present invention. The rear end platform 124, longitudinal rails 105 and slidable carriage 120, along with a spring biasing means not shown, comprise substantially an upper structure of the illustrated exercise machine 100.

A substantially horizontal base structure 90 is shown, being of sufficient width and length so as to support the upper structure and an exerciser 85 thereupon. The diagram shows an end view of a roll axis 83 about which the upper structure may roll clockwise or counterclockwise at acute angles as determined by an exerciser 85 or exercise instructor.

It should be noted that there are many means of attaching an upper structure to a substantially horizontal lower structure of a Pilates machine such that the plane of the top surface of the upper structure may be rolled or pitched to an acute angle relative to the horizontal base structure 90, including but not limited to a central axle, one or more hinges, or lifting devices such as hydraulic cylinders capable of lifting one side of the upper structure relative to the opposed side of the structure, all of which would position the plane of the upper structure at an acute angle about one or more axes relative to the horizontal base structure 90.

Figure 23:
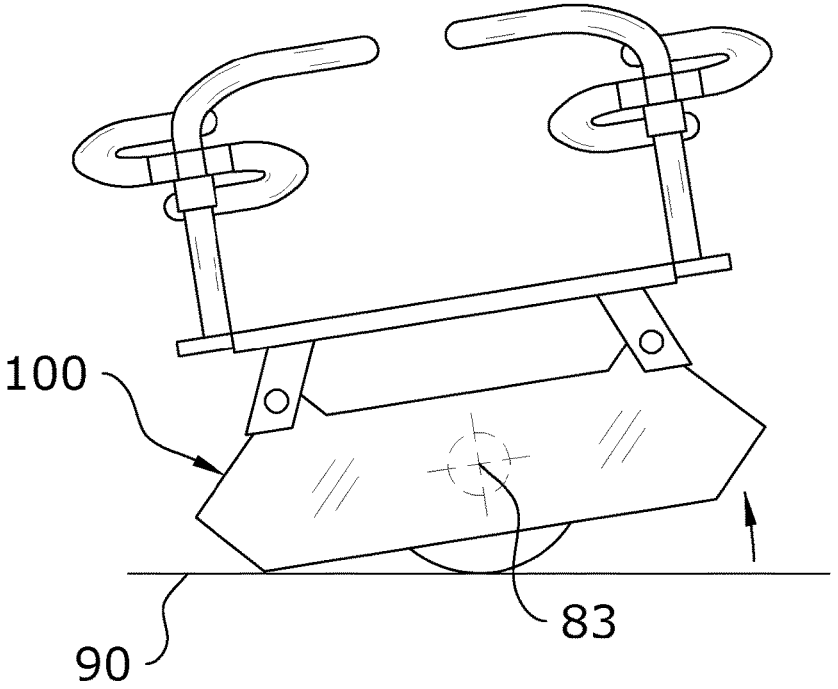
FIG. 23 is a frontal view of an exemplary multi-axis adjustable exercise machine on a rolled plane.

FIG. 23 is an exemplary diagram showing an end view of a Pilates machine with the plane of the top surface of the foot platform 124 that has been rolled counter-clockwise about the roll axis 83. Those skilled in the art will immediately understand that although rolling the upper structure unbalances the exerciser 85 when compared to traditional exercise machines 100, they would nevertheless acknowledge that such unbalancing would require the exerciser 85 to beneficially engage muscles not otherwise used to maintain balance on a horizontal exercise surface, or to more forcefully engaging muscles that would ordinarily be used on a horizontal exercise platform.

Figure 24:
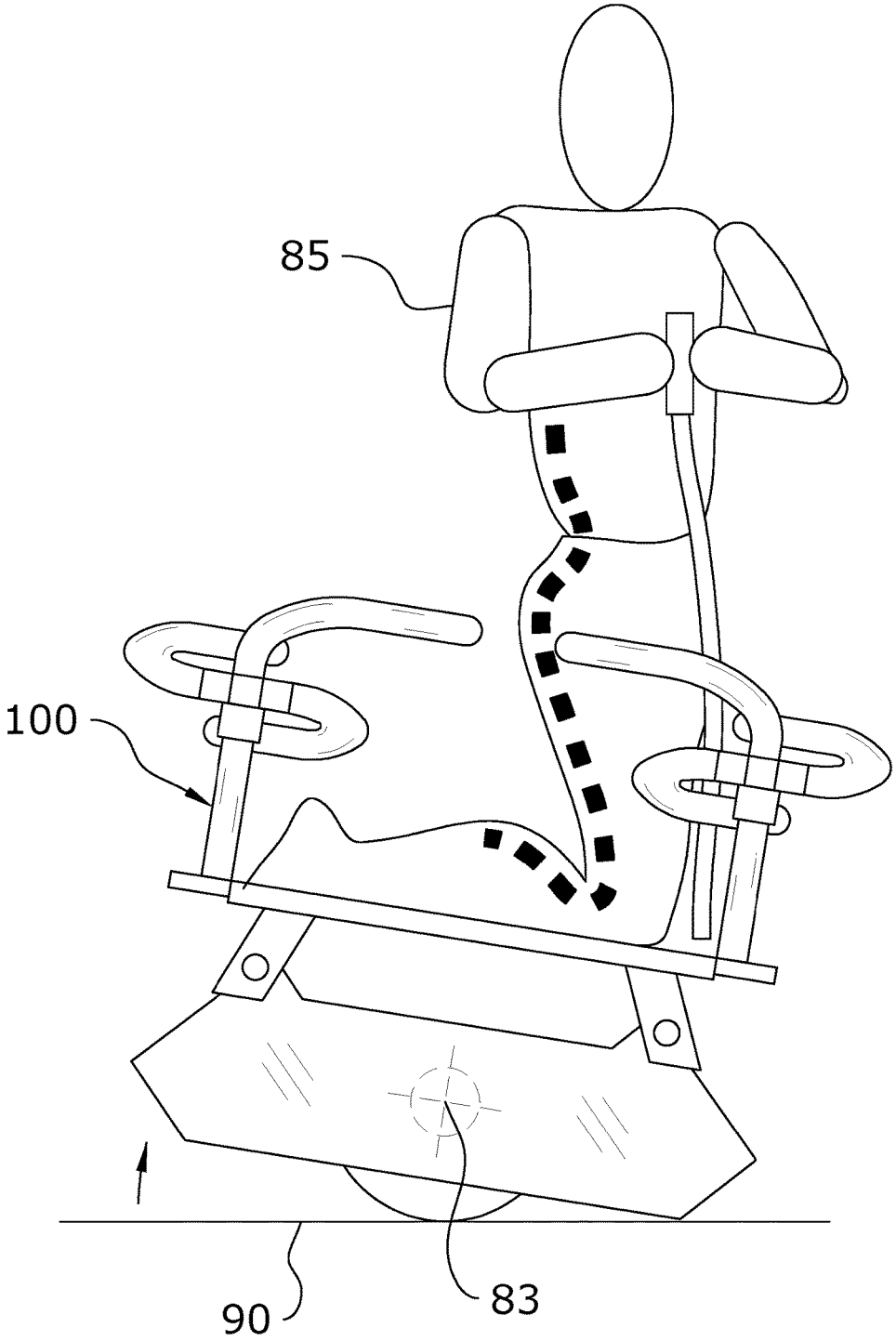
FIG. 24 is a frontal view of an exemplary multi-axis adjustable exercise machine being used on a rolled plane by an exerciser in a kneeled position.

FIG. 24 is an exemplary diagram showing an end view of an exercise machine 100 that has been pivoted clockwise about a roll axis 83, and an exerciser 85 thereupon. More specifically, a roll axis 83 is located at one edge of an exercise machine 100 as a hingeable connection means between the upper structure and a supporting base structure 90.

In the diagram, one edge opposed to the edge incorporating the hinged connecting means between the upper and base structures 90 is rolled clockwise such that the top plane of the upper structure is tilted to thereby create an acute angle of the exercise carriage 120 relative to the horizontal base structure 90. It should be noted that a longitudinal axis pivot point positioned along the center line of the machine would allow the upper structure to rotate counterclockwise, as well as clockwise as desired by the exerciser 85 or instructor.

A representative exerciser 85 is positioned in a kneeling position upon the angled top surface of a slidable carriage 120, grasping a pull rope that is passed through a pulley affixed to the upper structure, with the opposite end of the rope attached to the slidable carriage 120. In the diagram, the exerciser 85 has locked their hands at a fixed position, preferably along the centerline of their upper body, and performs an exercise by twisting the upper body such that the locked position hands that are grasping the rope pull the rope through the pulley, thereby moving the slidable carriage 120 in a direction opposed to the spring biasing force.

Those skilled in the art will immediately recognize that an exerciser 85 kneeling on an exercise carriage 120 with a top surface tilted relative to the horizontal base structure must engage muscles not typically engaged when kneeling on a traditional exercise machine 100. In the diagram, muscles that may be more fully engaged by the exerciser 85 in order to maintain balance on the declined platform include the calf, gluteal, hamstring and external oblique muscles.

Through experimentation and testing, it was found that a pitch to the top exercise surface of an exercise machine 100 of as little as five degrees created significantly increased stimulation of muscles not ordinarily used, or which may be only marginally used when performing the same exercise on a substantially horizontal exercise surface. Introducing a pitched or rolled exercise surface of the exercise machine 100 stimulates the body's proprioceptors which sense imbalance to which the exercise responds to maintain balance. The result is enhanced coordination and agility of the exerciser 85.

More intense muscle engagement resulting from performing exercises on a pitched exercise surface is more beneficial than not engaging those muscles on a horizontal exercise surface. For instance, in an effort to experience a complete body workout, engagement of major and minor muscles to correct an off-center balance, while at the same time engaging the major and minor muscles required to perform the exercise, increases the types and number of muscles engaged during a workout. Further, the pitched or rolled exercise surface forces an exerciser 85 to consider each movement and body position throughout the exercise, thereby disrupting muscle memory which results in a more effective workout regimen.

The commercial benefit of an exercise machine 100 of the present invention that provides for performing exercises on pitched exercise surface is that more muscles are engaged, and more calories are burned during an exercise routine, thereby reducing the duration of a workout. Shorter workout times that do not reduce the workout effectiveness allow exercise studios to conduct more exercise classes during a typical day, thereby realizing a revenue increase as a result of more classes that use the same machines 100 during normal business hours.

Figure 25:
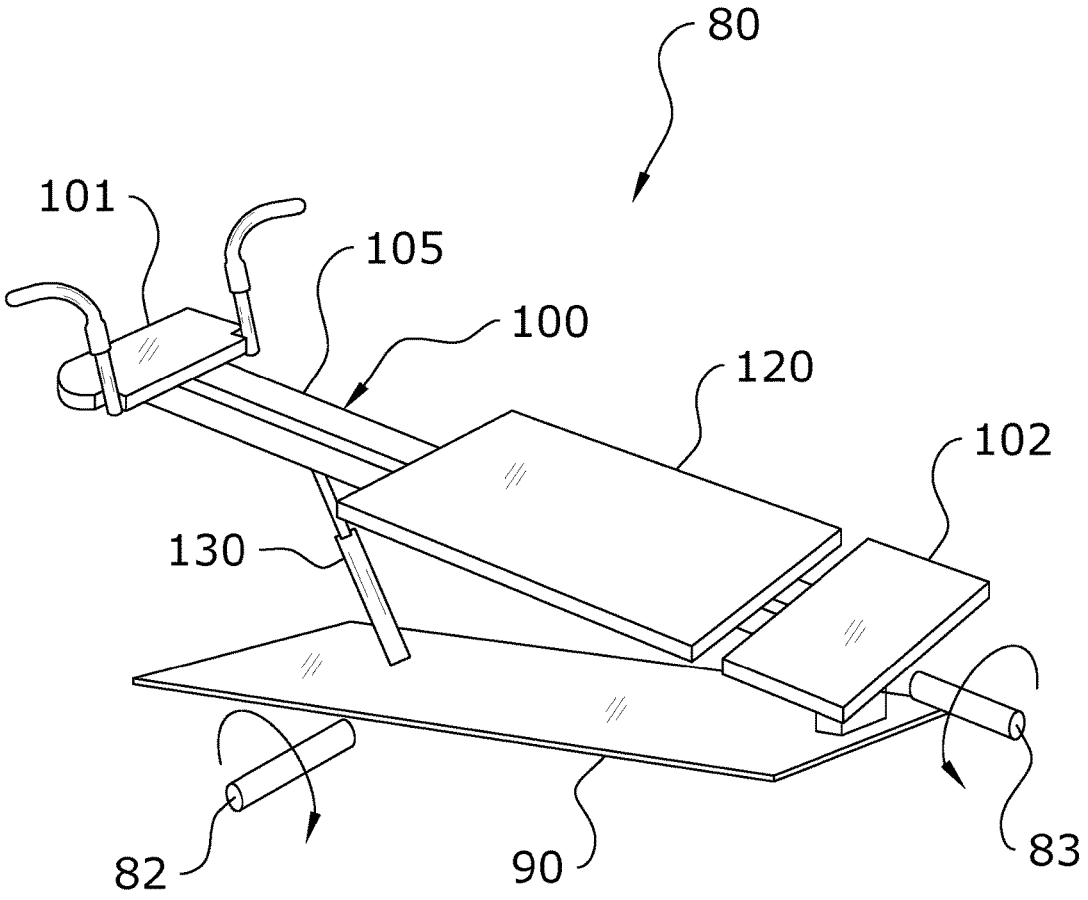
FIG. 25 is an upper perspective view of an exemplary multi-axis adjustable exercise machine which has been both pitched and rolled.

FIG. 25 is an exemplary illustration showing an orthogonal view of an improved exercise machine 100 that has been pivoted about a roll and pitch axis 82, 83. In the diagram, an upper structure of an exercise machine 100 is shown with a rear end 92 of the upper structure elevated relative to the substantially horizontal base structure 90, a slidable carriage 120 that rolls along one or more rails forming a track 105 aligned with the longitudinal axis in response to the force exerted by a spring biasing means against the slidable carriage 120 by an exerciser 85, a first platform 122 positioned at the front end 91, and a substantially horizontal base structure 90. Foot bars and handles may be used by an exerciser 85 when performing exercises, but are not a required integral part of the present invention. The second platform 124, longitudinal rails 105 and slidable carriage 120, first platform 122, and integrated structure, along with a spring biasing means not shown, comprise substantially an upper structure of the exercise machine 100 of the present invention.

For illustrative purposes, a lifting means is shown connected between the upper structure and base structure as a mechanism to pitch the rear end 102 of the machine 100 upwardly relative to the front end 101, but the lifting means disclosed is not meant to be limiting. Further, it can be readily seen in the diagram that the entire plane of the top exercise surface is rolled counterclockwise about the roll axis 83. Therefore, the diagram illustrates an exercise surface that is simultaneously pitched and rolled about both the pitch and roll axes 82, 83. Introducing a novel changeable, multi-axis exercise surface into an exercise machine 100 provides for practically unlimited combinations of pitch and roll, and a practically unlimited number of exercises that can be performed on each angular variation of pitch and roll.

B. Base

As shown throughout the figures, the present invention includes a base 90 to which the exercise machine 100 of the present invention is pivotally attached such that the exercise machine 100 may be pivoted about a pitch axis 82 and/or a roll axis 83 with respect to the base 90. Adjustment to pivot about such axes 82, 83 will increase or decrease intensity of exercises as well as focus exercises on different muscle groups which are typically not focused on when using a traditional exercise machine 100 on a level plane. The shape, structure, and configuration of the base 90 may vary in different embodiments, and thus the scope of the present invention should not be construed as limited by the exemplary configuration shown in the figures.

It should be appreciated that, in some embodiments, the base 90 may be comprised of any structure which interconnects the exercise machine 100 with a surface, such as legs contacting the floor. Thus, in some embodiments, an explicit base 90 may be omitted, with the ground surface being comprised of the base 90 for the exercise machine 100. In such embodiments, the actuators 130, 146, 162, 166 may be connected directly between the ground and the exercise machine 100.

In the embodiment best shown in FIGS. 26-45, the base 90 generally includes a front end 91, a rear end 92, a first side 93, and a second side 94. The base 90 may be of a solid configuration or may be comprised of an outer frame as shown in the figures. The base 90 will rest upon the ground and remain stable as the exercise machine 100 is pivoted about the pitch and/or roll axes 82, 83.

The base 90 may include one or more cross bars 96, such as extending between the first and second sides 93, 94. The cross bar 96 may be located at various locations along the length of the base 90 between its front and rear ends 91, 92. In the embodiment shown in FIGS. 26-35, a cross bar 96 is located approximately ½ of the distance from the front end 91 to the rear end 92 of the base 90.

As shown throughout the figures, one or more actuators 130, 146, 162, 166 will generally be connected between the base 90 and the exercise machine 100. One or more of these actuators 130, 146, 162, 166 may be connected to one or more cross bars 96. However, it should be appreciated that one or all of the actuators 130, 146, 162, 166 could be connected to various locations of the base 90, particularly in embodiments which may include a solid base 90. Thus, the mount location of the actuators 130, 146, 162, 166 on the base 90 may vary and should not be construed as limited by the exemplary figures.

C. Exercise Machine

The present invention is generally used in combination with an exercise machine 100. Various types of exercise machines 100 may be utilized. Although the figures illustrate a Pilates machine 100, it should be appreciated that other exercise machines 100 such as treadmills, ellipticals, edge machines, exercise bikes, and the like could also be utilized in combination with the base 90 and actuation system of the present invention. In one embodiment, the exercise machine 100 may be comprised of the "Exercise Machine" described and shown in U.S. Pat. No. 8,641,585, issued on Feb. 4, 2014, which is hereby fully incorporated by reference.

As shown throughout the figures, the exercise machine 100 may include a front end 101, a rear end 102, a first side 103, and a second side 104. The front end 101 will generally be raised and lowered while the rear end 102 remains pivotably secured to the base 100 when the present invention is being pivoted about the pitch axis 82. However, the reverse arrangement could also be utilized; with the rear end 102 being raised and lowered while the front end 101 remains stationary. Either arrangement allows adjustment of the levels of incline (and thus the pitch angle) of the exercise machine 100 with respect to the base 90.

As shown throughout the figures, the first side 103 and second side 104 of the exercise machine 100 may also be raised or lowered as the present invention is pivoted about the roll axis 83. Generally, as the first side 103 is raised, the second side 104 is lowered, or vice versa. By raising or lowering either of the sides 103, 104 the exercise machine 100 is pivoted about the roll axis 83; increasing or decreasing the roll angle of the exercise machine 100 with respect to the base 90.

In some embodiments, the exercise machine 100 may include a carriage 120 which is slidably secured along a track 105 of the exercise machine 100. Such embodiments may also include a first platform 122 fixed at the front end 101 of the exercise machine 100 and a second platform 124 fixed at the rear end 102 of the exercise machine 100. By utilizing the present invention, a wide range of exercises may be performed such as are discussed herein.

Figure 40:
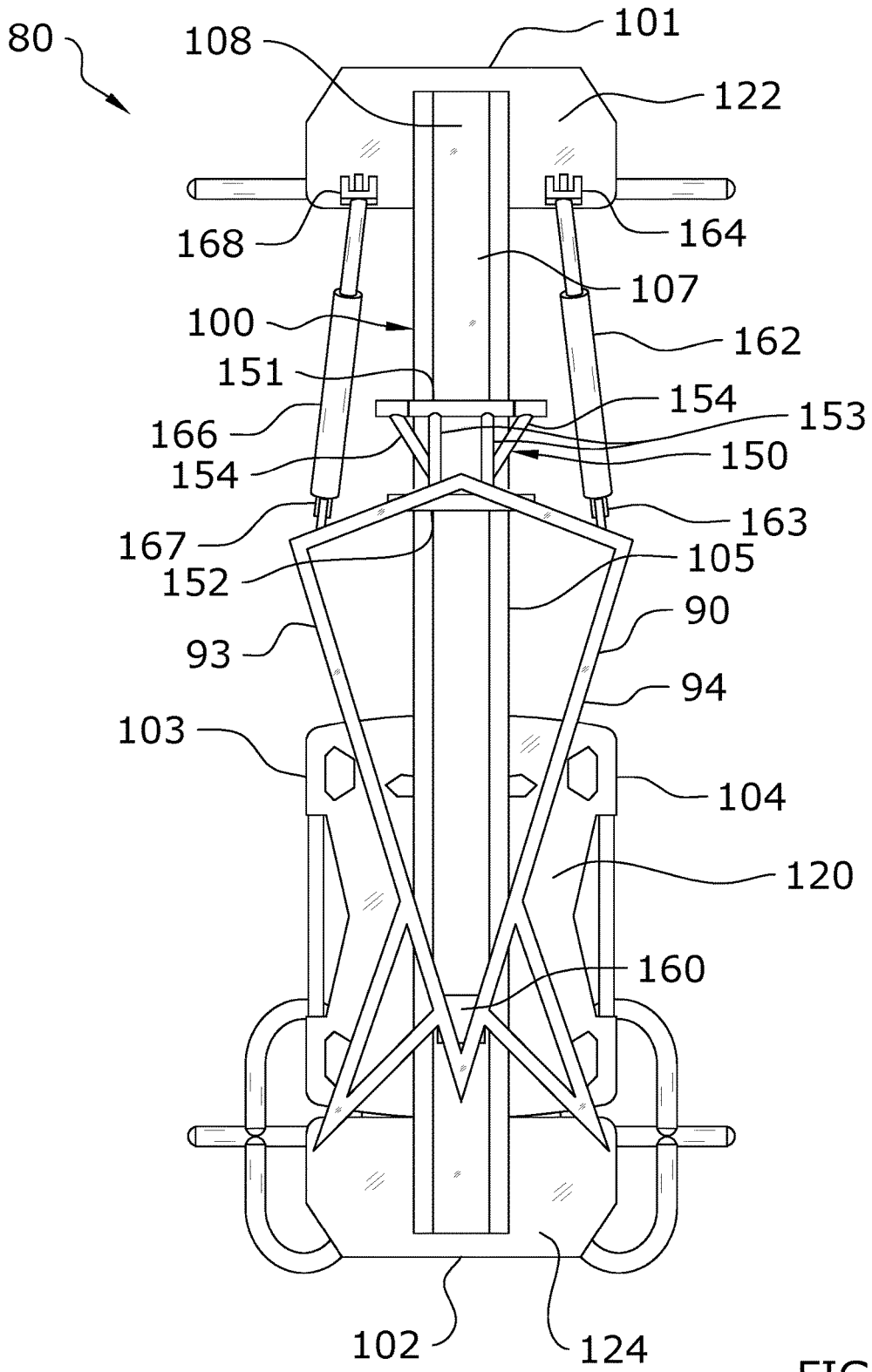
FIG. 40 is a bottom view of the present invention using a second actuation embodiment.

In embodiments which utilize a track 105, various types of tracks 105 may be utilized. The track 105 may comprise a singular rail or may comprise multiple rails which work in conjunction to form the track 105 upon which the carriage 120 is movably secured. The track 105 will generally include an upper end 106 and a lower end 107, with the carriage 120 being movably secured to the upper end 106 of the track 105. The lower end 107 of the track 105 may in some embodiments include a groove 108 such as shown in FIG. 40, with one or more joints 134, 144, 155, 161 being fixedly or slidably connected within the groove 108.

D. First Actuation Embodiment and Operation Thereof

There are numerous different embodiments of actuator systems which effectuate the pivoting of the exercise machine 100 about the pitch and/or roll axes 82, 83 with respect to the base 90. On such actuator embodiment is shown in FIGS. 26-35 of the drawings. In such an embodiment, a pitch actuator 130 is utilized to effectuate the adjustment of the pitch angle of the exercise machine 100 while a roll actuator 146 is utilized to effectuate the adjustment of the roll angle of the exercise machine 100.

Figure 26:
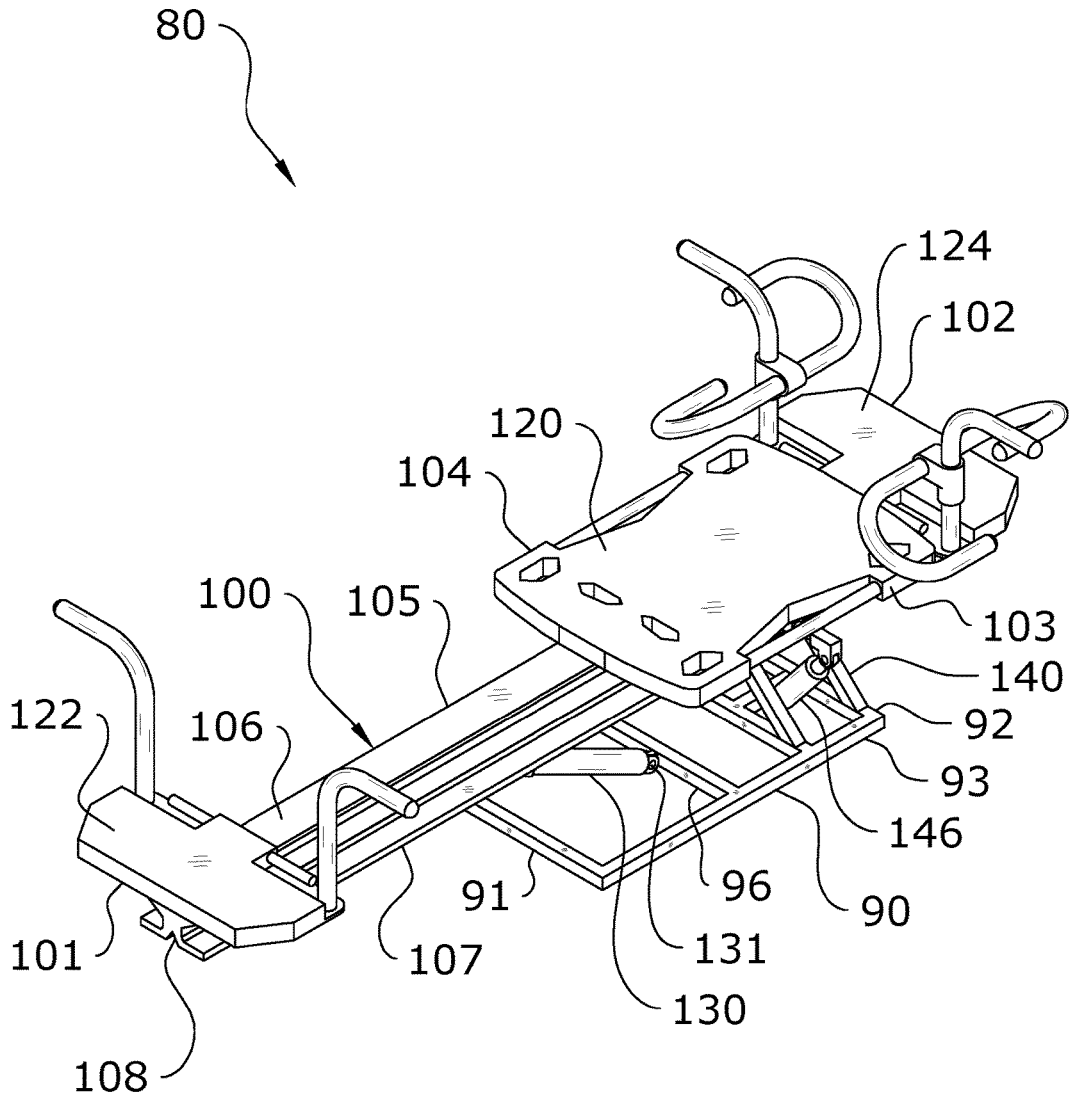
FIG. 26 is an upper perspective view of the present invention using a first actuation embodiment.
Figure 27:
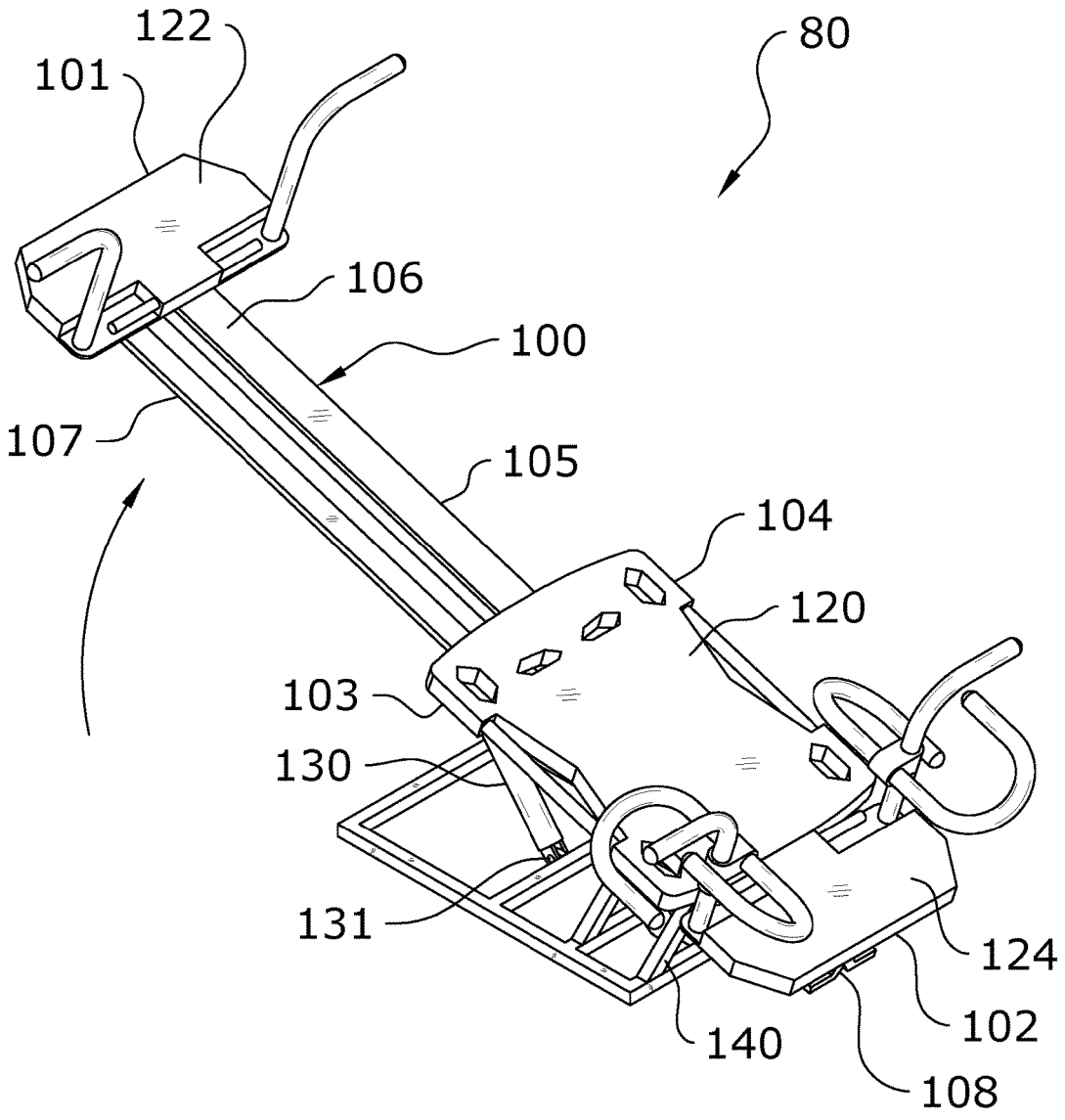
FIG. 27 is an upper perspective view of the present invention which has been pitched upward using a first actuation embodiment.
Figure 28:
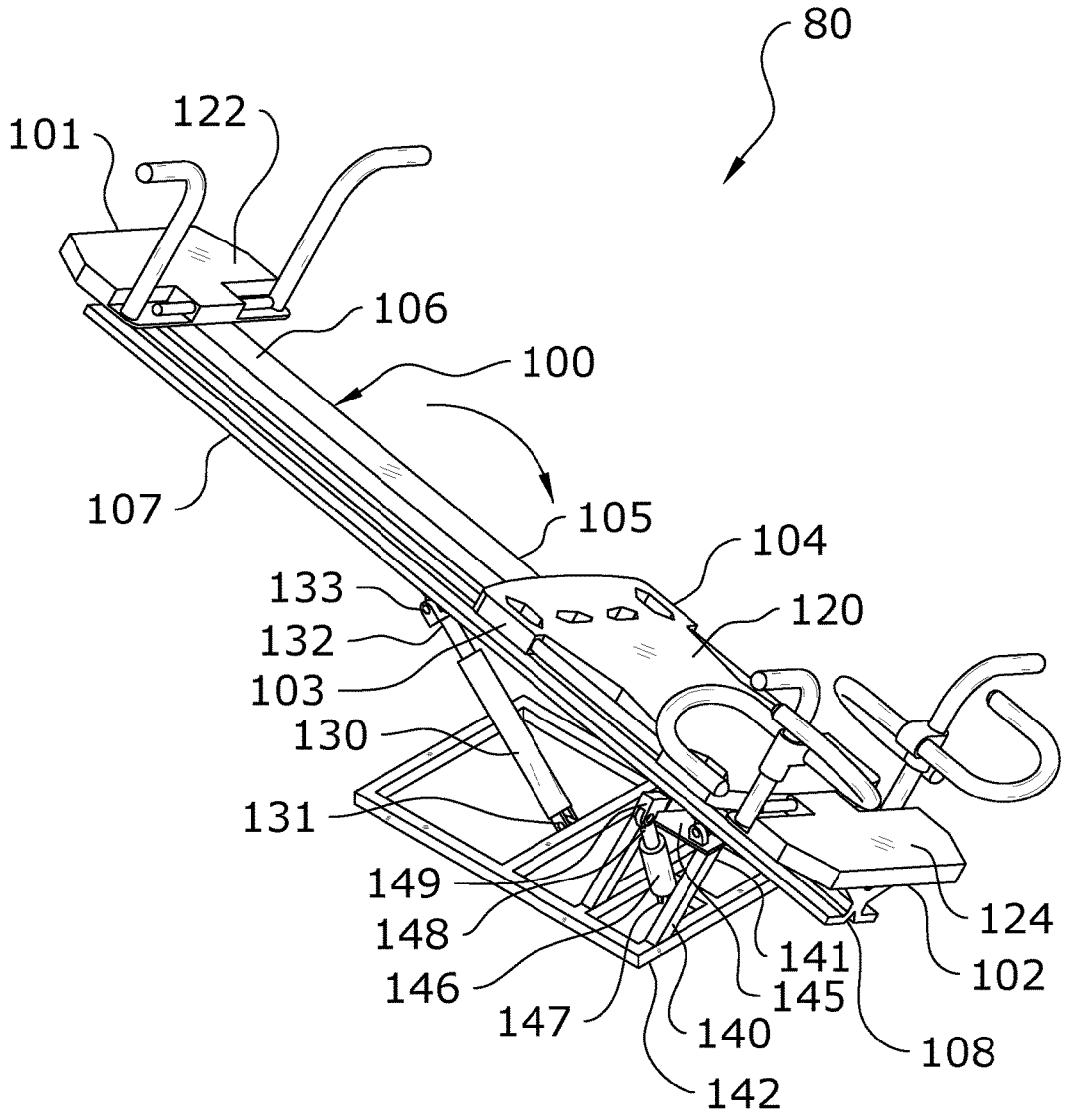
FIG. 28 is an upper perspective view of the present invention which has been pitched upward and rolled using a first actuation embodiment.
Figure 29:
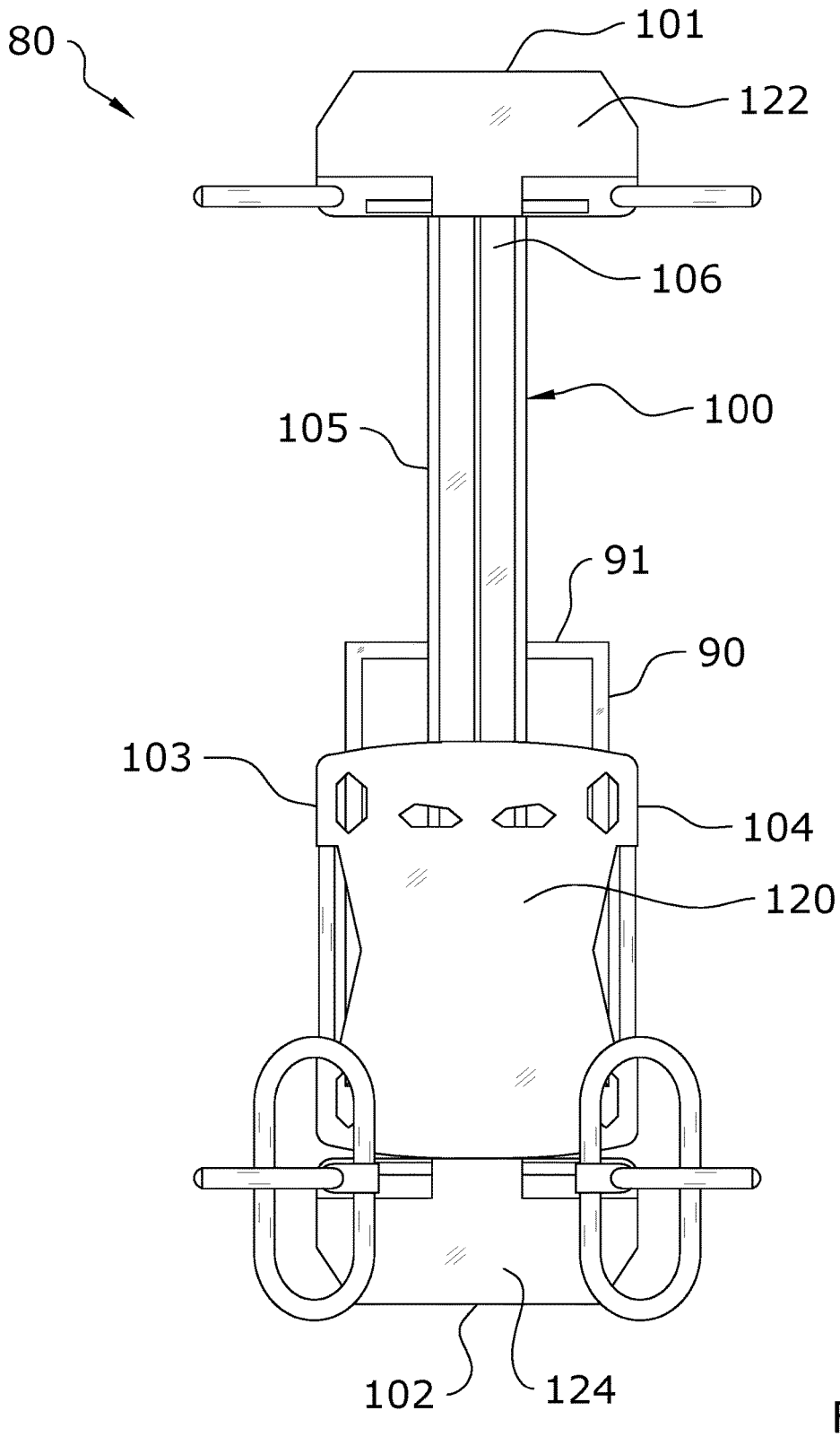
FIG. 29 is a top view of the present invention using a first actuation embodiment.
Figure 30:
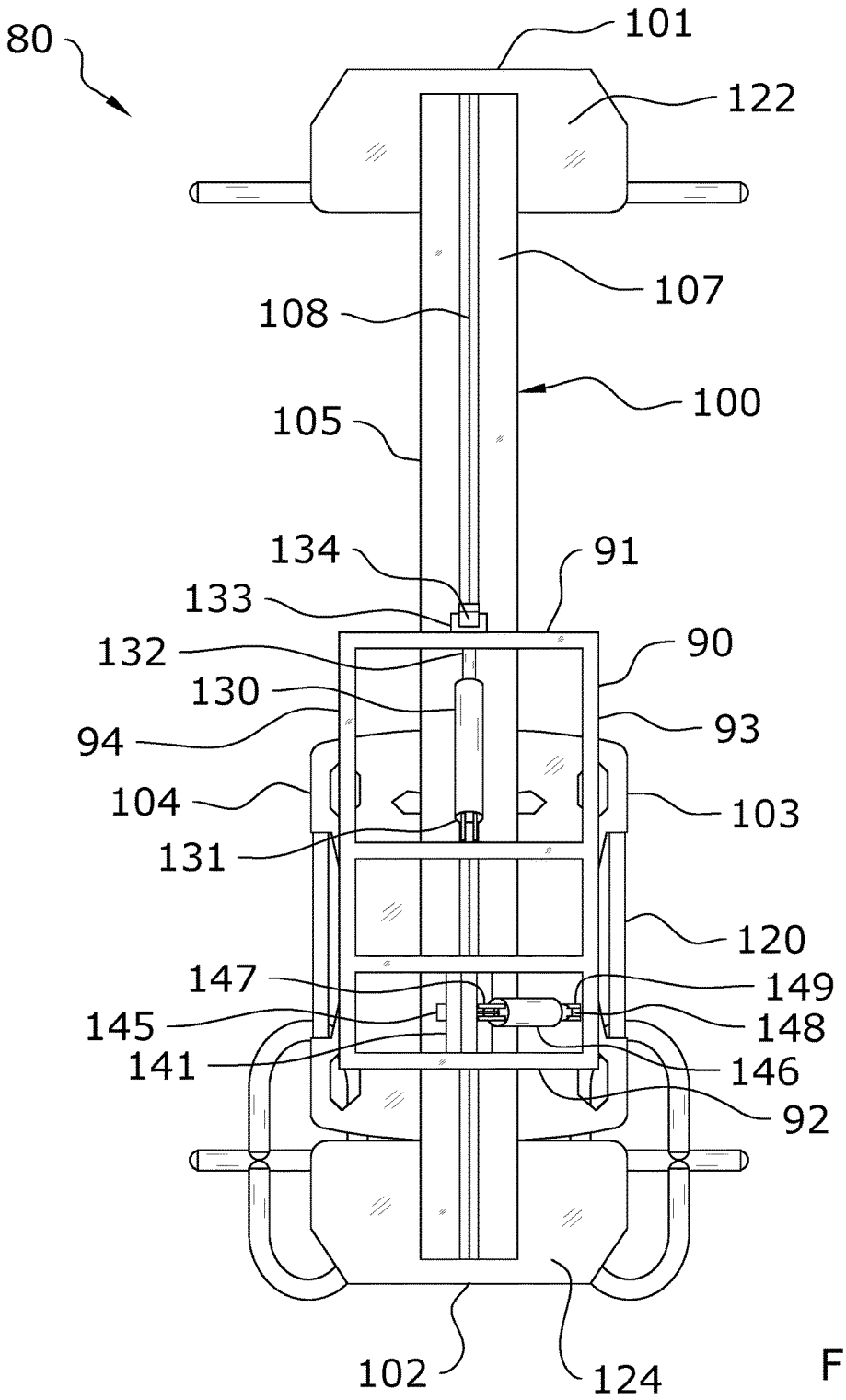
FIG. 30 is a bottom view of the present invention using a first actuation embodiment.
Figure 31:
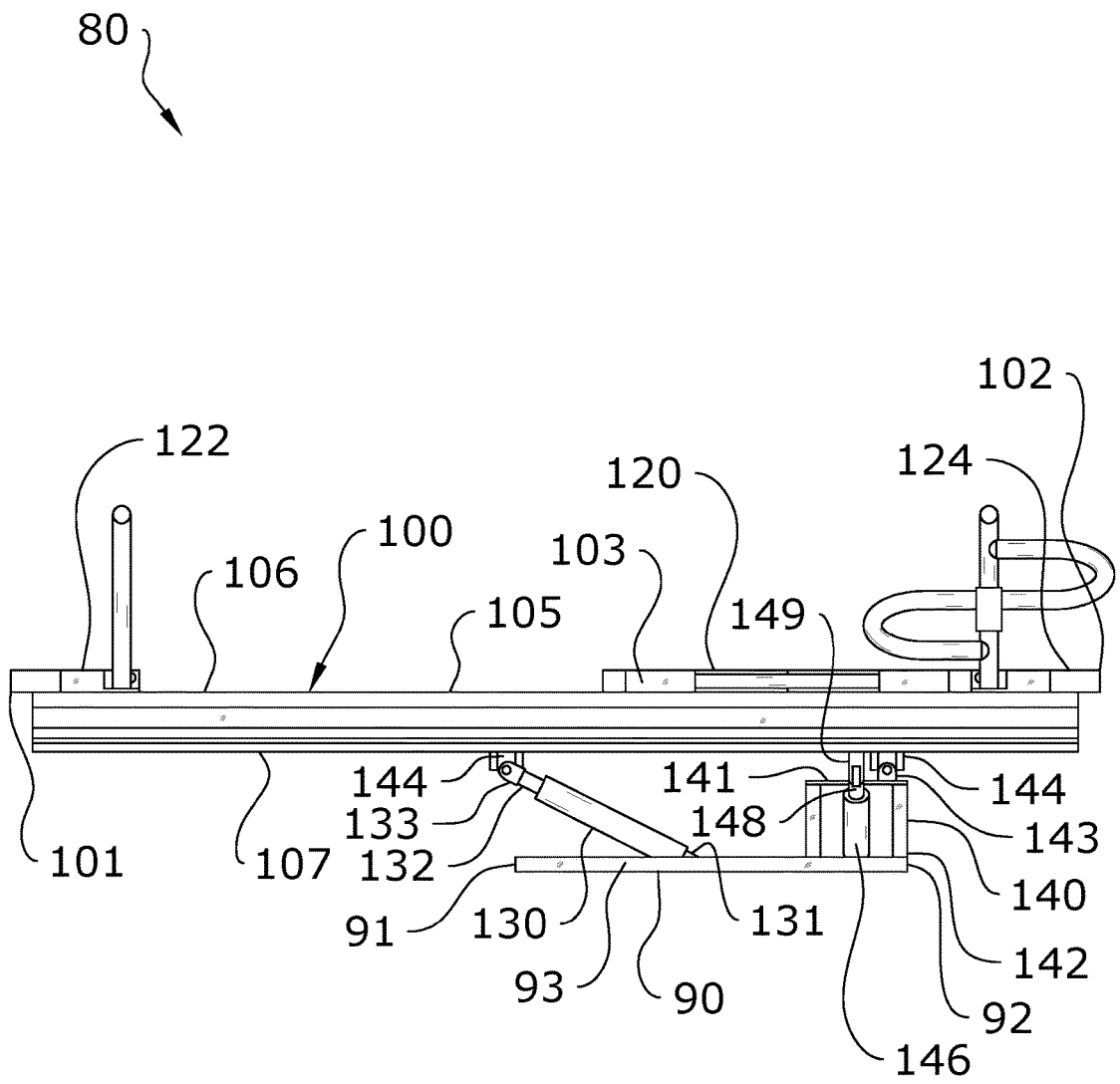
FIG. 31 is a side view of the present invention using a first actuation embodiment.

As shown in FIGS. 26 and 27, the pitch actuator 130 includes a first end 131 and a second end 132, with the first end 131 being connected to the base 90 and the second end 132 being connected to the exercise machine 100. The second end 132 of the pitch actuator 130 includes a bracket 133 which connects to a first joint 134. The first joint 134 may be comprised of any structure which will allow pivoting of the exercise machine 100 about the first joint 134.

The first joint 134 may pivot along any axis and, in some embodiments, may comprise a ball-and-sock joint. In a preferred embodiment, the first joint 134 is connected to the lower end 107 of the track 105 of the exercise machine 100, such as within its groove 108, though the first joint 134 may be located at various other locations on the exercise machine 100.

As the pitch actuator 130 is extended, the front end 101 of the exercise machine 100 is raised. As the pitch actuator 130 is retracted, the front end 101 of the exercise machine 100 is lowered. Such raising and lowering of the front end 101 of the exercise machine 100 will increase or decrease the pitch angle of the exercise machine 100 with respect to the base 90. It should be stressed that, in some embodiments, the pitch actuator 130 may raise and lower the rear end 102 of the exercise machine 100, with the front end 101 remaining in place.

The roll actuator 146 is best shown in FIGS. 26, 28, 30-33. The roll actuator 146 allows the exercise machine 100 to pivot about a roll axis 83 with respect to the base 90, thus increasing or decreasing the roll angle of the exercise machine 100 with respect to the base 90. Extension of the roll actuator 146 pivots the exercise machine 100 about the roll axis 83 in a first direction and retraction of the roll actuator 140 pivots the exercise machine 100 about the roll axis 83 in a second direction.

Figure 32:
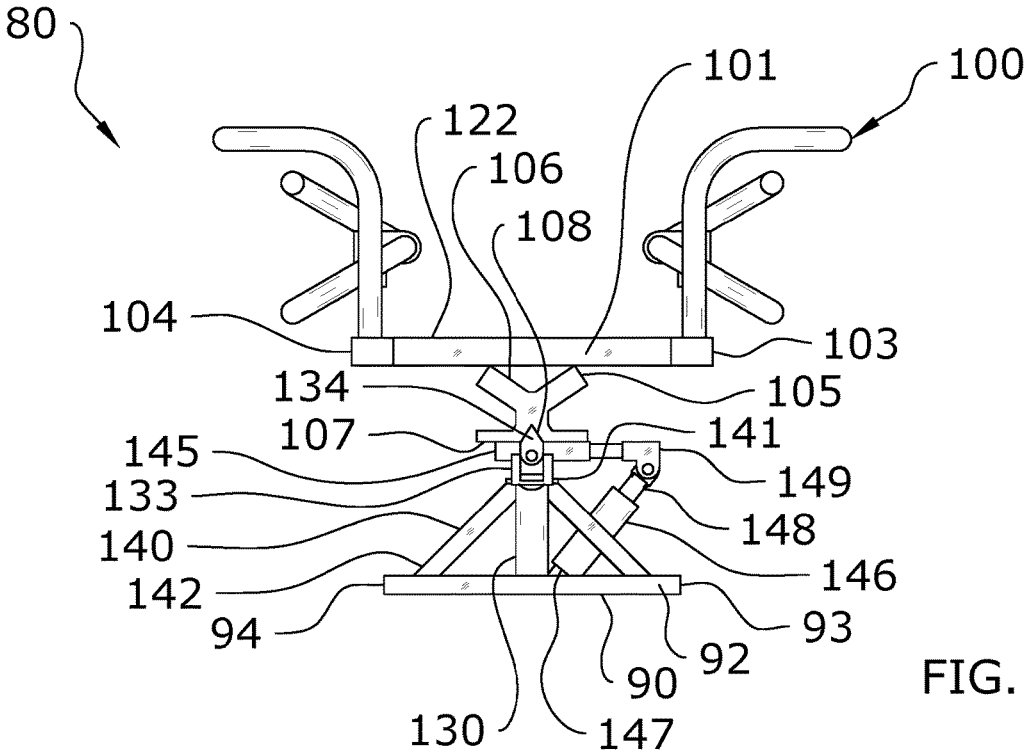
FIG. 32 is a frontal view of the present invention using a first actuation embodiment.
Figure 33:
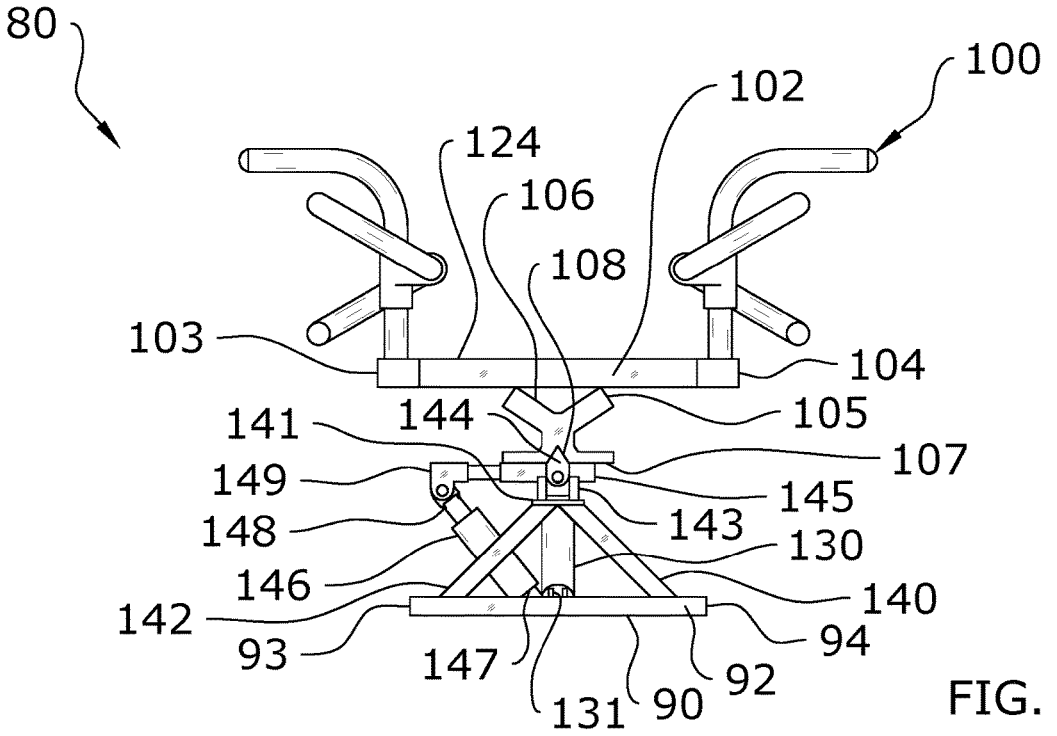
FIG. 33 is a rear view of the present invention using a first actuation embodiment.

As best shown in FIGS. 32 and 33, the roll actuator 146 may be slightly elevated from the base 90, such as through usage of a roll support 140. The roll support 140 extends upwardly from the base 90, with the upper end 141 of the roll support 140 being connected to a bracket 143 and the lower end 142 of the roll support 140 being connected to the base 90.

As best shown in FIG. 33, a cross member 145 is secured to the bracket 143, with the roll actuator 146 being connected at its first end 147 to the base 90 and at its second end 148 to an actuator connector 149 which connects the roll actuator 146 with the cross member 145. The cross member 145 is directly connected to the lower end 107 of the track 105 of the exercise machine 100. A second joint 144 connects the roll support 140 to the lower end 107 of the track 105, such as within the groove 108. As the roll actuator 146 is extended, it will pivot the roll support 140, thus causing the second joint 144 to pivot itself and allow the exercise machine 100 to pivot with respect to the base 90 about the roll axis 83. Various types of second joints 144 may be utilized, including a ball-and-socket joint as discussed previously.

Figure 34:
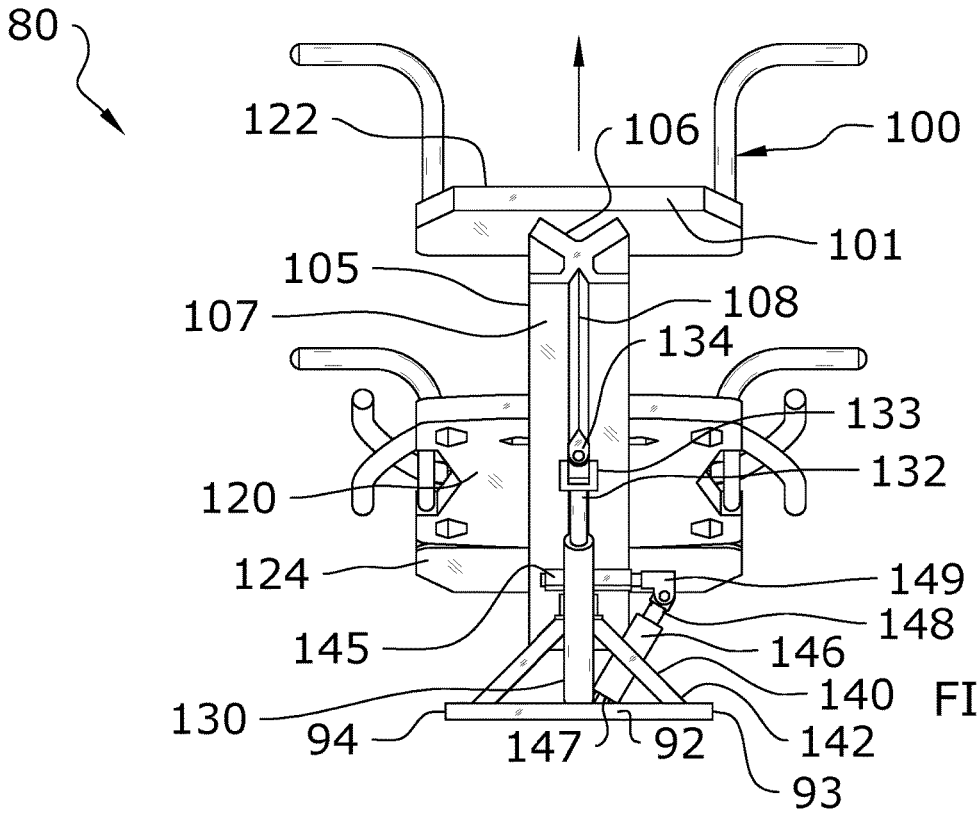
FIG. 34 is a frontal view of the present invention pitched upward using a first actuation embodiment.

FIGS. 27, 28, 34, and 35 illustrate use of the first actuation embodiment to adjust the roll and pitch angles of the exercise machine 100 with respect to the base 90. Actuation of the pitch actuator 130 will increase or decrease the pitch angle of the exercise machine 100 by pivoting the exercise machine 100 about the pitch axis 82, such as shown in FIG. 34. The extension of the pitch actuator 130 will raise either the front end 101 or the rear end 102 of the exercise machine 100 with respect to the base 90, with the opposite end remaining in place.

Figure 35:
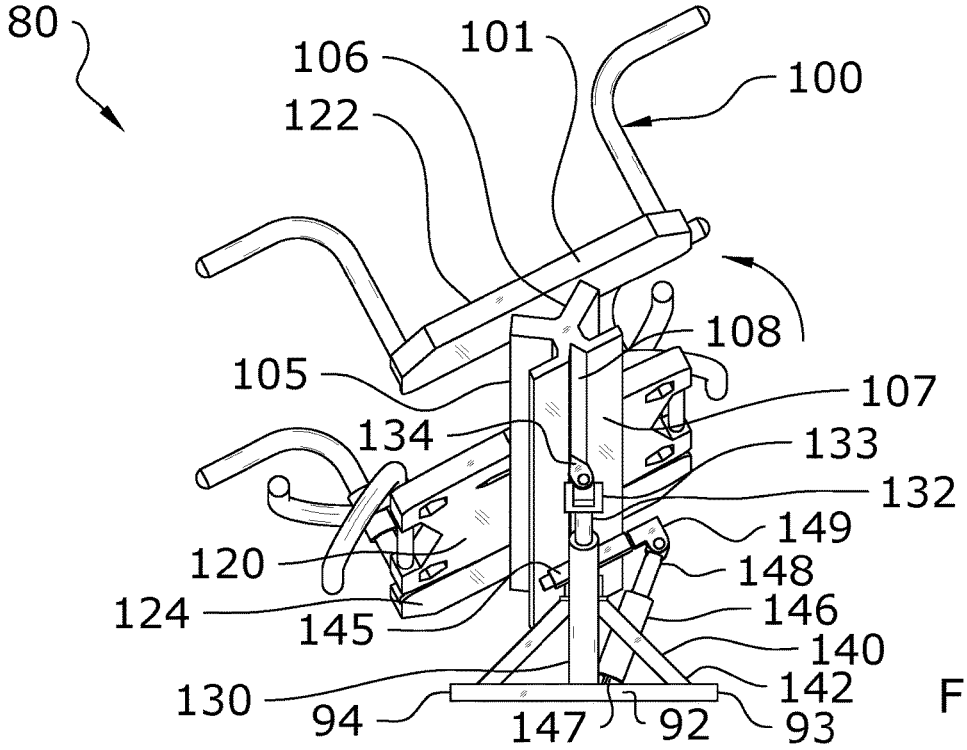
FIG. 35 is a frontal view of the present invention pitched upward and rolled using a first actuation embodiment.
Figure 36:
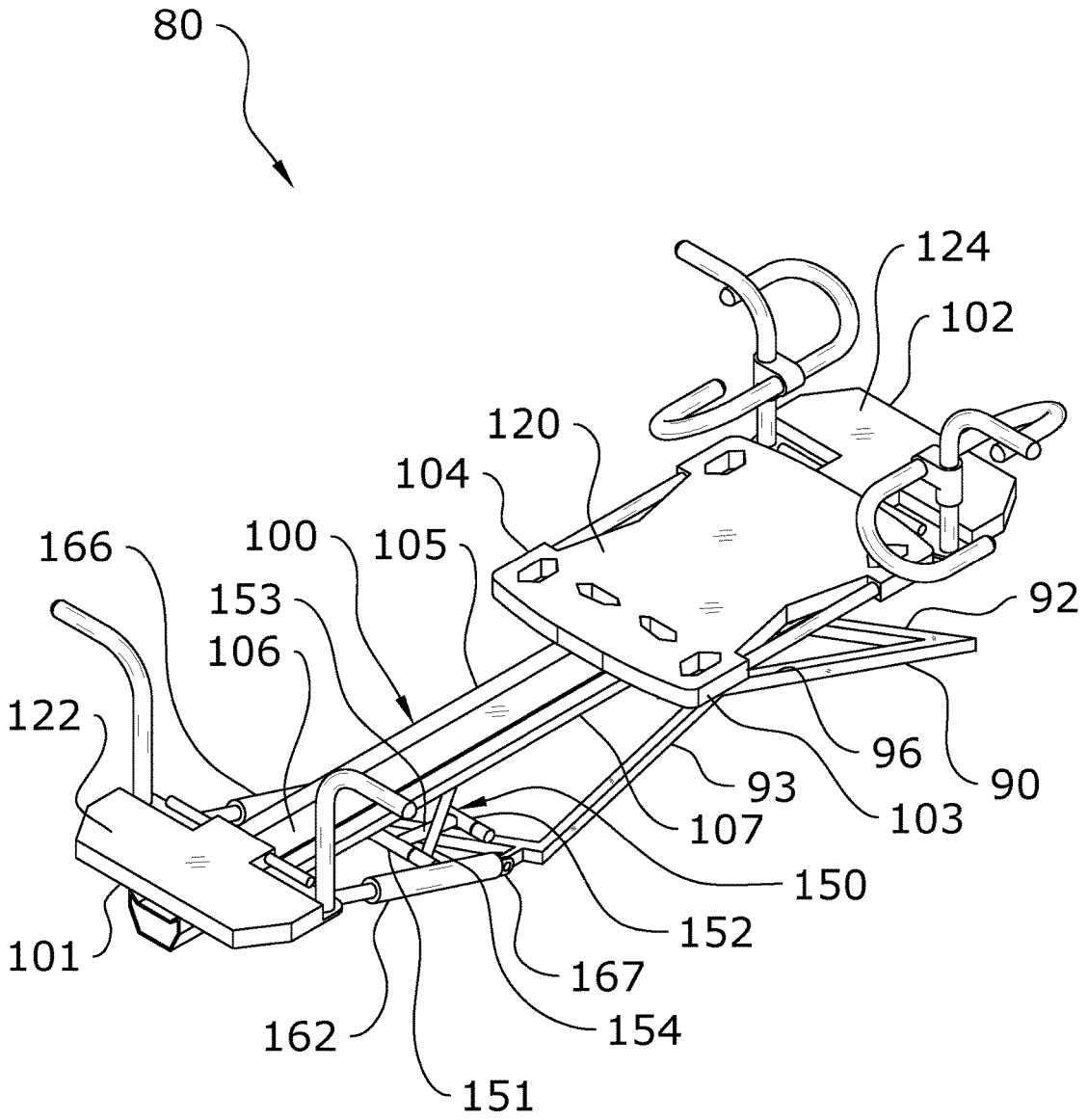
FIG. 36 is an upper perspective view of the present invention using a second actuation embodiment.
Figure 37:
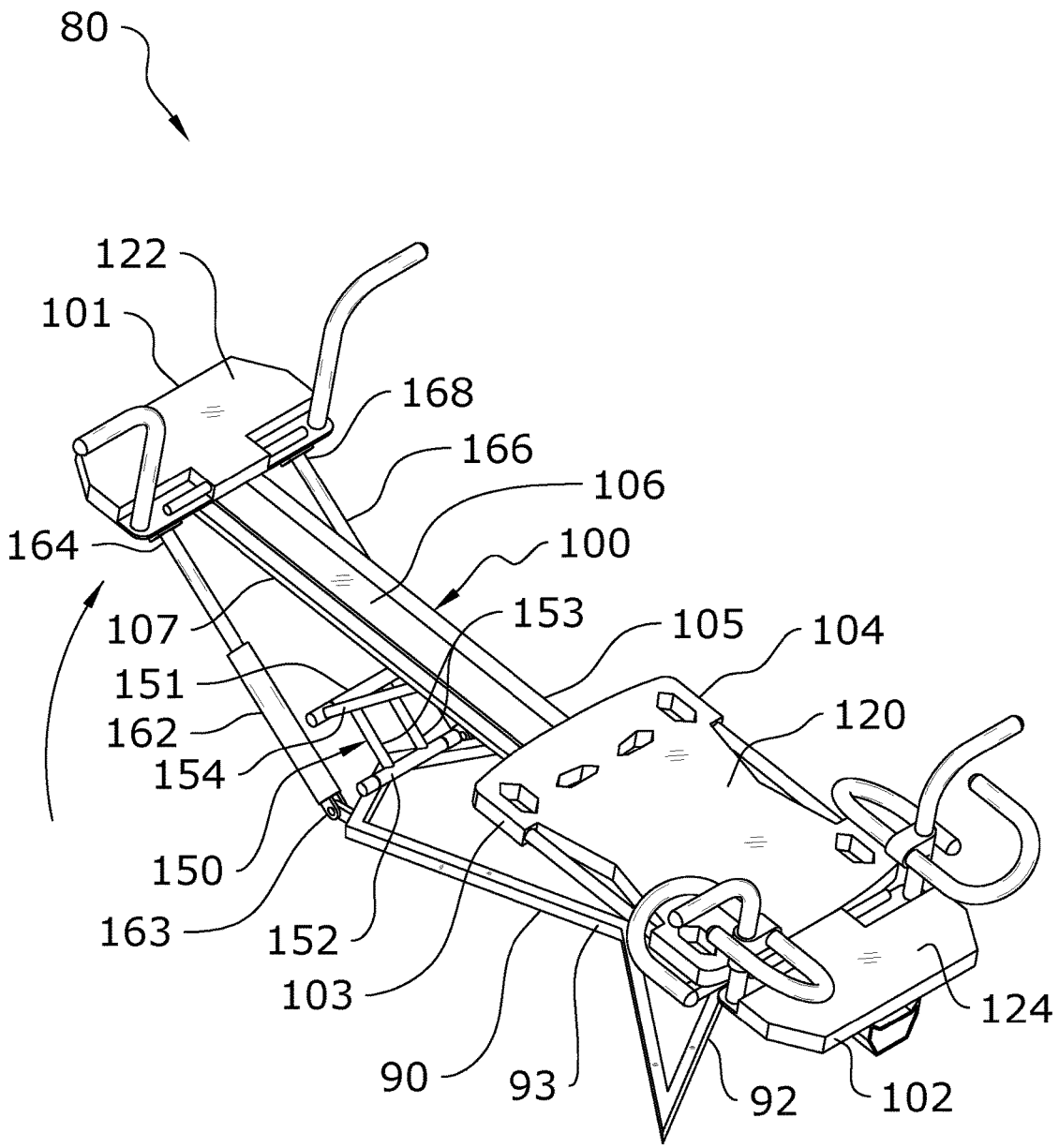
FIG. 37 is an upper perspective view of the present invention pitched upward using a second actuation embodiment.

Similarly, actuation of the roll actuator 146 will increase or decrease the roll angle of the exercise machine 100 by pivoting the exercise machine 100 about the roll axis 83, such as shown in FIG. 35. The extension of the roll actuator 146 will raise the first side 103 or the second side 104 of the exercise machine 100 with respect to the base 90, with the opposite side remaining in place.

E. Second Actuation Embodiment and Operation Thereof

FIGS. 36-46 illustrate a second actuator embodiment for use with the present invention. In the embodiment shown therein, a first actuator 162 and a second actuator 166 operate together to adjust the pitch angle and/or roll angle of the exercise machine 100. The first and second actuators 162, 166 each extend between the base 90 and the exercise machine 100. The first and second actuators 162, 166 may be substantially parallel as shown in the figures, or other orientations may be utilized.

Figure 38:
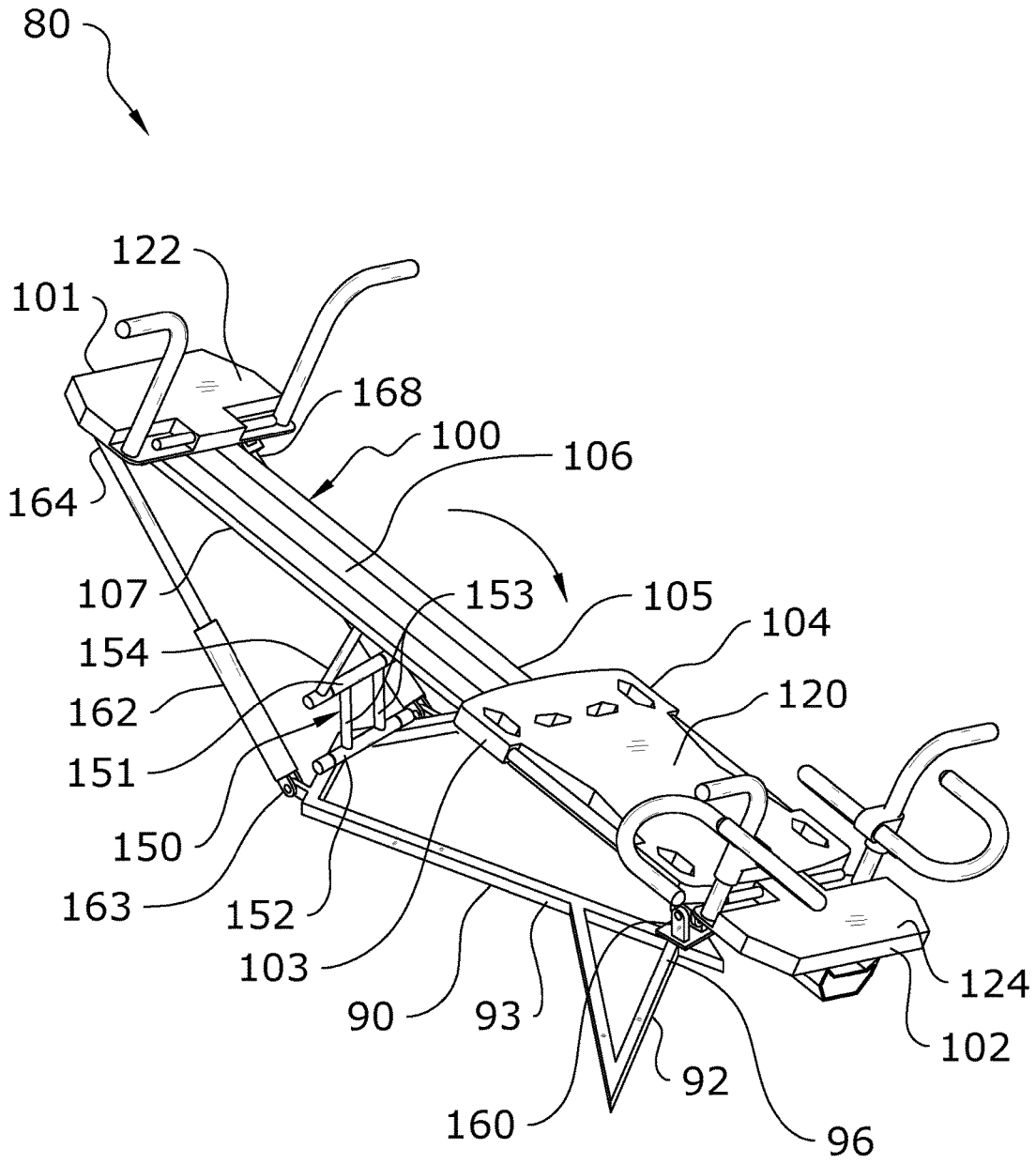
FIG. 38 is an upper perspective view of the present invention pitched upward and rolled using a second actuation embodiment.
Figure 39:
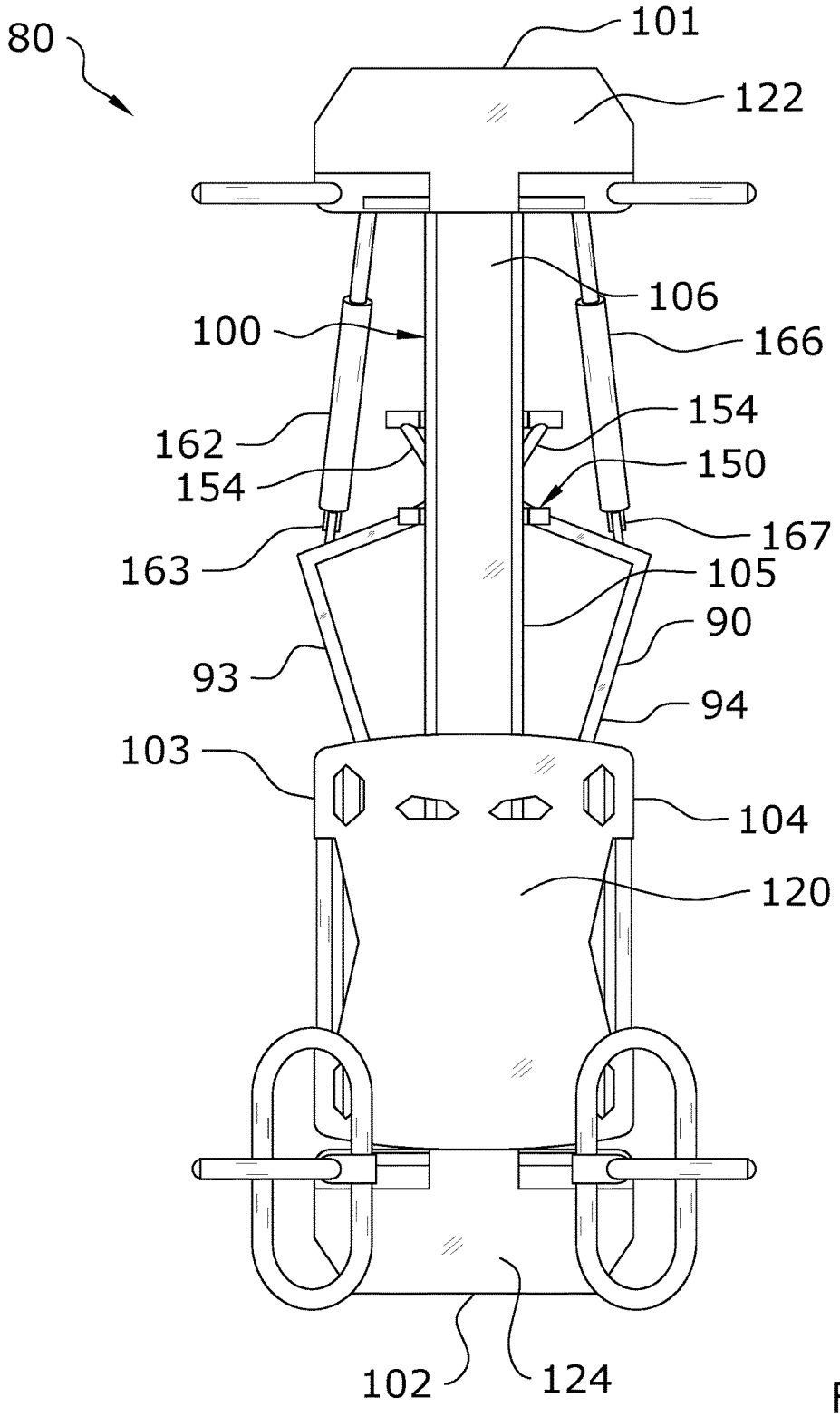
FIG. 39 is a top view of the present invention using a second actuation embodiment.

A frontal mount 150 may be connected between the front end 91 of the base 90 and the exercise machine 100 such as shown in FIG. 38. The frontal mount 150 effectuates a pivotal connection between the base 90 and exercise machine 100 which allows the exercise machine 100 to be pitched upward or downward in response to certain movements of the actuators 162, 166.

Figure 46:
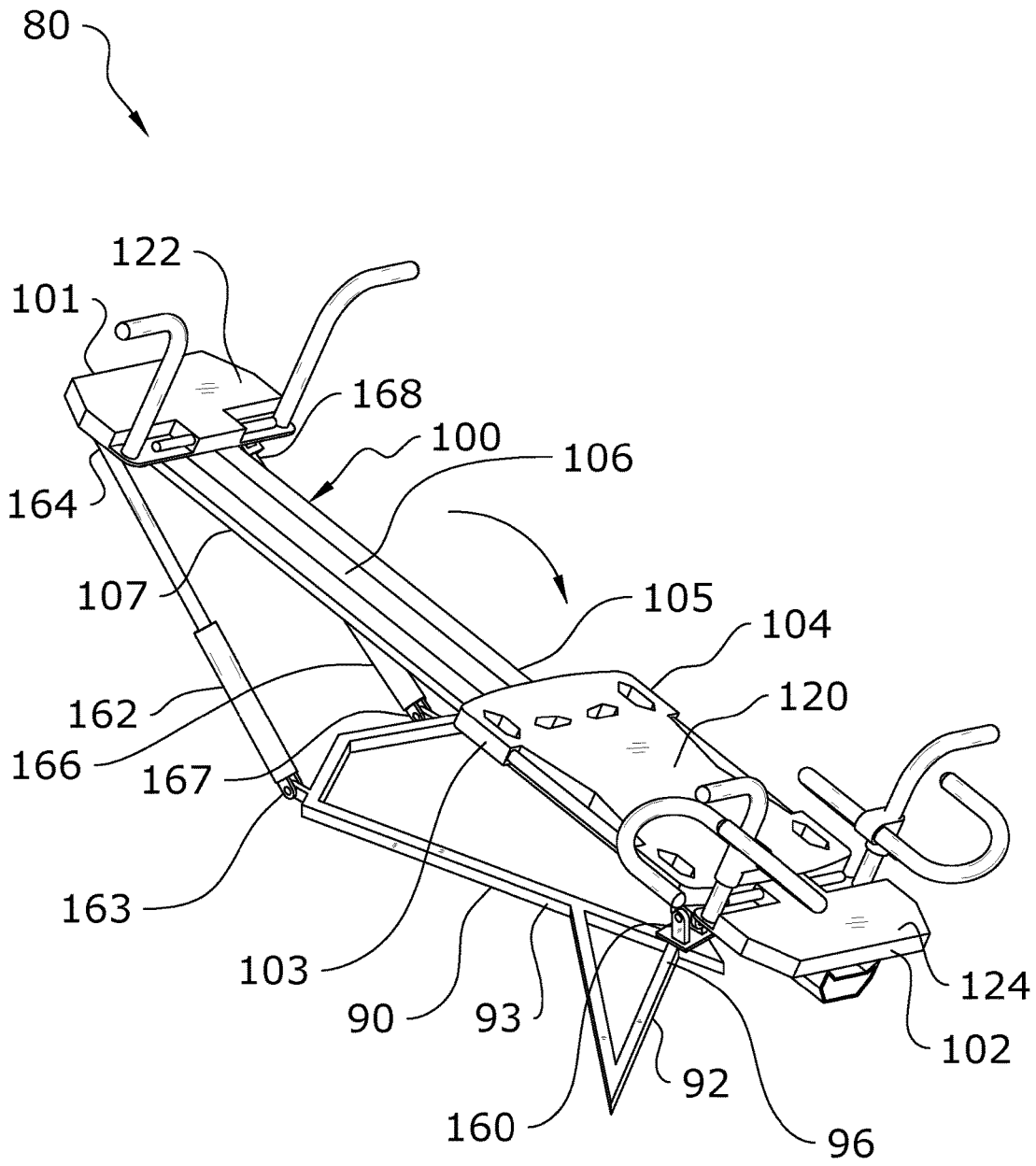
FIG. 46 is an upper perspective view of the present invention using a second actuation embodiment without a frontal mount.

While the frontal mount 150 is not required (an illustration of the second actuation embodiment without a frontal mount 150 is shown in FIG. 46), it can provide a smoother and uniform pitching motion of the exercise machine 100. The frontal mount 150 is best shown in FIG. 38 and may comprise an upper bar 151, a lower bar 152, and vertical supports 153 connecting the upper and lower bars 151, 152. The upper and lower bars 151, 152 are both rotatable so that the frontal mount 150 may adjust when in use. Pivot supports 154 extend from the rotatable upper bar 151 and converge into a single frontal joint 155 which connects to the exercise machine 100, such as to the lower end 107 of the track 105, though other locations may be utilized. The frontal joint 155 may comprise any type of joint, including a ball-and-socket joint.

Figure 41:
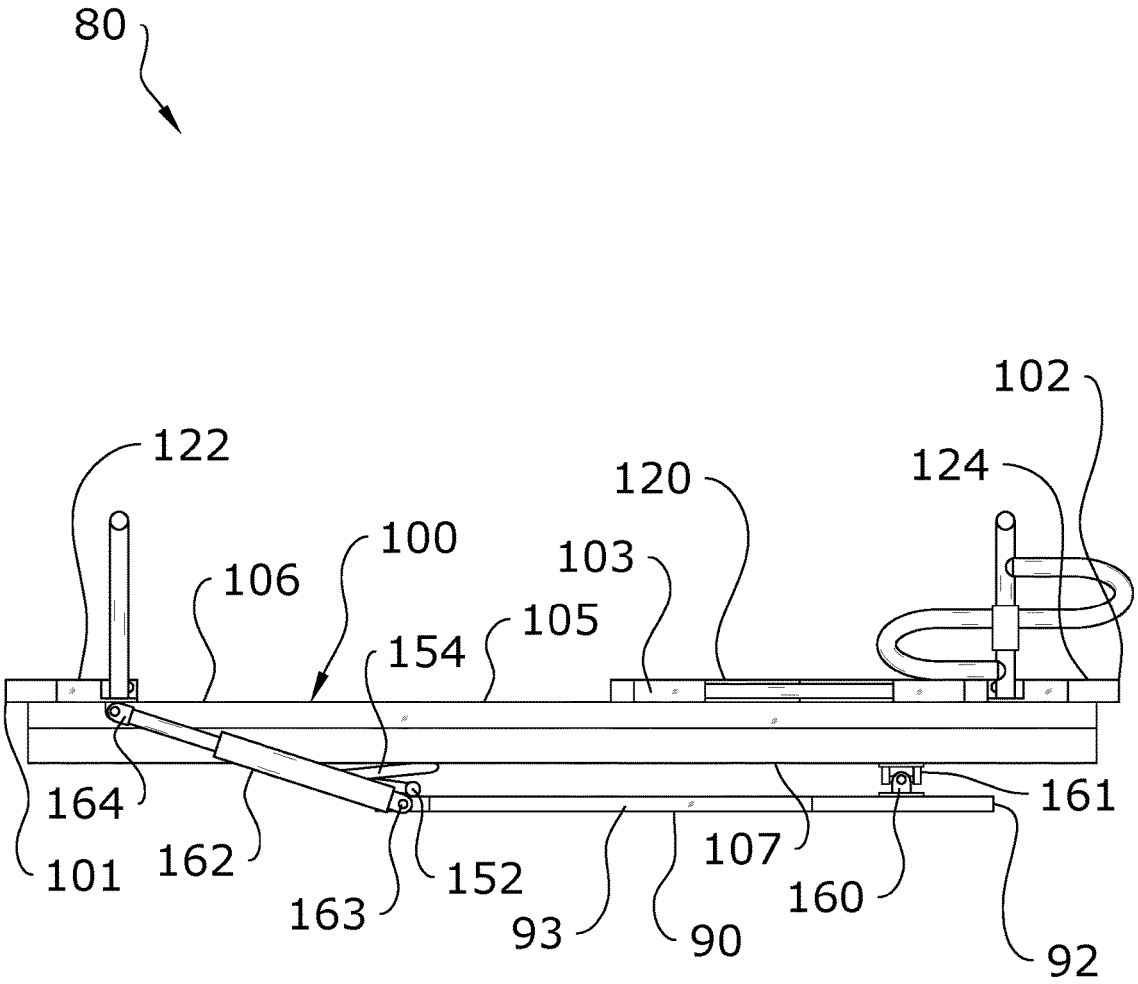
FIG. 41 is a side view of the present invention using a second actuation embodiment.
Figure 42:
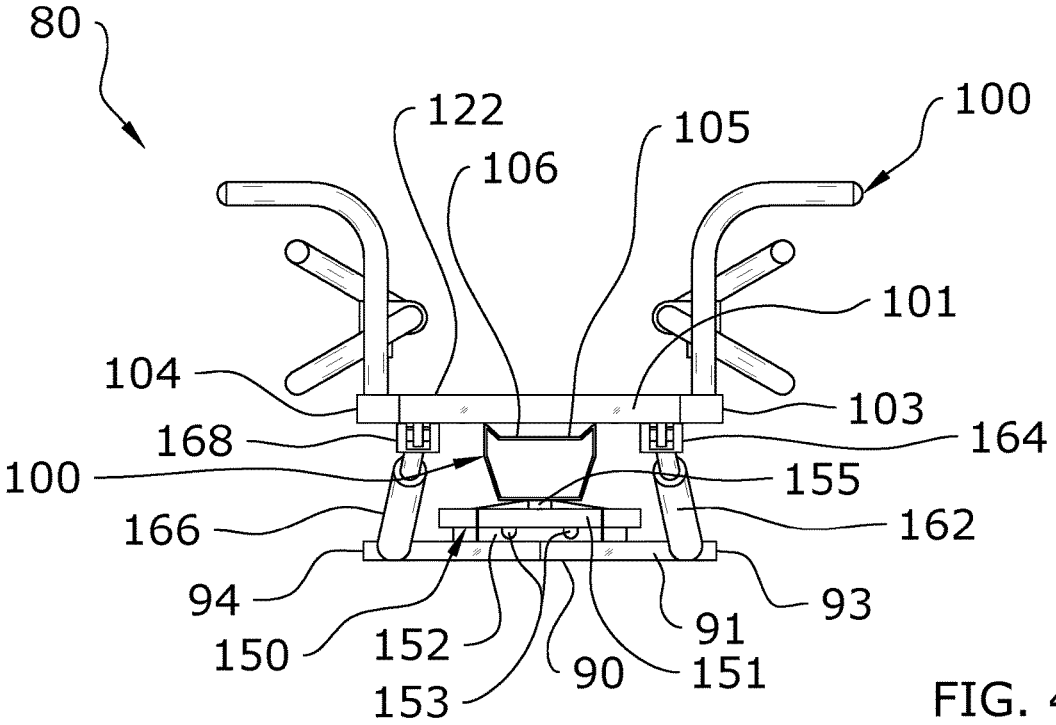
FIG. 42 is a frontal view of the present invention using a second actuation embodiment.
Figure 43:
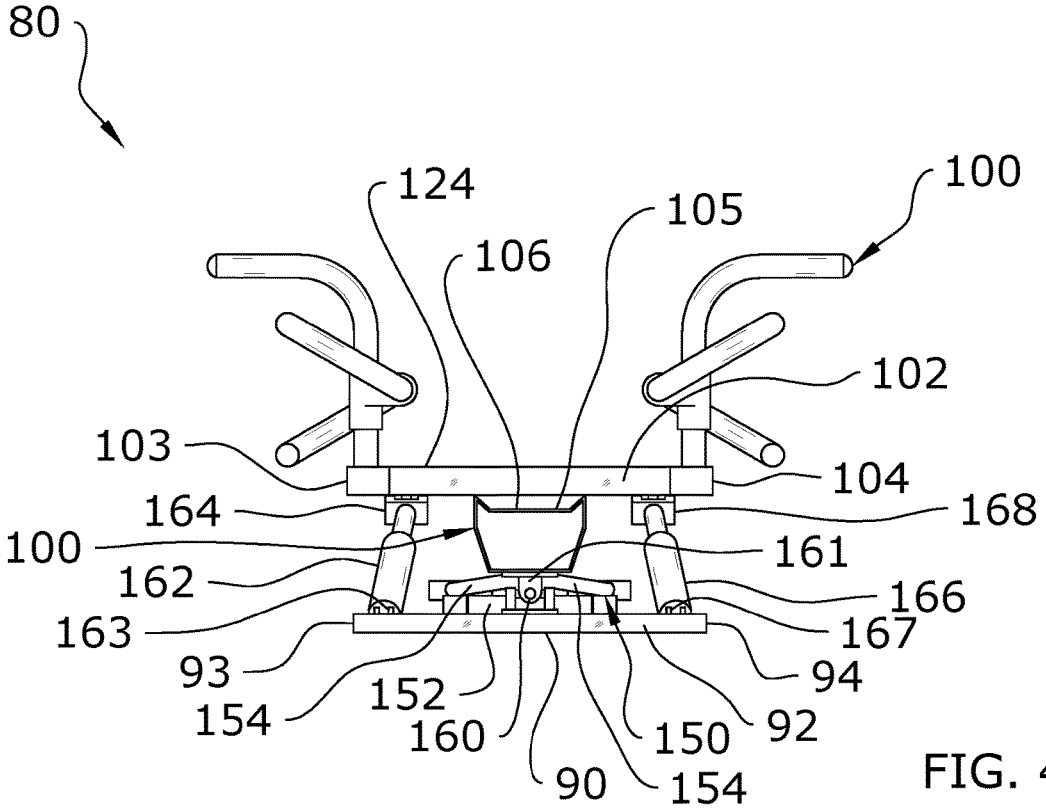
FIG. 43 is a rear view of the present invention using a second actuation embodiment.
Figure 44:
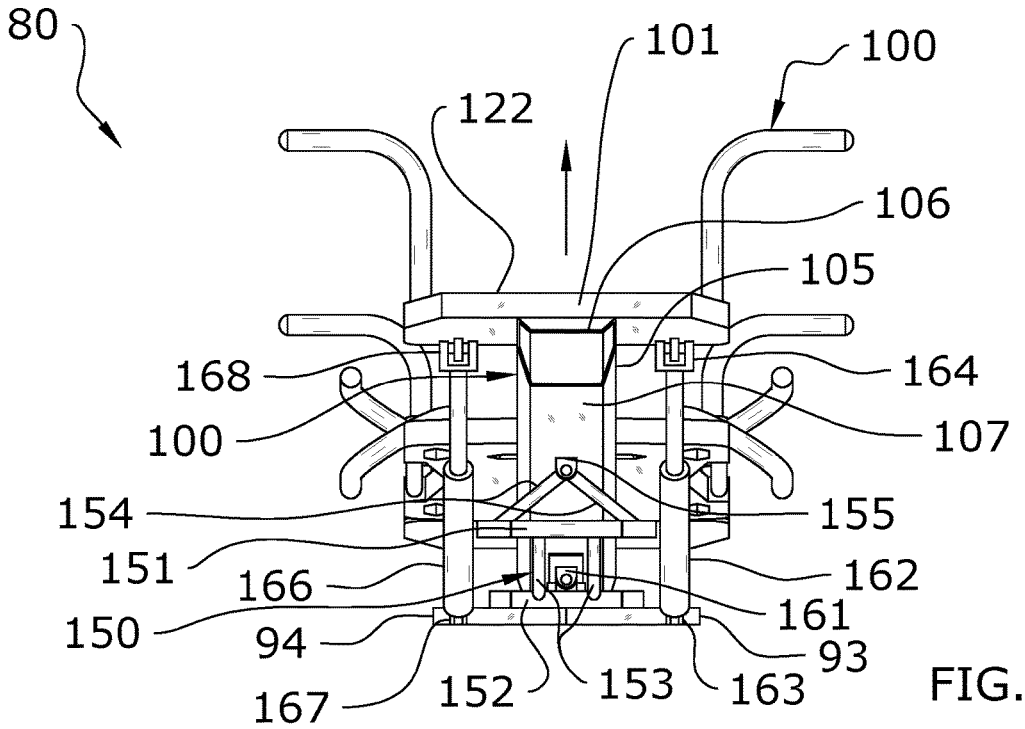
FIG. 44 is a frontal view of the present invention pitched upward using a second actuation embodiment.
Figure 45:
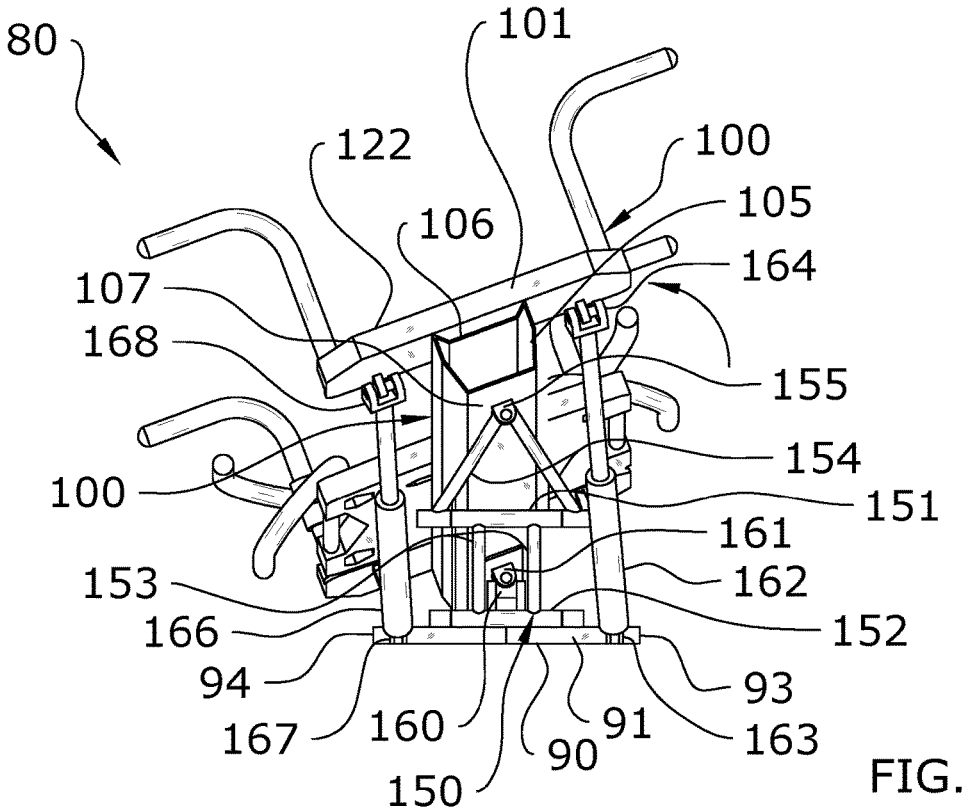
FIG. 45 is a frontal view of the present invention pitched upward and rolled using a second actuation embodiment.

A pair of interconnected joints 160, 161 may be utilized to connect the rear end 92 of the base 90 with the rear end 102 of the exercise machine 100. These interconnected joints 160, 161 are best shown in FIG. 41 and comprise a first rear joint 160 and a second rear joint 161. As shown in the figures, the first and second rear joints 160, 161 are interconnected to allow full pivotal rotation of the exercise machine 100 about the pitch and roll axes 82, 83.

The first and second actuators 162, 166 of the second actuation embodiment are best shown in FIG. 40. The first actuator 162 extends between the front end 91 of the base 90 at its first side 93 and the front end 101 of the exercise machine 100 at its first side 103. Thus, the first end 163 of the first actuator 162 is connected to the base 90 and the second end 164 of the first actuator 162 is connected to the exercise machine 100.

The second actuator 166 extends between the front end 91 of the base 90 at its second side 94 and the front end 101 of the exercise machine 100 at its second side 104. Thus, the first end 167 of the second actuator 166 is connected to the base 90 and the second end 168 of the second actuator 166 is connected to the exercise machine 100. The first and second actuators 162, 166 will preferably be comprised of the same length and may be oriented in a substantially parallel relationship with each other. In the embodiment shown in the figures, the second ends 164, 168 of the first and second actuators 162, 166 are each connected to either side of the first platform 122.

In use, the first and second actuators 162, 166 operate together to adjust both the pitch angle and the roll angle of the exercise machine 100 with respect to the base 90. When the first actuator 162 is extended, the exercise machine 100 will pivot about the roll axis 83 in a first direction, thus increasing the roll angle of the exercise machine 100. When the second actuator 166 is extended, the exercise machine 100 will pivot about the roll axis 83 in a second direction, thus decreasing the roll angle of the exercise machine 100. When making such roll adjustments, the opposing actuator 162, 166 may itself retract to aid in the motion (i.e. extending the first actuator 162 and retracting the second actuator 166 to pivot about the roll axis 83). If the opposing actuator 162, 166 remains static, then there may be some pivoting of the exercise machine 100 about the pitch axis 82 in addition to the roll axis 83.

When both the first and second actuators 162, 166 are extended at the same time and speed, the exercise machine 100 is pivoted about the pitch axis 82 in a first direction with respect to the base 90, thus increasing the pitch angle of the exercise machine 100. When both the first and second actuators 162, 166 are retracted at the same time and speed, the exercise machine 100 is pivoted about the pitch axis 82 in a second direction with respect to the base 90, thus decreasing the pitch angle of the exercise machine 100. If both first and second actuators 162, 166 are simultaneously extended but at different speeds, the roll angle of the exercise machine 100 may also be adjusted.

F. Methods of Exercise

The present invention may be utilized to vary the typical exercise routine of an exerciser 85 to be far more efficient and to work on different groups of muscles as discussed herein. For example, an exerciser 85 could first position herself on the exercise machine 100 to perform a first exercise, then pivot the exercise machine 100 about a first axis in a first direction and about a second axis in a second direction to reach a first position. The first exercise may be performed during or after the pivoting of the exercise machine 100 to the first position.

After completing the exercise in the first position, the exercise machine 100 may be further pivoted about either or both axes to reach a second position which is different from the first position (for example, the attitude of the second position may be different than that of the first position). A second exercise may then be performed during or after the pivoting of the exercise machine 100 to the second position.

After completion of the second exercise, the exercise machine 100 may again be pivoted to a third position which is different from the first and second positions (for example, the attitude of the third position may be different than that of the first and second positions). A third exercise may then be performed during or after the pivoting of the exercise machine 100 to the third position (the third exercise could be different from the first two exercises, or may comprise the same exercise as the first exercise).

FIG. 47 is an exemplary illustration showing a workout planning chart. It is well known that exercisers 85 or their instructors plan a typical workout session in such a manner so as to exercise certain muscles and muscle groups. The chart lists a representative schedule intended to exercise all of the major muscles of the body, often referred to as a "whole body workout".

The objective of the workout is to, as would be obvious to those skilled in the art, exercise to the desired intensity all of the muscle groups. For each major muscle or group, a preferred exercise would be selected. A complete workout therefore will comprise a large number of different exercises performed in sequence. Another objective of a workout is to maximize the intensity of muscle stimulation, and further to activate as many muscles as possible during each exercise.

The pitch and roll of the exercise machine 100 of the present invention provides for a novel method of increasing the number of muscles engaged during an exercise by unbalancing the exerciser 85, thereby requiring the exerciser 85 to engage muscles to counteract the multi-plane attitude of the exercise machine 100. These muscles would not necessarily be engage when performing the exercise on a horizontal plane.

As can be seen in the chart, a smaller number of exercises are needed when exercising according to the present invention because the pitch and roll of the plane of the exercise machine 100 increases the number of muscles, and further increases the intensity that engaged muscles must work. By comparison, a smaller number of muscles are engaged with less intensity when exercising on a traditional exercise machine, therefore requiring more types of exercises in order to fully exercise all of the targeted muscles.

Figure 48:
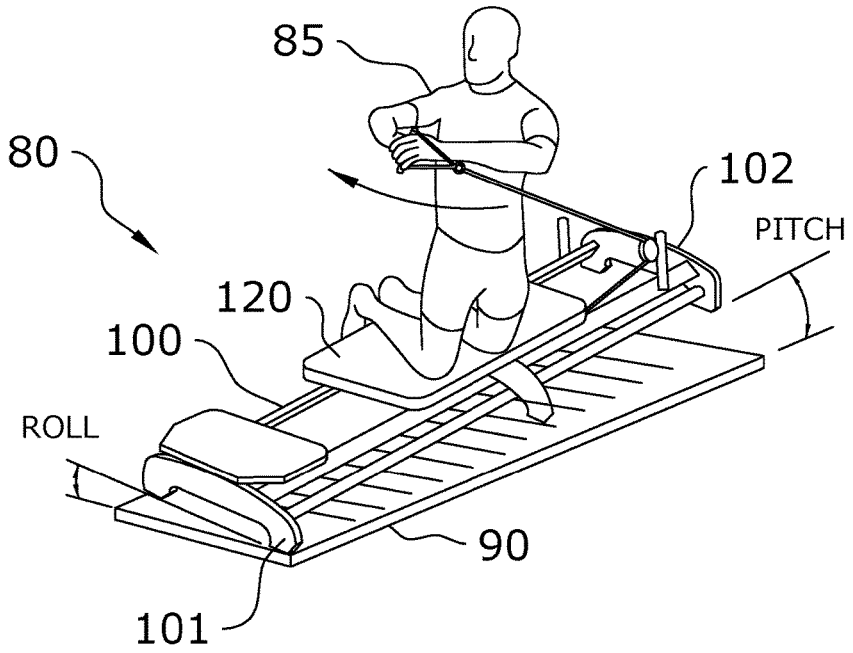
FIG. 48 is an exemplary illustration showing an exerciser on an improved exercise machine positioned about two axes.

Literally, in an exercise facility, time is money. As more time is consumed for each exercise class during business hours, the establishment is constrained to conducting fewer classes—therefore receiving less revenue. Those skilled in the art will immediately appreciate the competitive commercial advantages of the present invention that reduces the number of exercises, and therefore reduces the time required for an exerciser 85 to realize the full benefit of a whole body workout. With exercisers 85 occupying the machines 100 for less time, the facility can therefore conduct many more classes during the business day. FIG. 48 is an exemplary illustration showing an exerciser 85 on an improved exercise machine 100 positioned about two axes. In the drawing, a representative exerciser 85 is positioned upon the slidable carriage 120 of an exercise machine 100. As can be readily seen, the exercise machine 100 has been pitched so that the rear end 102 of the exercise machine 100 is raised relative to the front end 101, and the exercise machine 100 is rolled clockwise about the longitudinal roll axis.

The accompanying chart shows the number of angular degrees of pitch and roll of the exercise machine 100 as tested under two experimental conditions. The test was conducted using a cohort of human exercisers 85 to determine the degree to which exercising on an exercise machine 100 aligned with the horizontal plane differed from exercising on an exercise machine 100 pitched and rolled on two axes. A plurality of electromyography (EMG) sensors were affixed over primary and stabilizing muscles of the test subjects in order to measure the electrical signals generated by motor neurons during muscle contraction. Test subjects performed the same exercises on a first machine 100 positioned on the horizontal plane, and on an exercise machine 100 in a non-horizontal plane.

A higher EMG signal from a muscle when exercising on one machine relative to exercising on a different machine is a positive indicator as to which machine was better at intensifying the exercise routine. The EMG data further illustrates whether or not more muscles were stimulated while performing the improved method of exercising on a multi-axis, non-horizontal plane as compared to the traditional exercise method on a horizontal plane.

In the first test condition, the exercise machine 100 was not rolled or pitched as evidenced by the 0° pitch and roll angles. In other words, in the first test condition the top exercise surface of the exercise machine 100 was aligned with the horizontal plane of the floor.

In a second test condition, the rear end 102 of the exercise machine 100 was elevated to 9° relative to the front end 101, and the exercise machine 100 was rolled about the roll axis 83 by 13°. As can be readily seen, the pitch and roll angles create a unique, non-horizontal plane for movement of the exercise machine 100.

The representative exercise of the illustration is referred to as the "leaning torso twist" that preferably targets the particular muscles and muscle groups listed in the chart. It should be noted that when the exerciser 85 reverses positions to perform the exercise on the opposite side of the carriage, the "(left)" and "(right") references in the chart will reverse to "right" and "left" respectively.

Figure 49:
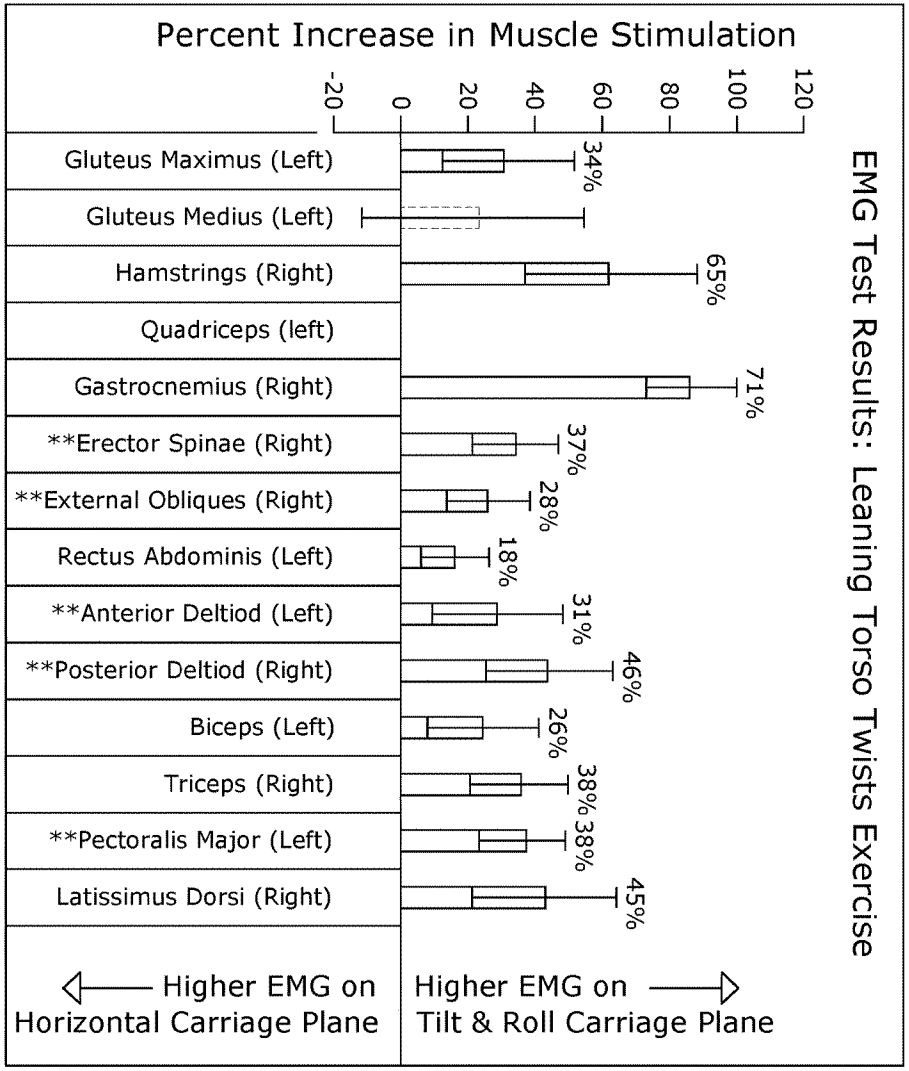
FIG. 49 is an exemplary illustration showing a graph of electromyography test results showing improved muscle stimulation.

FIG. 49 is an exemplary illustration showing a graph of electromyography test results that correlate to improved muscle stimulation. The targeted muscles for the exercise of FIG. 48 are shown on the table for clarity. However, since the exercise requires engagement of more muscles not typically engaged when performing this exercise on a horizontal plane of a traditional machine, a total of fourteen primary and stabilizing muscles were tested for each test subject, first on the non-horizontal plane, and secondly on the horizontal plane.

The solid bar indicates an average tested condition in which the motor neurons of the corresponding muscles produced a higher EMG signal level, and therefore a corresponding workout intensity, when exercising on a rolled and pitched platform compared to the horizontal platform. The error bars illustrate the high and low range of the cohort. The percentage figures shown above each chart bar indicate the average percent increase of muscle stimulation when performing the new method of exercise on the improved machine with a rolled and pitched carriage compared to the traditional method of exercising on a horizontal carriage.

The data overwhelmingly show that when performing the exercise according to the present invention, all five of the targeted muscles experienced 28% to 46% increase in muscle stimulation compared to the traditional machine and method. Those skilled in the art will further appreciate that the data also illustrates that seven other muscles typically not engaged during the performance of this exercise on a horizontal plane also experienced 18% to 71% increases in muscle stimulation.

Proving the efficacy of the new exercise method of the present invention, the data therefore favorably supports the advantages of the present invention over the previously taught and widely practiced method of exercising on a horizontally oriented exercise machine 100.

Figure 50:
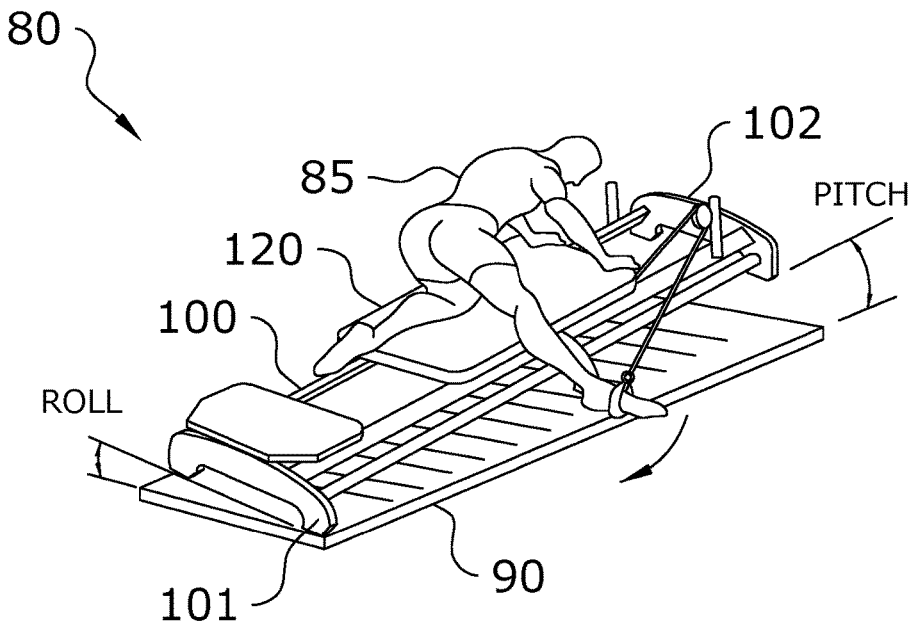
FIG. 50 is an exemplary illustration showing an exerciser on an improved exercise machine positioned about two axes.

FIG. 50 is an exemplary illustration showing an exerciser 85 on an improved exercise machine 100 positioned about two axes. The exerciser 85 is performing an exercise referred to as "scrambled eggs" wherein one foot engages a stirrup affixed to a pull rope extending to the spring biased slidable carriage 120 through a pulley. Muscle force is used to press the leg in the force direction so that the slidable carriage 120 slides towards the pulley end.

This exercise is first performed using one leg as illustrated for a prescribed number of repetitions, then repeating the exercise using the opposite foot extending from the opposite side of the machine. The chart of FIG. 49 shows that in test condition (2), the exercise machine 100 was pitched upward at a 12 degree angle, while the longitudinal axis was rolled at 13 degrees from the horizontal. Performing this exercise under Test Condition (2) increased muscle stimulation an average of 35% across the three primarily targeted muscles as shown.

Figure 51:
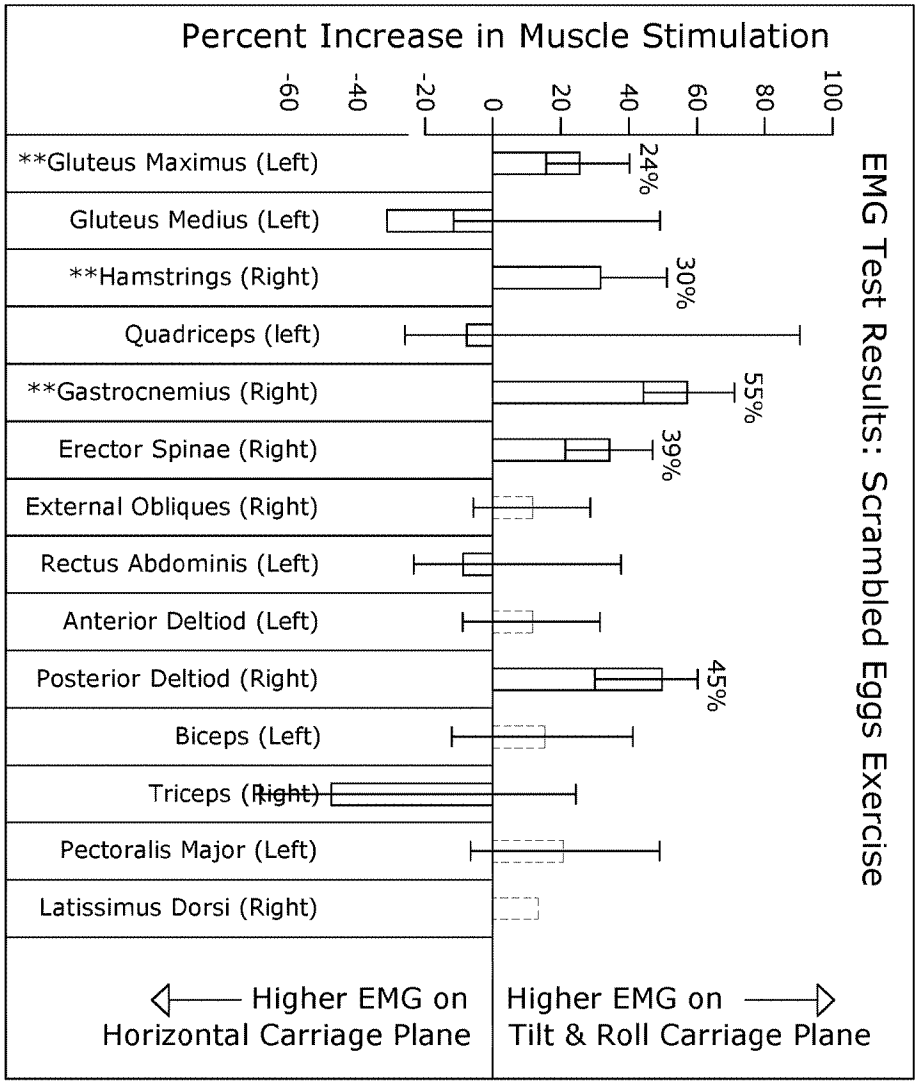
FIG. 51 is an exemplary illustration showing a graph of electromyography test results showing improved muscle stimulation.

FIG. 51 is an exemplary illustration showing a graph of electromyography test results that correlate to improved muscle stimulation. More specifically, the three muscles preferably targeted by this exercise are listed in the table. As can be readily seen, the muscle stimulation of these targeted muscles increased a significant 24% to 55% over muscle stimulation while performing the exercise on a traditional horizontally positioned exercise machine 100.

Additionally, the experimentation proved that two other muscles were also stimulated more by the novel exercise method and improved exercise machine 100 of the present invention. Some data obtained from the cohort proved to be inconsistent and therefore not a reliable indicator of an advantage of the present invention or traditional exercise machines 100 and exercise methods. On the other hand, some muscles, for instance the triceps, showed a muscle stimulation advantage of traditional exercise methods over the machine and method of the present invention. It should be noted however that both of these instances of inconsistency and apparent advantage of traditional machines and methods are of no consequence within the scope of the whole body workout since they are not, and were never intended as muscles preferably targeted by this particular exercise.

However, the experiment proved that exercising according to the method of the present invention produced a previously unknown and unanticipated result, that being that two muscles not targeted by this exercise on traditional machines produced significantly beneficial improvement in muscle stimulation. In a real world environment, exercisers 85 would perform new or improved exercises specifically targeting these muscles.

Figure 52:
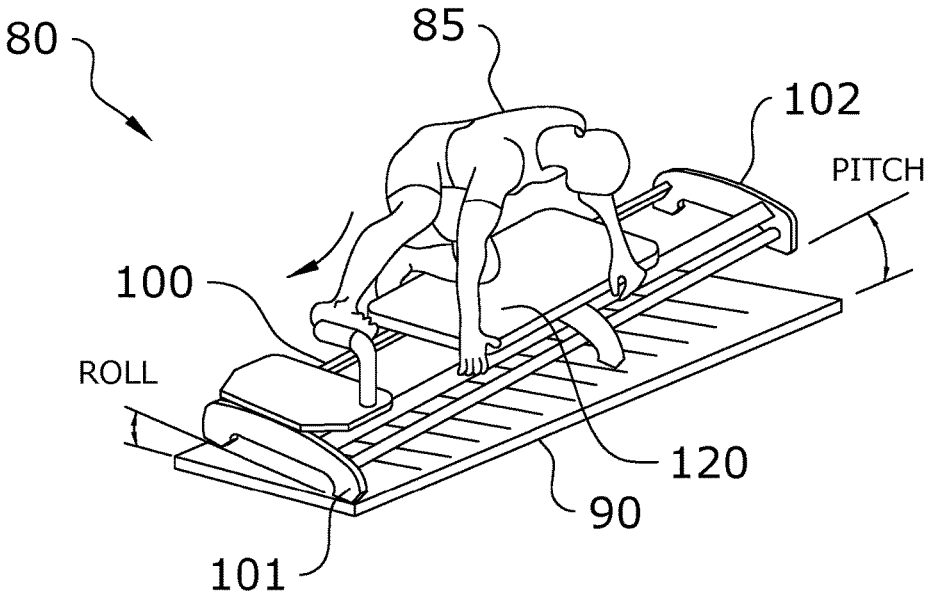
FIG. 52 is an exemplary illustration showing an exerciser on an improved exercise machine positioned about two axes.

FIG. 52 is an exemplary illustration showing an exerciser 85 performing an exercise referred to as a "spider kick" on an improved exercise machine 100 positioned about two axes. More specifically, as listed in the chart of FIG. 51, one end of the longitudinal axis is pitched upward at an angle of 12 degrees, and the exercise machine 100 positioned thereupon is rolled at an angle of 13 degrees.

This exercise is normally intended to target four primary muscles, the quadracept, gluteus maximus, hamstrings and gastronemius of the working side of the body, The exerciser 85 places a foot upon a press bar, and while positioned on the exercise machine 100, extends the leg with sufficient force as required to move the slidable carriage 120 towards the raised end against a spring biased resistance.

While performing this exercise according to the novel exercise method upon the improved machine of the present invention in Test Condition (2), the test subjects averaged an increase in muscle stimulation of over 32 percent as compared to performing this exercise on a traditional exercise machine 100 with the slidable carriage 120 in a horizontal plane.

Figure 53:
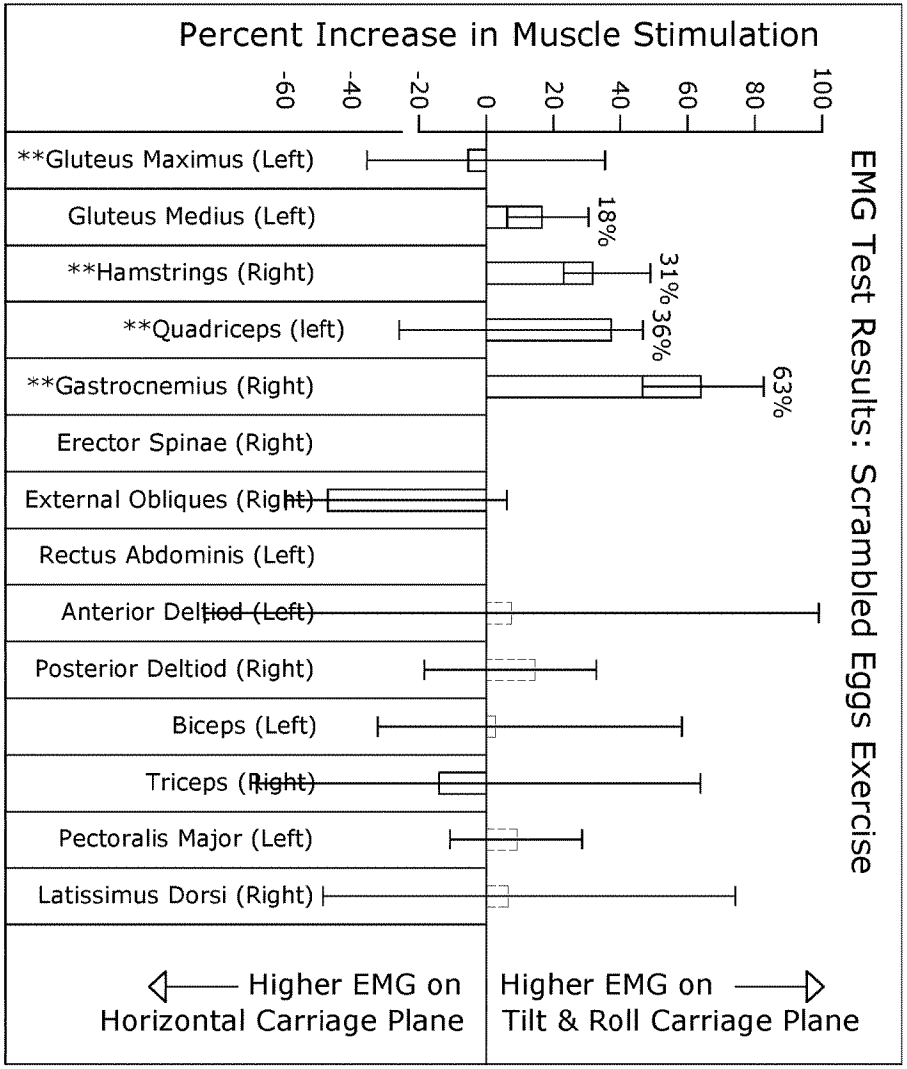
FIG. 53 is an exemplary illustration showing a graph of electromyography test results showing improved muscle stimulation.

FIG. 53 is an exemplary illustration showing a graph of electromyography test results that correlate to improved muscle stimulation. For clarity, the four muscles targeted by this exercise are listed in the table. As can be readily seen, three of the four muscles experienced significant 31% to 63% increases in muscle stimulation when performing this exercise according to the novel exercise method of the present invention as compared to performing the exercises on a traditional exercise machine 100.

One muscle, the gluteus maximus, experienced slightly lower stimulation on the multi-axis, non-horizontal exercise machine 100 of the present invention. The lower EMG reading on this muscle when performing this exercise cannot be considered dispositive to the efficacy of the novel exercise method or improved machine taught by the present invention.

First, the huge advantages of significant muscle stimulation of three of the four targeted muscles outweigh the slight reduction in stimulation of the gluteus maximus. Secondly, the improvement in gluteus medius, not a traditionally targeted muscle for this exercise, further outweighs the slight reduction in the gluteus maximus. Thirdly, as previously discussed, a whole body workout is comprised of a plurality of discrete exercises performed in a sequence during a workout session. Therefore, the overarching objective of such an exercise period is to ensure that the combination of exercises cumulatively provide the muscle stimulation of all primary and stabilizing muscles.

Therefore, the slight reduction of gluteus maximus stimulation in the exercise of FIG. 53 is completely negated, and further outweighed by the significant 24% increase in gluteus maximus stimulation during the performance of the exercise of FIG. 52. Still further, although the graph shows a higher stimulation of the external oblique and triceps when performing this exercise on a horizontal plane, these are not targeted muscles for this exercise, so the apparent negative reading is of no consequence. In fact, as illustrated in the graph of FIG. 50, the "leaning torso twist" performed according to the present invention created a 38% increase in triceps muscle stimulation, and a 28% increase in stimulation of the external obliques.

When the "spider kick" exercise of the drawing is combined with the "leaning torso twist" of FIG. 51, the overall muscle stimulation, and therefore beneficial exercise training increases significantly when performing exercises according to the present invention as compared to performing the same exercises in accordance with traditional exercise methods on an exercise machine 100 aligned with the horizontal plane.

Figure 54:
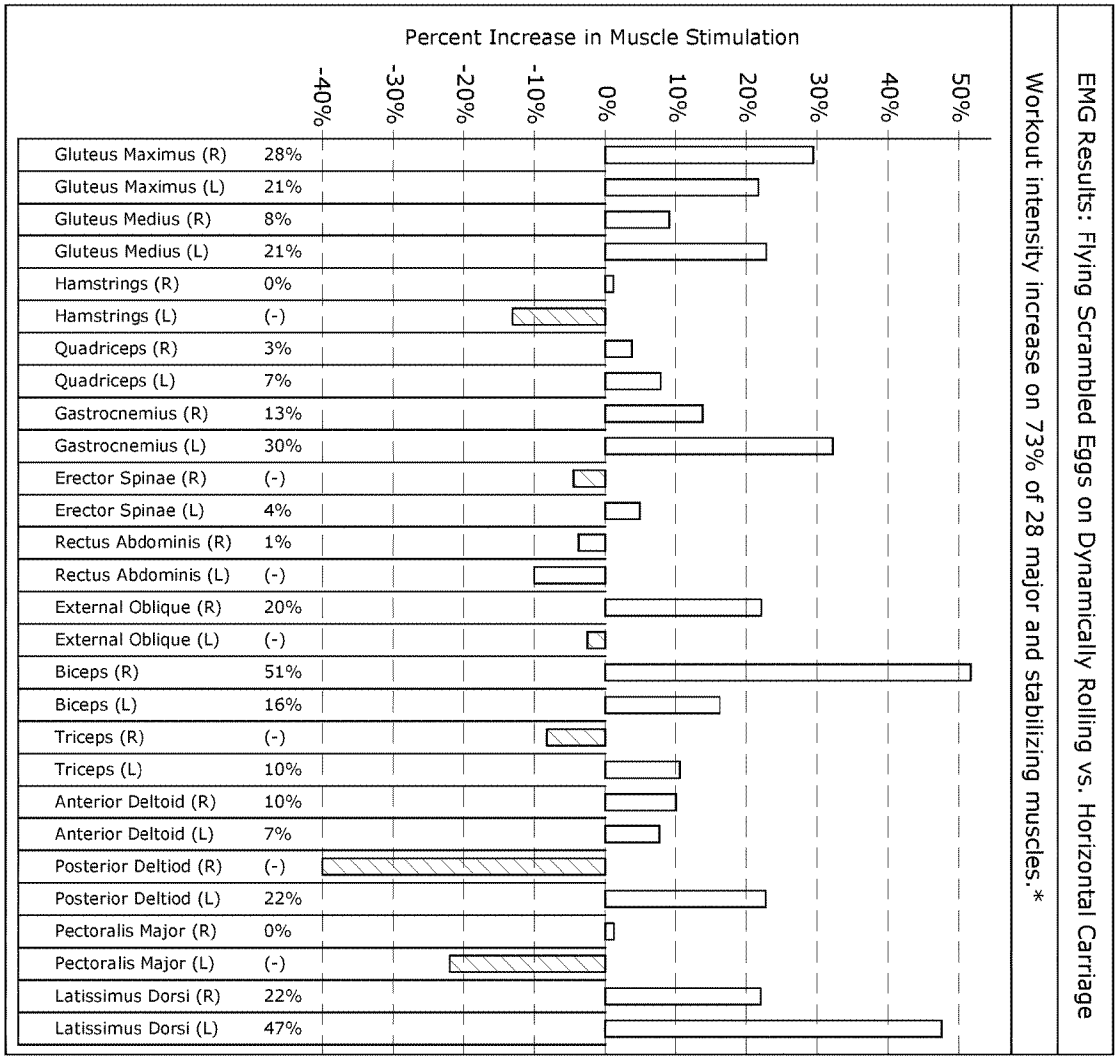
FIG. 54 is an exemplary illustration showing a graph of electromyography test results showing improved muscle stimulation.

FIG. 54 is an exemplary illustration showing a graph of electromyography test results showing improved muscle stimulation. As proven through experimentation, and as previously discussed, the novel method of exercising on an improved exercise machine 100 with variable pitch and roll angles to change the plane of the surface of the exercise machine 100 accelerates fitness conditioning by stimulating more muscles, increases the level of muscle stimulation, and is beneficial and preferred when compared to exercising on a traditional exercise machine 100 following the teachings of conventional exercise methods.

In another experimental test, 28 different muscles comprising the upper body, trunk, and lower body were tested to determine whether dynamically varying the pitch and/or roll of the already non-horizontal exercise surface while performing exercises would further intensify the muscle stimulation, thereby accelerating even more the strength and cardiovascular condition.

The EMG data collected and analyzed is shown in the graph. The bars extending positively from the zero line in the drawing show that muscle stimulation of eighteen muscles increased when performing the scrambled egg exercise on the dynamically-changing plane of the exercise machine 100 of the present invention.

On the other hand, bars extending in the negative direction from the zero percent line indicate the muscles that were stimulated more when performing the exercise on a traditional exercise machine 100 positioned in a horizontal plane. Of particular importance are the crosshatched bars on the chart. As previously discussed, many exercises are performed with a focus on the right or left side of the body, and are therefore performed on the opposite side in sequence. This ensures that both the right and left sides of the body are equally exercised.

Now, while the crosshatched bars indicate a right or left muscle which was not advantageously stimulated while exercising according to the present invention, one should note that for each muscle represented by a negative crosshatched bar, there is an adjacent positive bar for the opposing muscle. In other words, when a "Triceps (R)" shows a negative crosshatch bar, the "Triceps (L)" shows a 10% positive muscle stimulation when performing the exercise according to the present invention.

Therefore, by performing this exercise according to the novel method and improved machine of the present invention, first on the right side, then performing it again on the left side, 26 of the 28 muscles are beneficially more stimulated when compared to the traditional, horizontal plane Pilates machine.

Testing and experimentation provides evidence of improved muscle stimulation, and therefore accelerated strength and cardiovascular conditioning, when:

a. The new and novel method of exercising is performed on an exercise machine 100 that is statically positioned to a non-horizontal plane of an improved exercise machine 100, and
b. The new and novel method of exercising is performed on an exercise machine 100 that is dynamically moved to varying non-horizontal planes of an improved exercise machine 100 simultaneously with the performance of an exercise.

Compared to traditional exercise machines 100, the multi-axis pitch and roll functionality of the present invention provides the unique ability to engage more major and minor muscles to accelerate strength and cardiovascular conditioning, increase balance and coordination, and burn more calories as a result of engaging more muscles during the performance of an exercise, and do so in a shorter workout period than has ever been possible with traditional exercise machined 100 and exercise methods that are limited to a substantially horizontal exercise surface exercise.

It should be noted that the mechanism or mechanisms that may be used to tilt or roll the exercise surface in one or more planes relative to the horizontal support base may include mechanical, electromechanical, manual lift, pneumatic, or hydraulic lifting or tilting means, and the pitch and roll axis may be located at any position within the perimeter of the machine. Further, the means to modify the pitch and roll of the upper structure may be actuated manually or automatically, whether the pitch and roll are established prior to start of exercise, or are modified during the performance of the exercise. The foregoing description is not meant to be limiting.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a base;

a track movably connected to the base;

a carriage slidably connected to the track, wherein the carriage is slidable along a substantial length of the track;

a biasing member attached to the carriage to apply a resistive force to the carriage;

a first platform connected to the track, wherein the first platform is positioned near a first end of the track;

a first actuator connected between the base and the track; and a second actuator connected between the base and the track, wherein the first actuator and the second actuator are operable to move the track about a first axis and a second axis with respect to the base;

wherein the first actuator and the second actuator are motorized;

wherein the first actuator and the second actuator operate to pivot the track about the first axis and the second axis;

wherein the first axis is comprised of a pitch axis of the track and wherein the second axis is comprised of a roll axis of the track.

2. The exercise machine of claim 1, wherein extension of both the first actuator and the second actuator pivots the track about the first axis in a first direction.

3. The exercise machine of claim 2, wherein retraction of both the first actuator and the second actuator pivots the track about the first axis in a second direction.

4. The exercise machine of claim 3, wherein pivoting the track about the first axis in the first direction increases a pitch angle of the track with respect to the base and wherein pivoting the track about the first axis in the second direction decreases the pitch angle of the track with respect to the base.

5. The exercise machine of claim 1, wherein a distal end of the first actuator is connected to a first side of the track.

6. The exercise machine of claim 5, wherein a distal end of the second actuator is connected to a second side of the track, wherein the second side of the track is opposite of the first side of the track.

7. The exercise machine of claim 1, including a second platform connected to the track, wherein the second platform is positioned near a second end of the track.

8. The exercise machine of claim 7, wherein the carriage, the first platform and the second platform each have an upper surface that is positioned on or near a common plane.

9. The exercise machine of claim 1, wherein the base has a front end, a rear end, a first side and a second side.

10. The exercise machine of claim 9, wherein the base is configured to rest upon a ground surface.

11. The exercise machine of claim 1, wherein the first actuator is comprised of a linear actuator.

12. The exercise machine of claim 11, wherein the second actuator is comprised of a linear actuator.

13. The exercise machine of claim 1, wherein the first actuator is configured to extend and retract.

14. The exercise machine of claim 13, wherein the second actuator is configured to extend and retract.

15. The exercise machine of claim 1, wherein the first actuator pivots the track about the first axis and wherein the second actuator pivots the track about the second axis.

16. The exercise machine of claim 1, wherein the first actuator is adapted to increase or decrease a pitch angle of the track with respect to the base.

17. The exercise machine of claim 16, wherein the second actuator is adapted to increase or decrease a roll angle of the track with respect to the base.

18. The exercise machine of claim 1, wherein the first actuator and the second actuator are connected to at least one motor.

19. The exercise machine of claim 1, wherein the first actuator and the second actuator are individually motorized.

20. The exercise machine of claim 1, wherein extension of the first actuator pivots the track about the second axis in a second direction.

21. The exercise machine of claim 1, wherein the movement of the track about the first axis and the second axis occurs concurrently with one another.

22. The exercise machine of claim 1, wherein the movement of the track about the first axis and the second axis occurs independent of one another.

23. The exercise machine of claim 1, wherein the track is comprised of a singular rail.

24. The exercise machine of claim 1, wherein the track is comprised of multiple rails.

25. The exercise machine of claim 1, wherein the track is comprised of a pair of rails.

26. The exercise machine of claim 1, wherein the track includes an upper end and a lower end, wherein the carriage is movable connected to the upper end of the track.

27. The exercise machine of claim 1, wherein the biasing member is comprised of a spring.

28. The exercise machine of claim 1, wherein the biasing member is comprised of an elastic cord.

29. The exercise machine of claim 1, wherein base is comprised of a ground surface.

30. The exercise machine of claim 1, wherein the frame is comprised of a solid configuration.

31. The exercise machine of claim 1, including a first pair of handlebars connected to the track near the first end of the track or the first platform.

32. A method of exercising on the exercise machine of claim 1, comprising:

positioning an exerciser on the exercise machine to perform a first exercise;

moving the track about the pitch axis and about the roll axis to a first position; and performing the first exercise by the exerciser during or after the step of moving the track to the first position.

33. The method of claim 32, wherein the first exercise is comprise of the exerciser applying a force against the carriage along a longitudinal axis of the exercise machine.

34. The method of claim 33, wherein the force is against a force of the biasing member.

35. The method of claim 32, comprising:

moving the track about the pitch axis and about the roll axis to a second position, wherein the second position has a different attitude than the first position; and performing a second exercise by the exerciser during or after the step of moving the track to the second position.

36. The method of claim 35, wherein moving the track about the pitch axis occurs concurrently with moving the track about the roll axis.

37. The method of claim 32, wherein the first exercise is comprised of moving the carriage along a portion of the track.

38. An exercise machine, comprising:

a base;

a track having a longitudinal axis, wherein the track is movably connected to the base;

a carriage slidably connected to the track, wherein the carriage is slidable along a substantial length of the track;

a biasing member attached to the carriage to apply a resistive force to the carriage;

a first platform connected to the track, wherein the first platform is positioned near a first end of the track;

a first actuator connected between the base and the track; and a second actuator connected between the base and the track, wherein the first actuator and the second actuator are operable to move the track about a first axis and a second axis with respect to the base;

wherein the first actuator and the second actuator are motorized;

wherein the first actuator and the second actuator operate to pivot the track about the first axis and the second axis;

wherein the first axis is comprised of a pitch axis of the track and wherein the second axis is comprised of a roll axis of the track;

wherein a distal end of the first actuator is connected to a first side of the track;

wherein a distal end of the second actuator is connected to a second side of the track, wherein the second side of the track is opposite of the first side of the track;

wherein the first actuator is comprised of a linear actuator and wherein the second actuator is comprised of a linear actuator.

39. The exercise machine of claim 38, wherein the track is comprised of a singular rail.

40. The exercise machine of claim 38, wherein the track is comprised of multiple rails.

41. The exercise machine of claim 38, wherein the track is comprised of a pair of rails.

42. A method of exercising on the exercise machine of claim 38, comprising:

positioning an exerciser on the exercise machine to perform a first exercise;

moving the track about the pitch axis and about the roll axis to a first position; and performing the first exercise by the exerciser during or after the step of moving the track to the first position.

43. The method of claim 42, wherein the first exercise is comprised of moving the carriage along a portion of the track.

44. The method of claim 42, wherein the first exercise is comprise of the exerciser applying a force against the carriage along a longitudinal axis of the exercise machine.

45. An exercise machine, comprising:

a base;

a track having a longitudinal axis, wherein the track is movably connected to the base;

a carriage slidably connected to the track, wherein the carriage is slidable along a substantial length of the track;

a biasing member attached to the carriage to apply a resistive force to the carriage, wherein the biasing member is comprised of a spring;

a first platform connected to the track, wherein the first platform is positioned near a first end of the track;

a first pair of handlebars connected to the track near the first end of the track or the first platform;

a second platform connected to the track, wherein the second platform is positioned near a second end of the track;

a first actuator connected between the base and the track; and a second actuator connected between the base and the track, wherein the first actuator and the second actuator are operable to move the track about a first axis and a second axis with respect to the base;

wherein the first actuator and the second actuator are motorized;

wherein the first actuator and the second actuator operate to pivot the track about the first axis and the second axis;

wherein the first axis is comprised of a pitch axis of the track and wherein the second axis is comprised of a roll axis of the track;

wherein a distal end of the first actuator is connected to a first side of the track;

wherein a distal end of the second actuator is connected to a second side of the track, wherein the second side of the track is opposite of the first side of the track;

wherein the first actuator is comprised of a linear actuator and wherein the second actuator is comprised of a linear actuator;

wherein the carriage, the first platform and the second platform each have an upper surface that is positioned on or near a common plane;

wherein the track includes an upper end and a lower end, wherein the carriage is movable connected to the upper end of the track.

* * * * *